US006010809A

United States Patent [19]

Ishii et al.

[11] Patent Number: 6,010,809

[45] Date of Patent: Jan. 4, 2000

[54] SILVER HALIDE LIGHT-SENSITIVE COLOR PHOTOGRAPHIC MATERIAL

[75] Inventors: Fumio Ishii; Shinichi Daiba; Tomohiro Oshiyama; Shigeto Hirabayashi; Yoshiko Iwai, all of Hino, Japan

[73] Assignee: Konica Corporation, Japan

[21] Appl. No.: 09/166,943

[22] Filed: Jun. 10, 1998

[30] Foreign Application Priority Data

| | | | |
|---|---|---|---|
| Jun. 16, 1997 | [JP] | Japan | 9-158733 |
| Jul. 8, 1997 | [JP] | Japan | 9-182358 |
| Jul. 24, 1997 | [JP] | Japan | 9-214002 |
| Aug. 12, 1997 | [JP] | Japan | 9-217563 |
| Aug. 19, 1997 | [JP] | Japan | 9-222442 |

[51] Int. Cl.[7] ..... G03C 1/04; G03C 1/06

[52] U.S. Cl. ..... 430/20; 430/503; 430/543; 430/552; 430/553; 430/558

[58] Field of Search ..... 430/20, 503, 543, 430/552, 553, 558

[56] References Cited

U.S. PATENT DOCUMENTS 5,108,666 4/1992 Zeroni et al. ..... 264/22

5,700,608 12/1997 Eshelman et al. ..... 430/20

FOREIGN PATENT DOCUMENTS 0249662 12/1987 European Pat. Off. .

60-211452 10/1985 Japan .

OTHER PUBLICATIONS

Tiddy et al., "Highly Ordered Aggregates in Dilute Dye–Water Systems", Langmuir vol. 11 No. 2 pp. 390–393 (Feb. 1995).

Derwent Publication XP–002074029, 1 pg. Abstract (Aug. 1988).

*Primary Examiner*—John A. McPherson

*Attorney, Agent, or Firm*—Jordan B. Bierman; Bierman, Muserlian and Lucas

[57] ABSTRACT

A silver halide light-sensitive color photographic material is disclosed. The material comprises thermotropic low molecular crystal. The material is improved in light fastness of a dye image and dye-forming efficiency.

22 Claims, No Drawings

SILVER HALIDE LIGHT-SENSITIVE COLOR PHOTOGRAPHIC MATERIAL

FIELD OF THE INVENTION

The present invention relates to a silver halide light-sensitive color photographic material, and more specifically, to a silver halide light-sensitive color photographic material which exhibits excellent color reproduction and light fastness and further excellent dye-forming efficiency.

BACKGROUND OF THE INVENTION

In the field of silver halide light-sensitive color photographic materials, color images prepared employing couplers requires neither color variation nor color fading when exposed to light over extended hours or stored at high temperature and humidity.

However, it has been known that these color images exhibit unsatisfactory fastness, mainly against ultraviolet rays or visible light, and when subjected to exposure of such actinic light, the colors of images easily vary and fade. In order to minimize these disadvantages, heretofore, methods have been proposed in that couplers are selectively employed which form images with improved fading resistance; UV absorbers are incorporated to protect dye images from ultraviolet rays or a group which improves light fastness is substituted to a coupler moiety.

However, for example, in order to result in satisfactory light fastness of a dye image employing a UV absorber, a relatively large amount of the UV absorber is required and when a large amount of the UV absorber is added, the dye image has been occasionally stained due to the tint of the UV absorber itself. Furthermore, in spite of incorporation of the UV absorber, fading of the dye image due to visible light is not prevented. The improvement in light fastness employing UV absorbers is limited.

In addition, a method has been known in which dye image fading inhibiting agents are employed which have a phenolic hydroxyl group or a group which forms a phenolic hydroxyl group upon hydrolysis, and for example, Japanese Patent Publication Nos. 48-31256, 48-31625, and 51-30462; Japanese Patent Publication Open to Public Inspection Nos. 49-134326 and 49-134327 proposes phenols and bisphenols; U.S. Pat. No. 3,069,262 discloses pyrogallol, gallic acid and esters thereof; U.S. Pat. Nos. 2,360,290 and 4,015,990 disclose α-tocopherols and acyl derivatives thereof; Japanese Patent Publication No. 52-27534, Japanese Patent Publication Open to Public Inspection No. 52-14751, and U.S. Pat. No. 2,735,765 describe hydroquinone derivatives; U.S. Pat. Nos. 3,432,300 and 3,574,627 describe 6-hydroxychromans; U.S. Pat. No. 3,573,050 disclose 5-hydroxychroman derivatives; Japanese Patent Publication No. 49-20977 describes 6,6'-dihydroxy-2,2'-spirobichromans. These compounds, however, exhibit to some extent functions as fading inhibition and hue change preventing agents, but do not exhibit a sufficient effect of these.

Furthermore, U.K. Patent No. 1,451,000 describes that the stability of a dye image for light is improved by employing azomethine light-quenching compounds which exhibit a more bathochromic absorption peak than that of the dye image. However, the azomethine light-quenching compounds are disadvantageous because of a large effect to the hue because they themselves are tinted.

Furthermore, Japanese Patent Publication Open to Public Inspection No. 50-87649 and Research Disclosure Item No. 15162 (1976) describe a method in which the stability of dyes for light is improved employing metal complexes. However, these complexes do not result in sufficient fading inhibiting effect and in addition to this, a sufficient amount cannot be incorporated so as to exhibit the fading inhibiting effect, because their solubility in organic solvents is not large enough. Furthermore, because these complexes are highly tinted, a large amount of their addition results in adverse effects to the hue and purity of a dye image formed through color development.

In the silver halide light-sensitive photographic materials provided for direct appreciation (hereinafter referred to as "light-sensitive material"), for example, color photographic paper, etc., a combination of a yellow coupler, a magenta coupler, and a cyan coupler as dye-forming agents to form dye images is generally employed. These couplers are required to form dyes which meet basic performance requirements such as color reproduction properties of a formed dye image, dye-forming efficiency, keeping stability of a formed dye image, etc. Particularly, in recent years, color reproduction faithful to the genuine color of a subject has been markedly demanded.

As cyan image-forming couplers, conventionally, phenol series or naphthol series couplers have been widely employed. On the other hand, the cyan dye image prepared employing these phenol series or naphthol series couplers exhibit no sharp cut at the short wavelength side and exhibit unwanted absorption in the green region, that is, non-uniform absorption, which has resulted in insufficient color reproduction. In order to overcome this problem, pyroloazole-type cyan couplers are proposed in Japanese Patent Publication Open to Public Inspection Nos. 5-313324, 5-313325, and 6-347960. However, it has been found that these pyroloazole-type cyan couplers -exhibit insufficient dye-forming efficiency and dye images obtained thereby exhibit insufficient light fastness.

On account of this, in color negative films, the unwanted absorption should be corrected employing masking agents, etc., and on the other hand, no correction means is available for color paper to degrade remarkably color reproduction.

In order to improve color reproduction, pyrazolotriazole-type cyan couplers are proposed in Japanese Patent Publication Open to Public Inspection Nos. 63-250649, 63-250650, 64-554, etc. However, all these couplers are substituted with an electron attractive group and a hydrogen bonding group so as to form a color developed dye having a satisfactory absorption wavelength. Thus, on the contrary to preferred color reproduction, the coupling activity has not been satisfactory.

Furthermore, recently, in light-sensitive color photographic materials, which are provided for direct appreciation, excellent keeping stability, especially excellent light fastness has been demanded. In order to improve the light fastness, the addition of various additives, specifically, image stabilizing agents, has been known. However, when the dye image stabilizing agents are employed, they cause problems such as a decrease in maximum density and also a decease in contrast.

The silver halide light-sensitive color photographic material is subjected to exposure and then to a color development process which forms a color image through the formation of dyes upon allowing to react a p-phenylenediamine series color developing agent with couplers. In this photographic method, color reproduction is carried out employing the subtractive color method and a color image composed of yellow, magenta, and cyan superimposed images is formed.

Representative cyan dye-forming couplers are phenols and naphthols. Of these, the naphthols are employed for negative films because the absorption of a resultant dye can be extended to a longer wavelength, and also because the rate of the coupling reaction is high.

In the past, naphthols substituted with a carbamoyl group in the 2-position have been employed. However, problems arise in which the cyan dye obtained by this type of cyan coupler readily undergoes reduction fading and when processed with an exhausted bleach solution, the density obtained by color development decreases. On the other hand, technology to overcome the above-mentioned problems employing 1-naphthols newly substituted with a substituent in the 5-position is described in Japanese Patent Publication Open to Public Inspection Nos. 60-237448, 61-153640, and 63-208042. Furthermore, Japanese Patent Publication Open to Public Inspection No. 8-95212 discloses naphthols substituted with an arylcarbamoyl group in the 2 position. The compounds described in the above-mentioned Publication exhibit to some extent improvements in the reduction fading of a cyan dye and decrease in density caused by processing which enmloys an exhausted bleach solution. However, improvements are found to be insufficient and the secondary absorption of these cyan dyes is not preferred. Accordingly, further improvements have been desired.

SUMMARY IN THE INVENTION

Accordingly, the first object of the present invention is to provide a silver halide light-sensitive color photographic material which exhibits high speed and improvements in color reproduction.

The second object of the present invention is to provide a silver halide light-sensitive color photographic material which minimizes a decrease in density due to processing employing an exhausted bleach solution.

The other object of the present invention is to provide a silver halide light-sensitive color photographic material which exhibits improved color reproduction.

A furthermore object of the present invention is to provide a silver halide light-sensitive color photographic material which exhibits markedly improved light fastness of the dye images.

Still further object of the present invention is to provide a silver halide light-sensitive color photographic material which exhibits excellent dye-forming efficiency.

The silver halide light-sensitive color photographic material and embodiment thereof are described.

A silver halide light-sensitive color photographic material comprises a silver halide emulsion layer containing a coupler wherein the color photographic material comprises a thermotropic liquid crystal.

The silver halide light-sensitive color photographic material wherein the liquid crystal is smectic thermotropic liquid crystal or nematic thermotropic liquid crystal.

The silver halide light-sensitive color photographic material which comprises at least one thermotropic low molecular liquid crystal.

The liquid crystal is preferably selected from smectic thermotropic low molecular liquid crystals or nematic therotropic low molecular liquid crystals.

The thermotropic low molecular liquid crystal is preferably represented by the following general formula (L-1) or (L-2).

General formula (L-1)

$$Y_1\text{-}A_1\text{-}(X_1)m\text{-}A_2\text{-}Y_2$$

General formula (L-2)

$$Y_1\text{-}A_1\text{-}(X_1)m\text{-}A_2\text{-}(X_2)n\text{-}A_3\text{-}Y_2$$

wherein $A_1$, $A_2$, and $A_3$ each represents an alicyclic group or an aromatic group; $X_1$ and $X_2$ each represents a bonding group; m and n each represents 0 or 1, and $Y_1$ and $Y_2$ each represents a substituent.

In one of the preferable embodiment the silver halide light-sensitive color photographic material comprises a blue-sensitive silver halide emulsion layer, a green-sensitive silver halide emulsion layer, and a red-sensitive silver halide emission layer, and the green-sensitive emulsion layer comprises at least one thermotropic low molecular liquid crystal and at least one magenta coupler represented by the following general formula (M-1).

General formula (M-1)

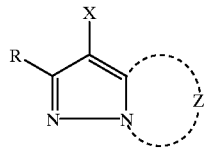

wherein R represents a hydrogen atom or a substituent; Z represents a group of nonmetallic atoms necessary for forming a nitrogen-containing heterocyclic ring and the ring formed by the above-mentioned Z may have a substituent. X represents a split-off group upon reaction with the oxide of a color developing agent.

In another embodiment of the silver halide light-sensitive color photographic material the above-mentioned red-sensitive layers comprises at least one thermotropic liquid crystal and at least one of the compounds represented by the following general formulas (I) to (IV).

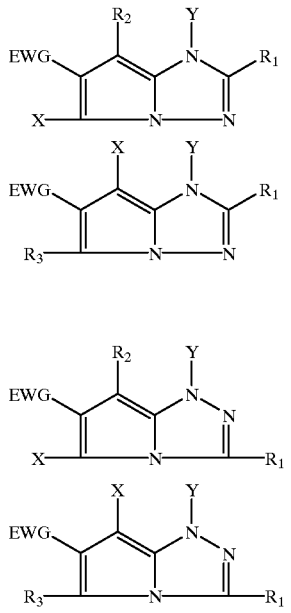

wherein $R_1$, $R_2$, and $R_3$, and Y each represents a hydrogen atom or a substituent; EWG is an electron attractive group having a Hammett substituent constant $\sigma_P$ of not less than 0.3, and X represents a hydrogen atom or a split-off group upon reaction with the oxide of a color developing agent.

The thermotropic liquid crystal is preferably smectic thermotropic liquid crystal or nematic thermotropic liquid crystal.

In the other embodiment at least one of the above-mentioned red-sensitive layers comprises a cyan coupler represented by general formula (IX) or (X), and the above-mentioned red-sensitive layer comprises at least one thermotropic liquid crystal.

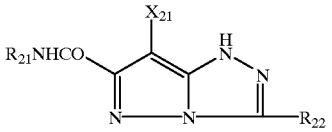

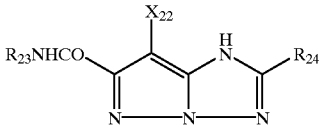

wherein $R_{21}$ and $R_{23}$ each represents a branched alkyl group, a substituted alkyl group, a substituted aryl group or a heterocyclic group, and $R_{22}$ and $R_{24}$ each represents a substituent. $X_{21}$ and $X_{22}$ each represents a hydrogen atom, a halogen atom, or a split-off group upon reaction with the oxide of a color developing agent.

In the other embodiment at least one of the above-mentioned red-sensitive layers comprises a cyan coupler represented by general formula (XI), and the above-mentioned red-sensitive layer comprises at least one thermotropic liquid crystal.

General formula (XI)

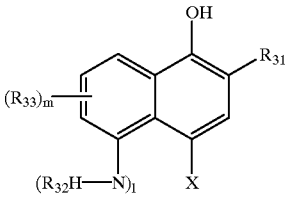

wherein $R_{31}$ represents —CON($R_{34}$)($R_{35}$) —NHCOR$_{34}$, —NHCOOR$_{36}$, —NHSO$_2$R$_{36}$, —NHCON($R_{35}$)($R_{36}$), —SO$_2$N($R_{34}$)($R_{35}$) or —NHSO$_2$N($R_{34}$)($R_{35}$); $R_{32}$ represents a hydrogen atom or a substituent; $R_{33}$ represents a substituent; X represents a hydrogen atom or a split-off group upon reaction with the oxide of an aromatic primary amine developing agent; 1 represents 0 or 1; m represents an integer of 0 to 3; $R_{34}$ and $R_{35}$ each represents a hydrogen atom, an aromatic group, an aliphatic group or a heterocyclic group; $R_{36}$ represents an aromatic group, an aliphatic group or a heterocyclic group. When m is 2 or 3, each $R_{33}$ may be the same or different or may form a ring through linking with each other, and $R_{34}$ and $R_{35}$, $R_{32}$ and $R_{33}$, $R_{32}$ and X may combine with each other to form a ring. However, when l is 0, m is 0 and $R_{31}$ is —CONHR$_{37}$ in which $R_{37}$ represents an aromatic group.

A thermotropic high molecular liquid crystal may be used as the liquid crystal.

They may be preferably smectic thermotropic high molecular liquid crystals or nematic thermotropic high molecular liquid crystals.

The thermotropic high molecular liquid crystal is preferably those represented by general formula (L-3), (L-4) or (L-5),

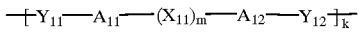

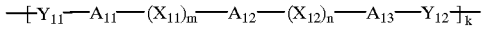

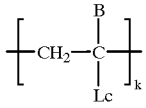

Lc: $-Y_{11}-A_{11}-(X_{11})_n-A_{12}-Y_{13}$ or $-Y_{11}-A_{11}-(X_{11})_m-A_{12}-(X_{12})_n-A_{13}-Y_{13}$ wherein $A_{11}$, $A_{12}$, and $A_{13}$ each represents an alicyclic group or a aromatic group; $X_{11}$, $X_{12}$, $Y_{11}$ and $Y_{12}$ each represents a bonding group; m and n each represents 0 or 1, and $Y_{13}$ represents a substituent; B is a methyl group or a hydrogen atom; k represents recurring number.

The thermotropic high molecular liquid crystal and a magenta coupler represented by the following general formula M-1 are preferably used in the green-sensitive emulsion layer.

General formula M-1

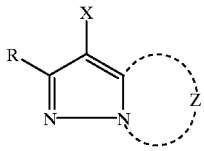

wherein R represents a hydrogen atom or a substituent; Z represents a group of nonmetallic atoms necessary for forming a nitrogen-containing heterocyclic ring and said ring formed by said Z may have a substituent, X represents a split-off group upon reacting with the oxide of a color developing agent.

DETAILED DESCRIPTION OF THE INVENTION

The present invention is explained in detail below.

The liquid crystal is a liquid in which the molecules are collectively oriented in spite of possessing fluidity like a liquid and designates an intermediate state between a solid phase and an isotropic liquid phase, and a substance exhibiting such an intermediate state. As liquid crystal substances, a number of types have been known, and there are thermotropic liquid crystals which are changed to liquid crystals through variation in temperature and lyophilic liquid crystals which are changed to liquid crystals in the predetermined range of concentration as represented by a soap solution. Furthermore, in the substances which exhibit liquid crystal-properties, low molecular substances and high molecular substances are known. The "low molecular" in the present invention indicates a molecule having a molecular weight of not more than 2,000. Furthermore, the thermotropic low molecular liquid crystal substances can be divided into smectic, nematic, cholesteric, and discotic liquid crystals according to difference in the liquid crystal state. The molecular structures and properties of liquid crystals are described in a number of publications, for example, Masaichi Matsumoto, Ichiyoshi, Kakuta, "Ekisho no Kiso to Oyo" ("Fundamentals and Application of Liquid Crystals"), Kogyo Chosakai, Tokyo, 1991; Ichiro Nakata, Fumikazu Hori, Akio Mukao, "Ekisho Nyumon" ("Introduction to Liquid Crystals"), Saiwai Shobo, Tokyo, 1993; Kouji Okano, Shunsuke Kobayashi, "Ekisho Kiso-hen", ("Liquid Crystals; Basic Part"), Baifuu-kan Tokyo, 1985, etc., which can be employed as references. In the present invention, marked advantages are found when the smectic and nematic liquid crystal substances are employed.

The action mechanism in which the liquid crystal substances associated with the present invention exhibit excellent advantages has not yet been clarified. However, it is estimated that these liquid crystal substances are subjected to mutual interaction with image-forming dye molecules in a silver halide light-sensitive color photographic material; accelerates the returning speed of photoexcited dye molecule to the ground state and prevents the decomposition of the dye molecule. Since the molecules of the liquid crystal are collectively oriented, dye molecules are formed from coupler in accordance with the same orientation as the molecules of the liquid crystal. The orientation of the dye molecules is estimated to avoid coagulation of dye molecules to reduce subsidiary absorption.

The thermotropic low molecular liquid crystals represented by general formulas (L-1) or (L-2) and thermotropic high molecular liquid crystals represented by general formula (L-3), (L-4) or (L-5), will now be described.

In the above-mentioned general formulas (L-1), (L-2), (L-3), (L-4) and (L-5) alicyclic groups or aromatic groups, represented by $A_1$, $A_2$, $A_3$, $A_{11}$, $A_{12}$, and $A_{13}$ include, for example those having groups as mentioned below.

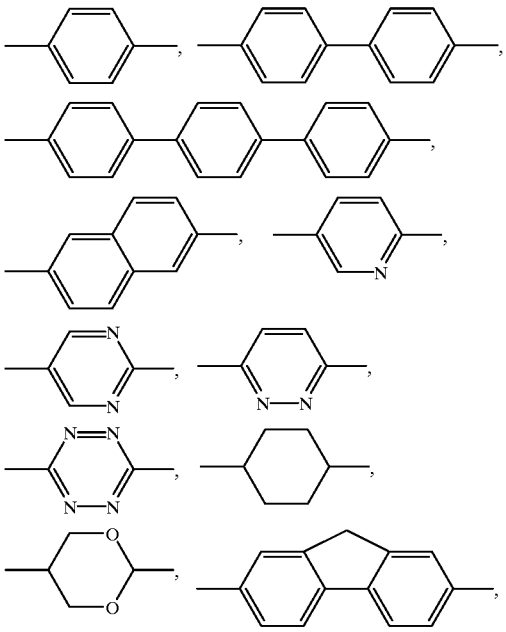

-continued

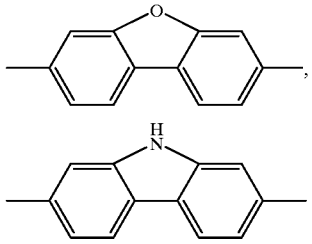

These groups mentioned above may have a substituent, for example, such as an alkyl group, a halogen atom, a cyano group, an alkoxy group, an acyl group, a nitro group, etc.

Bonding groups represented by $X_1$, $X_2$, $X_{11}$, $X_{12}$, $Y_{11}$and $Y_{12}$ include the following groups.

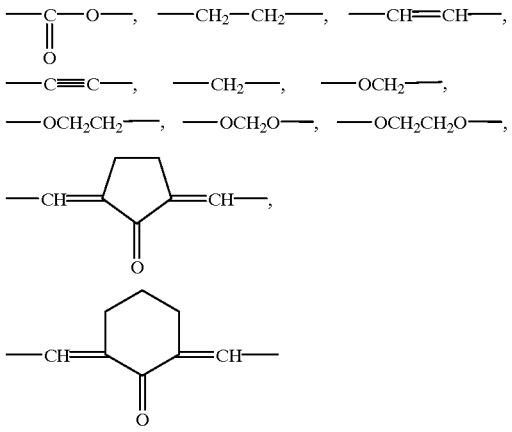

These groups mentioned abve may have a substituent.

m and n each represents an integer of 0 or 1.

Substituents represented by $Y_1$, $Y_2$ and $Y_{13}$ include, for example, the following groups.

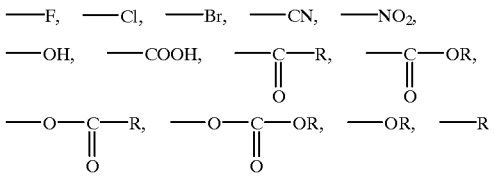

wherein R represents straight chain or branched chain groups having from 1 to 25 carbon atoms, such as an alkyl group, an alkenyl group, an alkynyl group, etc.

Specific examples of thermotropic low molecular liquid crystal compounds represented by the general formula (L-1) or (L-2) are shown below.

L-1
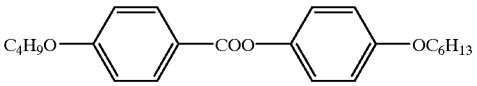
L-2
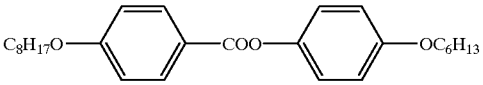
L-3
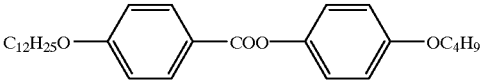
L-4
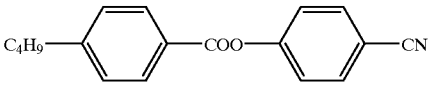
L-5
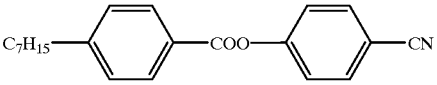
L-6
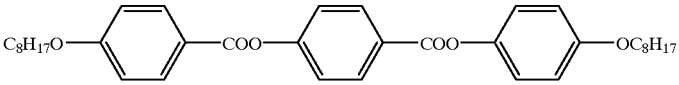
L-7
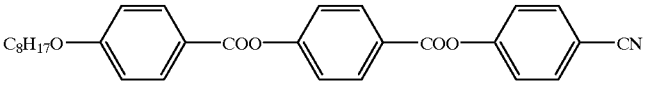
L-8
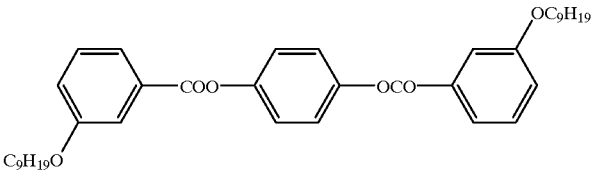
L-9
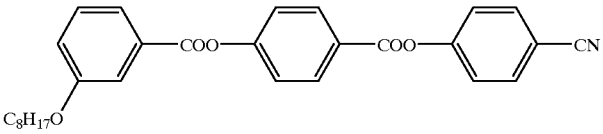
L-10
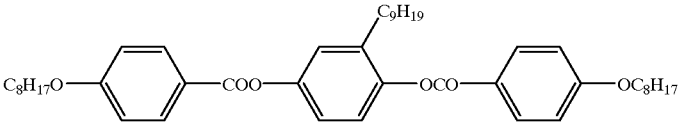
L-11
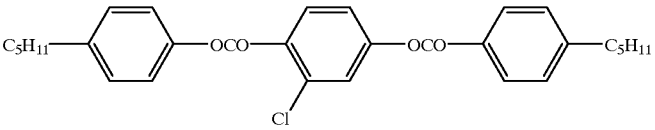

-continued
L-12
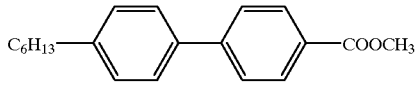
L-13
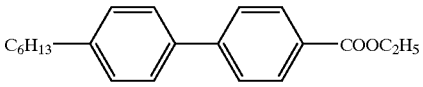
L-14
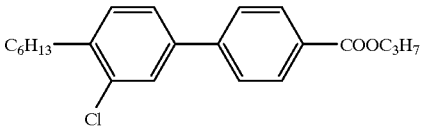
L-15
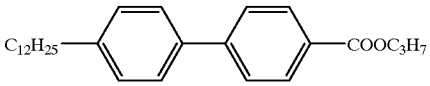
L-16
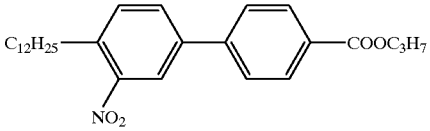
L-17
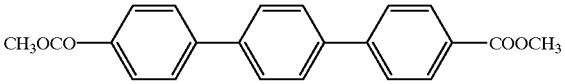
L-18
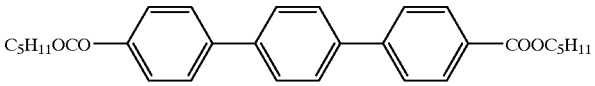
L-19
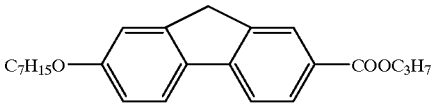
L-20
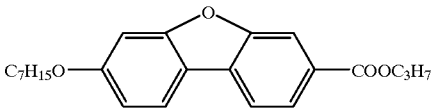
L-21
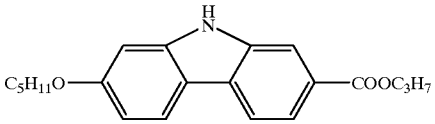
L-22
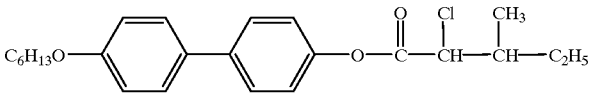

-continued
L-23
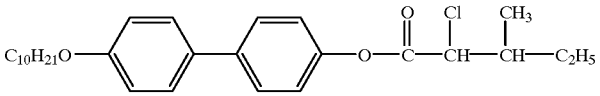
L-24
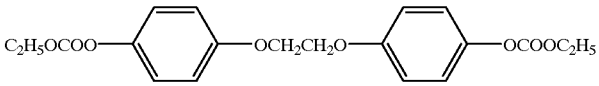
L-25
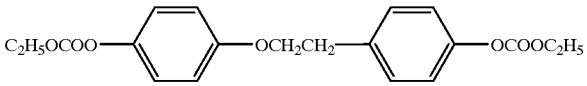
L-26
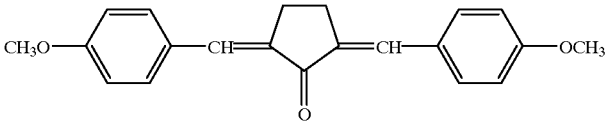
L-27
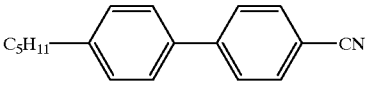
L-28
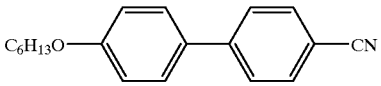
L-29
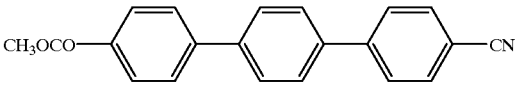
L-30
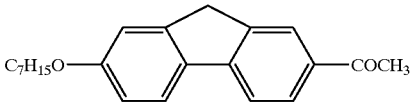
L-31
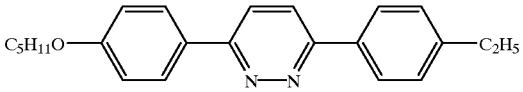
L-32
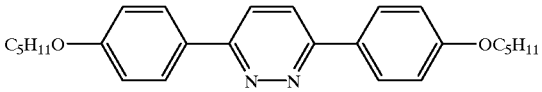
L-33
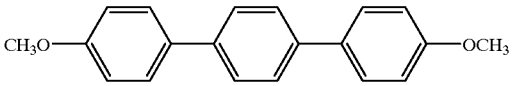
L-34
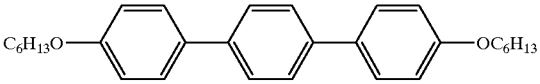

-continued
L-35
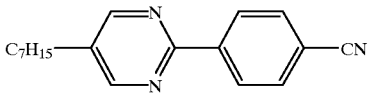
L-36
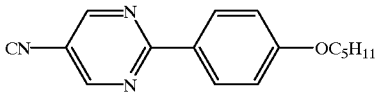
L-37
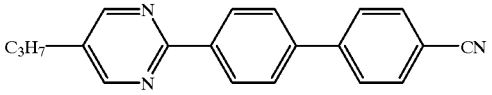
L-38
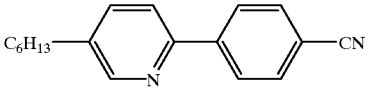
L-39
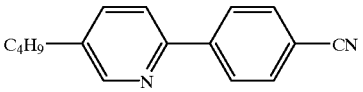
L-40
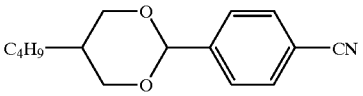
L-41
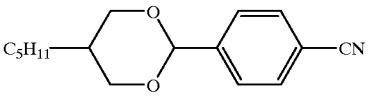
L-42
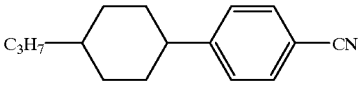
L-43
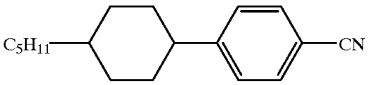
L-44
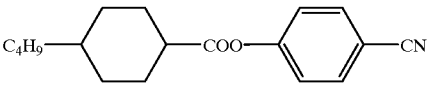
L-45
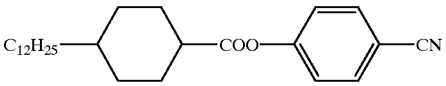
L-46
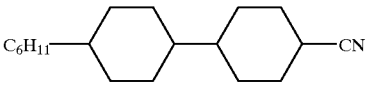

-continued
L-47
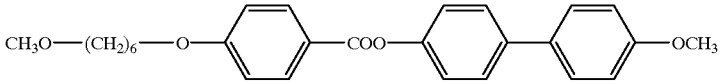
L-48
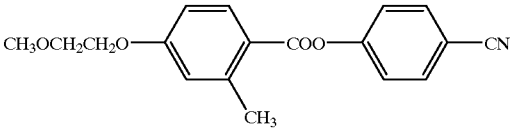
L-49
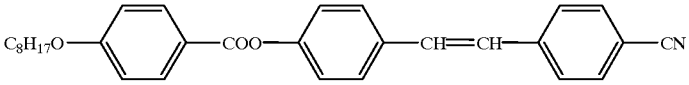
L-50
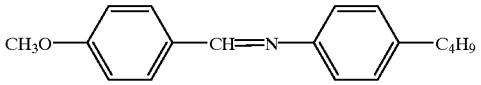
L-51
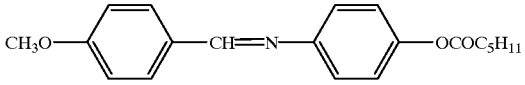
L-52
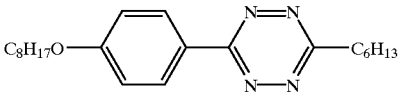
L-53
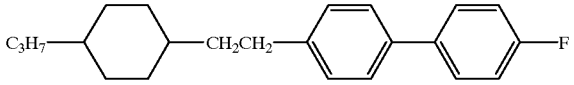
L-54
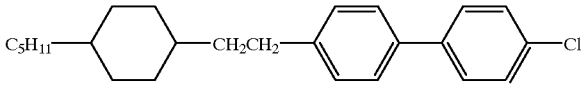
L-55
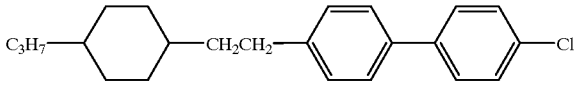
L-56
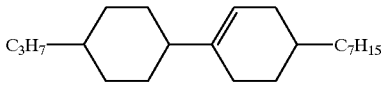
L-57
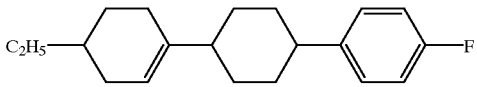
L-58
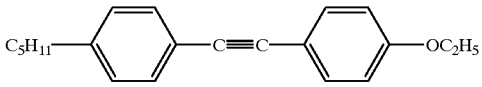

-continued
L-59
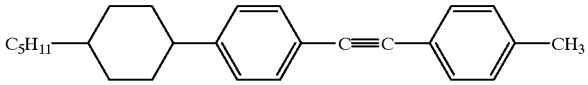
L-60
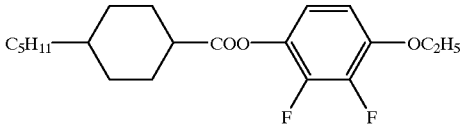
L-61
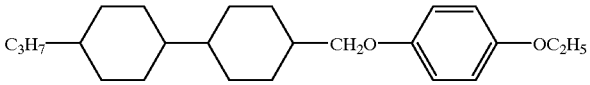
L-62
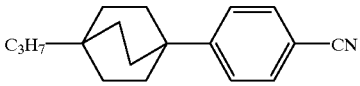
L-63
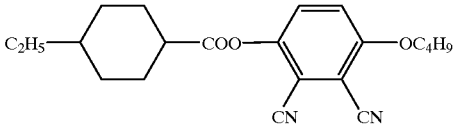
L-64
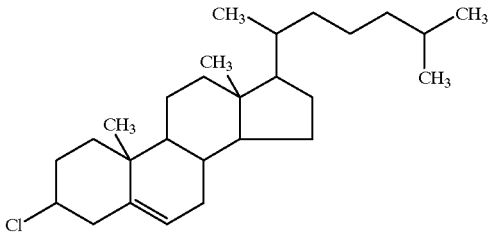
L-65
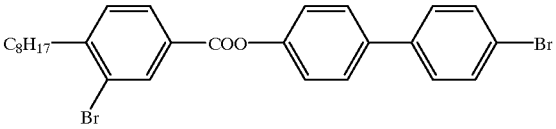
L-66
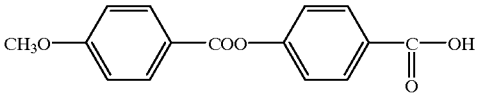
L-67
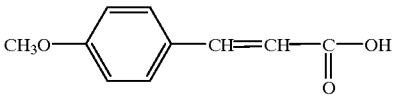
L-68
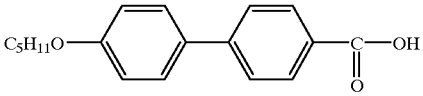

-continued
L-69
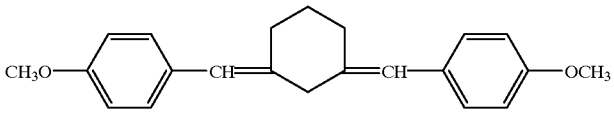
L-70
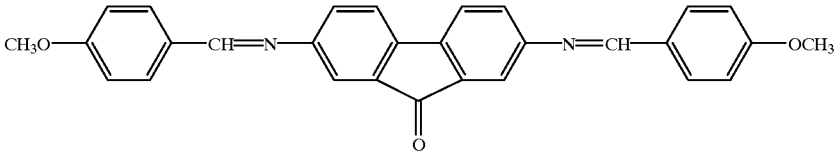
L-71
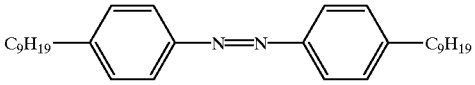
L-72
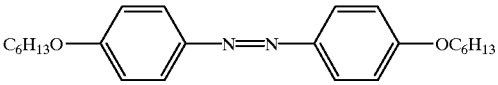
L-73
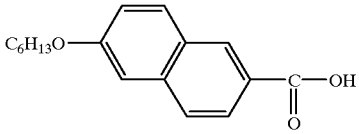
L-74
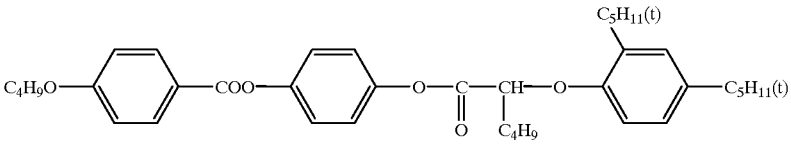
L-75
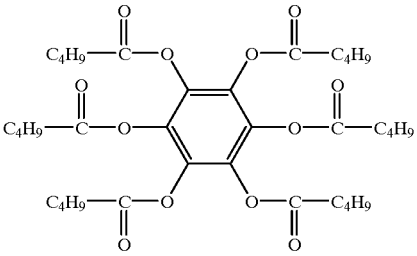
L-76
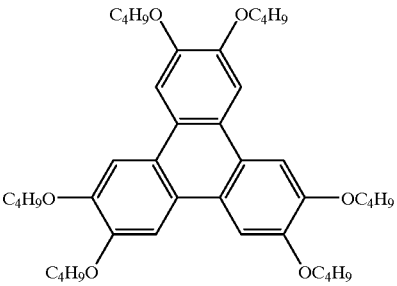

-continued
L-77
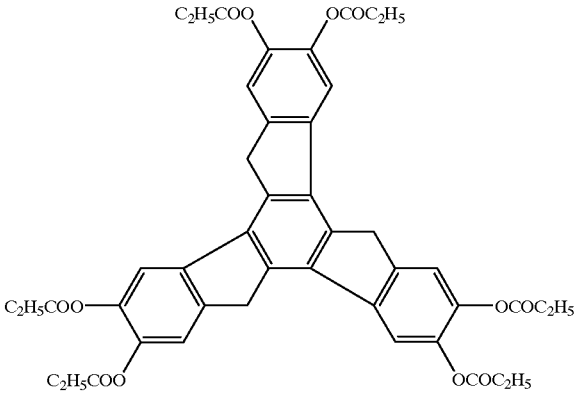
In the following, the compounds are shown by means of recurring unit.
L-78
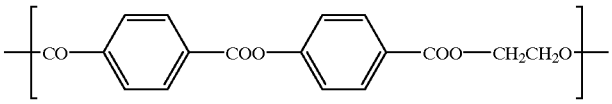
L-79
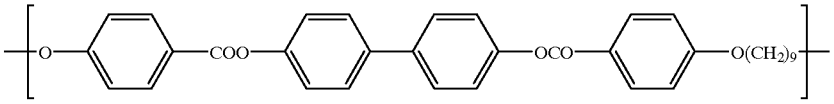
L-80
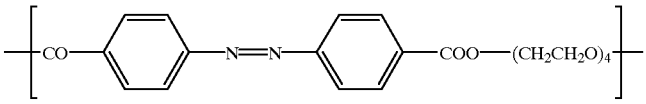
L-81
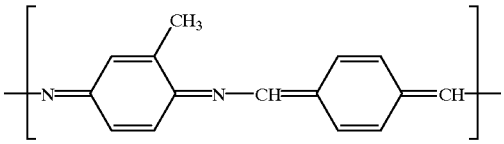
L-82
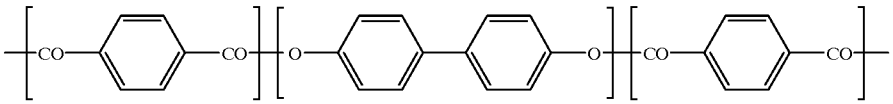
L-83
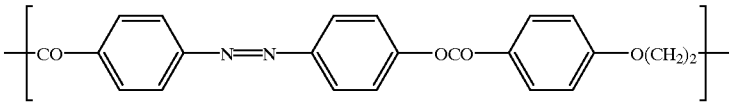
L-84
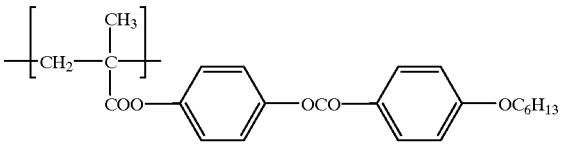

-continued
L-85
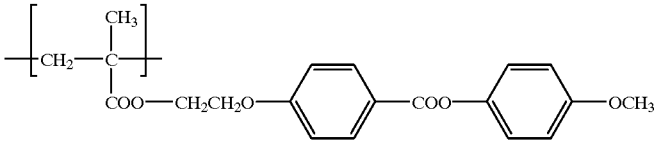
L-86
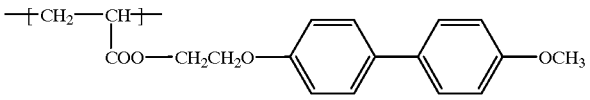
L-87
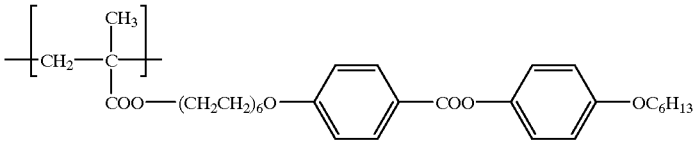
These compounds can be synthesized in the same method as described in the above cited book, e.g. Nakada, Hori, Mukao, "Ekisho Nyumon" ("Introduction to Liquid Crystals").
Specific examples of thermotropic high molecular liquid crystal compounds are shown by means of recurring unit.
PL-1
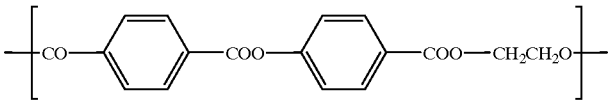
PL-2
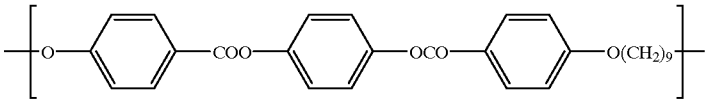
PL-3
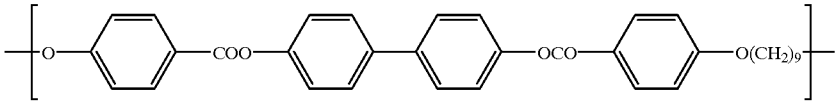
PL-4
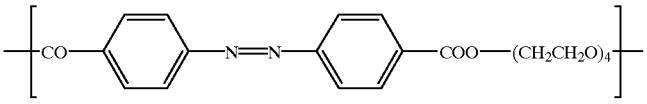
PL-5
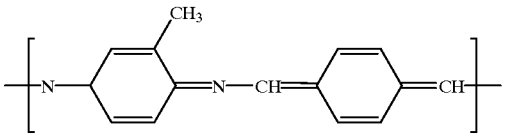
PL-6

-continued
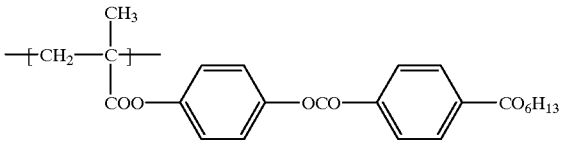
PL-7
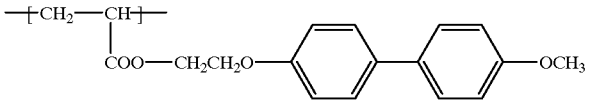
PL-8
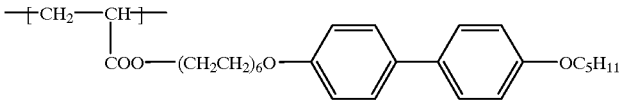
PL-9
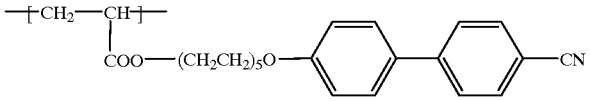
PL-11
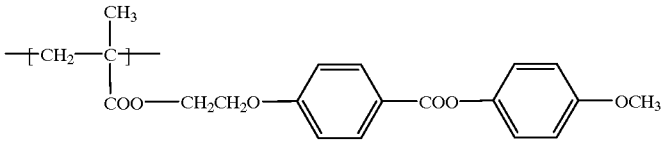
PL-12
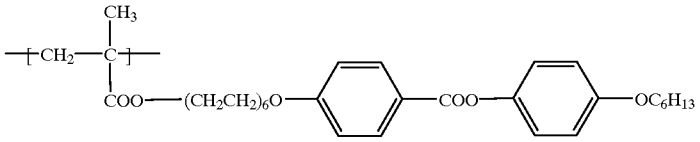
PL-13
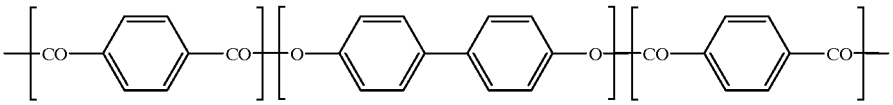
PL-14
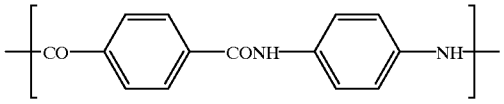
PL-15
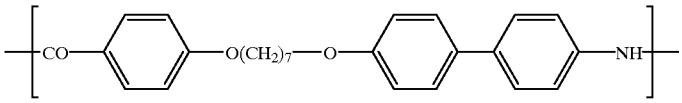
PL-16

-continued
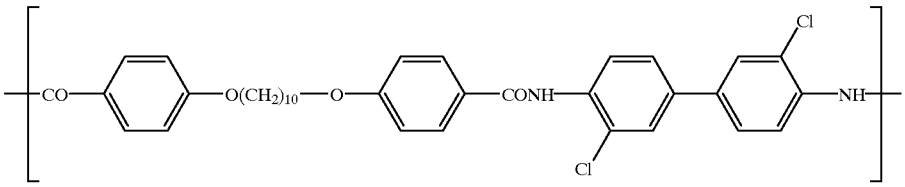
PL-17
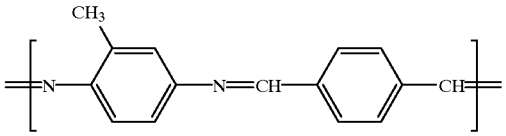
PL-18
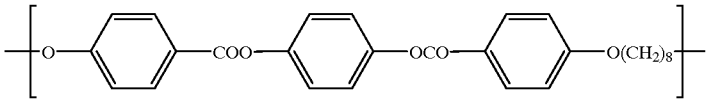
PL-19
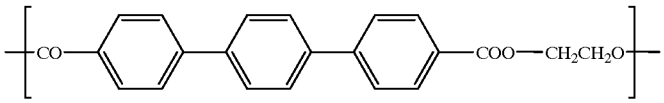
PL-20
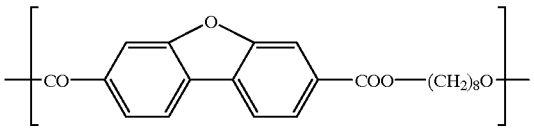
PL-21
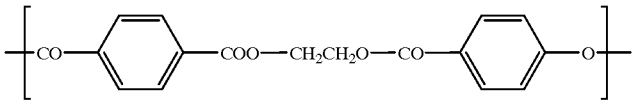
PL-22
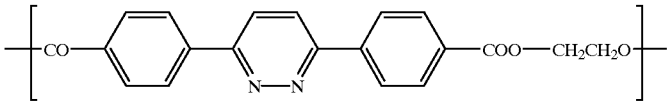
PL-23
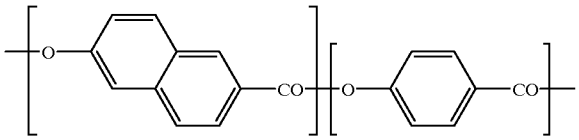
PL-24
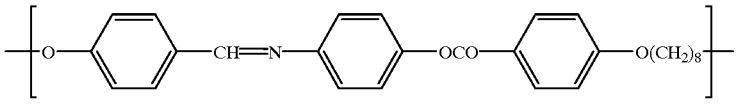

-continued
PL-25
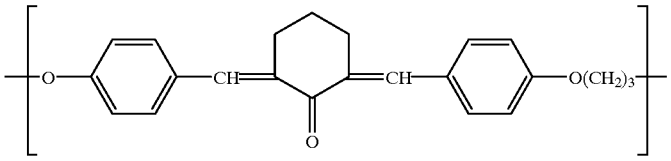
PL-26
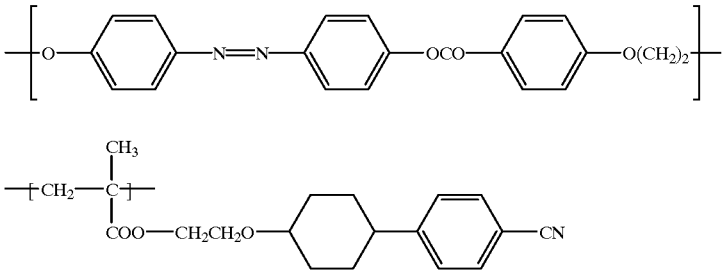
PL-27
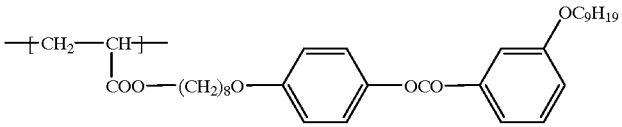
PL-28
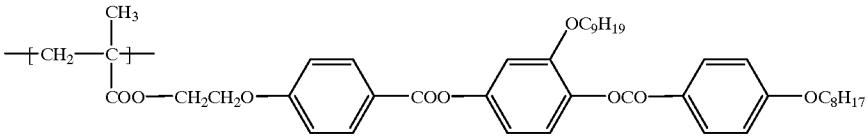
PL-29
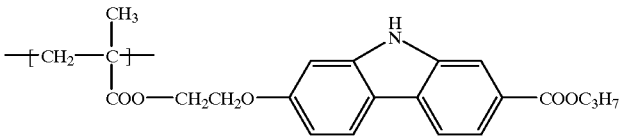
PL-30
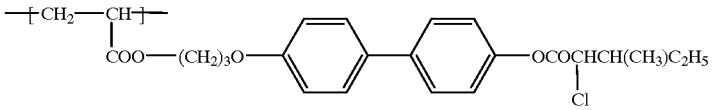
PL-31
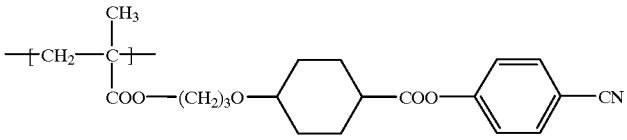
PL-32

-continued
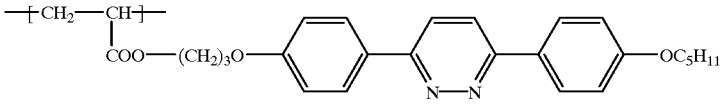
PL-33
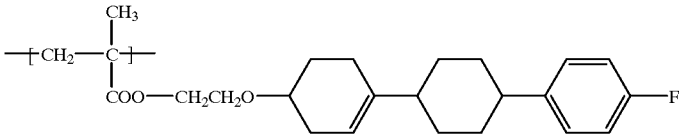
PL-34
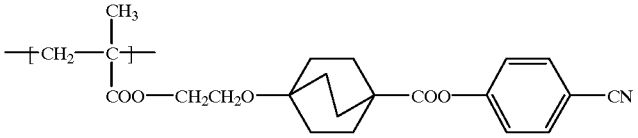
PL-35
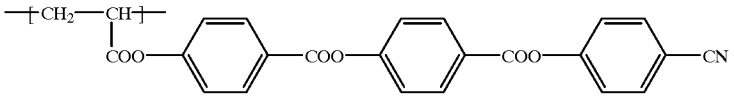
PL-36
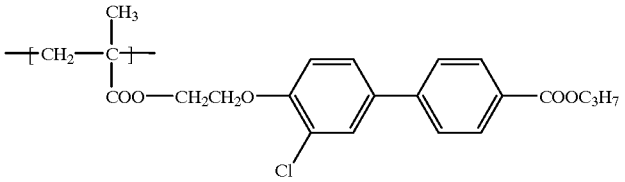
PL-37
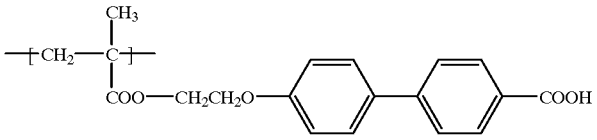
PL-38
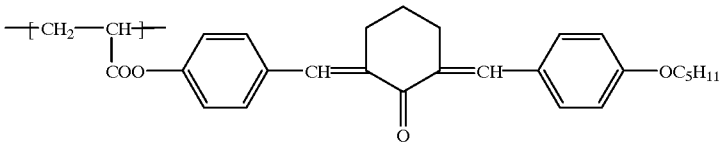
PL-39
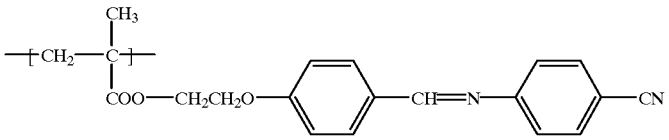

-continued
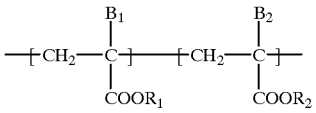
| | $B_1$ | $B_2$ | $R_1$ |
|---|---|---|---|
| PL-40 | H | H | 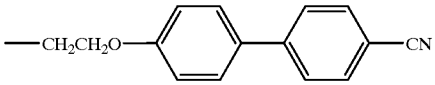 |
| PL-41 | H | H | 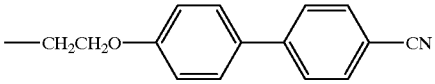 |
| PL-42 | H | $CH_3$ | 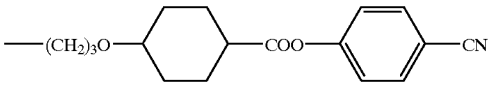 |
| PL-43 | $CH_3$ | $CH_3$ | 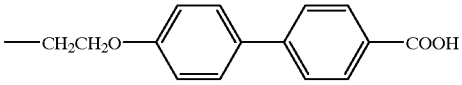 |
| PL-44 | $CH_3$ | $CH_3$ | 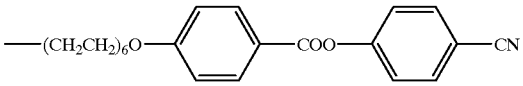 |
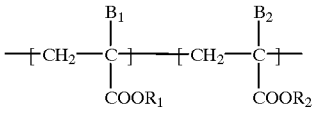
| | $R_2$ |
|---|---|
| PL-40 | 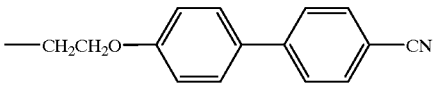 |
| PL-41 | 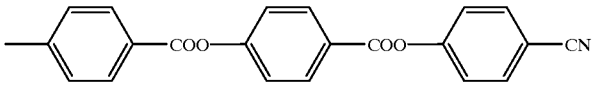 |
| PL-42 | 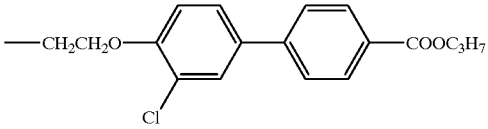 |
| PL-43 | 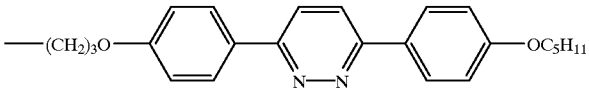 |
| PL-44 | 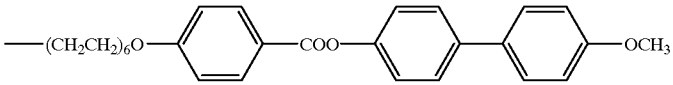 |

These compounds can be synthesized in the same method as described in the above cited book, e.g. Nakada, Hori, Mukao, "Ekisho Nyumon" ("Introduction to Liquid Crystals").

The average molecular weight of these compounds is preferably between 20,000 and 100,000, and more preferably between 4,000 and 20,000.

In the present invention, preferred yellow couplers, which can be employed in combination with the liquid crystal compounds represented by the general-formula (L-1), (L-2), (L-3), (L-4) or (L-5) include benzoylacetanilide-type couplers, pivaloylacetanilide-type couplers, magenta couplers include 5-pyrazolone series, pyrazolotriazole series, indazolone series couplers, and the cyan couplers include phenol series, naphthol series, pyrazoloquinazolone series, pyrazolopyrimidine series, pyrazolotriazole series, imidazole series couplers.

The representative examples of specific magenta couplers employed in the present invention include M-1 to M-28 described on pages 52 to 58 of Japanese Patent Publication Open to Public Inspection No. 4-313751.

In addition to these, magenta couplers which can be employed in combination thereof are described in, for example, U.S. Pat. No. 3,684,514; U.K. Patent No. 1,183,515; Japanese Patent Publication Nos. 40-6031, 40-6035, 44-15754, 45-40757, and 46-19032; Japanese Patent Publication Open to Public Inspection Nos. 50-13041, 53-129035, 51-37646, and 55-62454; U.S. Pat. No. 3,725,067; U.K. Patent Nos. 1,252,418 and 1,334,515; Japanese Patent Publication Open to Public Inspection Nos. 59-171956, 59-162548,60-43659, and 60-33552; Research Disclosure Item No. 24626 (1984); Japanese Patent Application Nos. 59-243007, 59-243008, 59-243009, 59-243012, 60-70197, and 60-70198, etc., and these magenta couplers can be synthesized according to the methods described therein.

Magenta couplers represented by the general formula (M-1) in the present invention are described below.

In the above-mentioned general formula (M-1), the representative substituents represented by R, include any of several groups such as alkyl, aryl, anilino, acylamino, sulfonamidealkylthio, arylthio, alkenyl, cycloalkyl, etc. In addition to these, are included a halogen atom, and a cycloalkenyl, alkynyl, heterocyclic, sulfonyl, sulfinyl, phophonyl, acyl, sulfamoyl, cyano, alkoxy, aryloxy, heterocyloxy, cyloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, heterocylothio group. And a spiro compound residual group, a bridge-containing hydrocarbon compound residual group can be included.

Alkyl groups represented by R are preferably those having from 1 to 32 carbon atoms and may be a straight chain or branched chain.

An aryl group represented by R is preferably a phenyl group.

Acylamino groups represented by R include an alkylcarbonylamino group, an arylcarbonylamino group, etc.

Sulfonamide groups represented by R include an alkylsulfonylamino group, an arylsulfonylamino group, etc.

Alkyl components and aryl components in the alkylthio group and arylthio group represented by R include an alkyl group and an aryl group, represented by the above-mentioned R.

Alkenyl groups represented by R include those having from 2 to 32 carbon atoms, and as the cycloalkyl groups, those have preferably from 2 to 12 carbon atoms, and more preferably from 5 to 7 carbon atoms, and the alkenyl group may be a straight chain or branched chain.

Cycloalkenyl groups represented by R are those having from 3 to 12 carbon atoms and preferably from 5 to 7 carbon atoms.

Sulfonyl groups represented by R include an alkylsulfonyl group, an arylsulfonyl group, etc.;

sulfinyl groups include an alkylsulfinyl group, an arylsulfinyl group, etc.;

phosphonyl groups include an alkylphosphonyl group, an alkoxyphosphonyl group, an aryloxyphsphonyl group, an arylphosphonyl group, etc.;

acyl groups include an alkylcarbonyl group, an arylcarbonyl group, etc.;

carbamoyl groups include an alkylcarbamoyl group, an arylcarbamoyl group, etc.;

sulfamoyl groups include an alkylsulfamoyl group, an arylsulfamoyl group, etc.;

acyloxy groups include an alkylcarbonyloxy group, an arylcarbonyloxy group, etc.;

ureido groups include an alkylureido group, an arylureido group, etc.;

sulfamoylamino groups include an alkylsulfamoylamino group, an arylsulfamoylamino group, etc.;

heterocyclic groups are preferably those of 5- to 7 member group, and specifically a 2-furyl group, a 2-thienyl group, a 2-pyrimidinyl group a 2-benzothiazolyl group, etc.;

heterocyloxy groups are preferably those having a 5- to 7-member heterocyclic ring and, for example, a 3,4,5, 6tetrahydropyranyl-2-oxy group, a 1-phenyltetrazole-5-oxy group, etc.;

imido groups include a succinimido group, a 3-heptadecysuccinimido group, a phthalimido group, a glutarimido group, etc.;

spiro compound residual groups include a spyro[3.3] heptane-1-il etc.;

bridge-having hydrocarbon compound residual groups include a bicyclo[2.2.1]heptane-1-il, a tricyclo [3.3.1.1$^{3,7}$]decane-1-il, 7,7-dimethyl-bicyclo[2.2.1] heptane-1-il, etc.

X represents an atom or a group which can leave on reaction with the oxide of a color developing agent, for example, a halogen atom (a chlorine atom, a bromine atom, a fluorine atom, etc.) and an alkoxy, aryloxy, heterocycloxy, acyloxy, sulfonyloxy, alkoxy, carbonyloxy, aryloxycarbonyl, alkyloxaryloxy, alkoxyoxaryloxy, alkylthio, heterocylothio, alkyloxythiocarbonylthio, acylamino, aulfonamido, nitrogen atom containing heterocyclic ring, alkyloxycarbonylamino, aryloxycarbonylamino, carboxyl group.

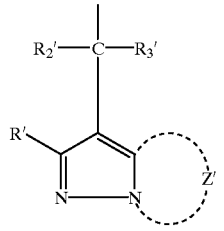

wherein R' is the same as the above-mentioned R; Z' is the same as the above-mentioned Z; $R_2'$ and $R_3'$ each represents a hydrogen atom, an aryl group, an alkyl group or a heterocyclic group. The preferred substituents are halogen atoms and particularly preferred ones are chlorine atoms.

Furthermore, nitrogen-containing heterocyclic rings formed utilizing Z or Z' include a pyrazole ring, an imidazole ring, a triazole ring, a tetrazole ring, etc., and a substituent which may be carried by the above-mentioned ring include those described for the above-mentioned R.

Representative examples of specific magenta couplers represented by the general formula (M-1) of the present invention are shown below.

M-1

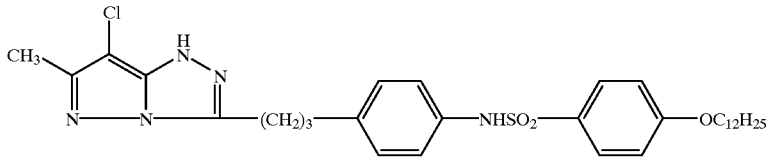

M-2

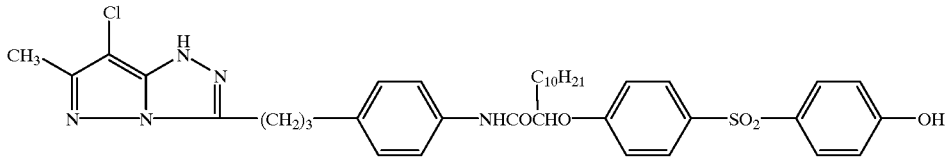

M-3

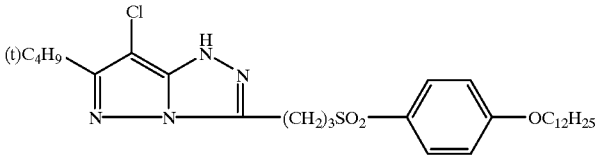

M-4

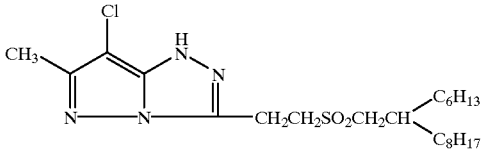

M-5

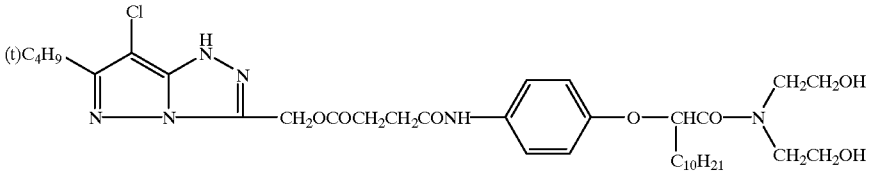

M-6

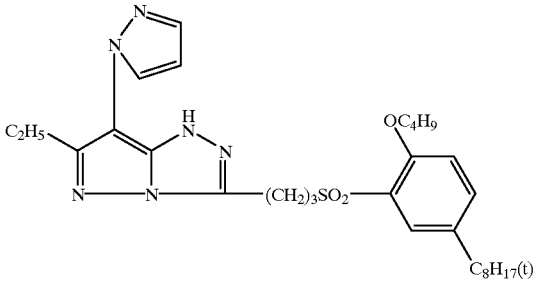

M-7

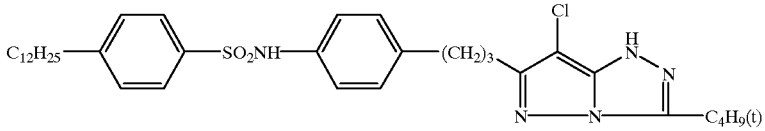

-continued
M-8
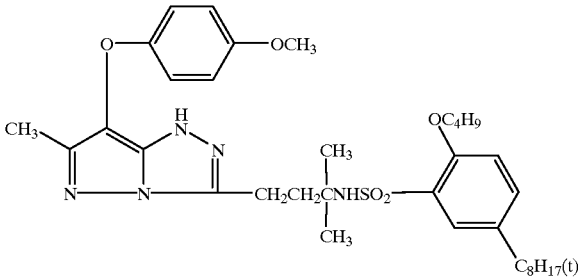
M-9
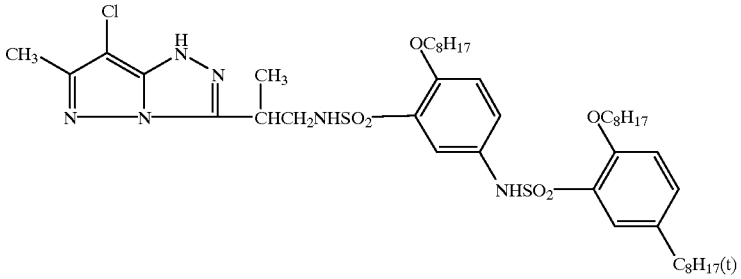
M-10
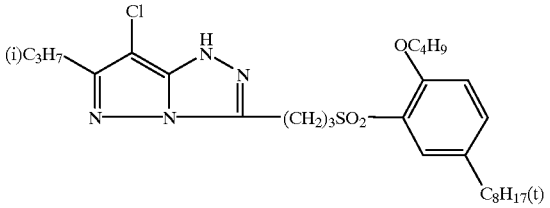
M-11
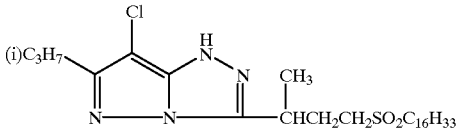
M-12
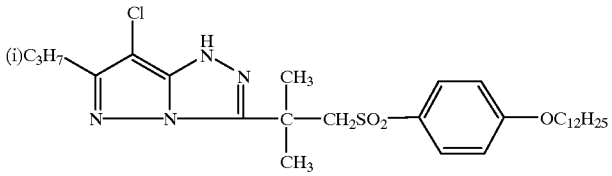
M-13
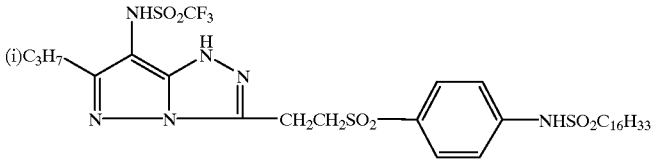
M-14
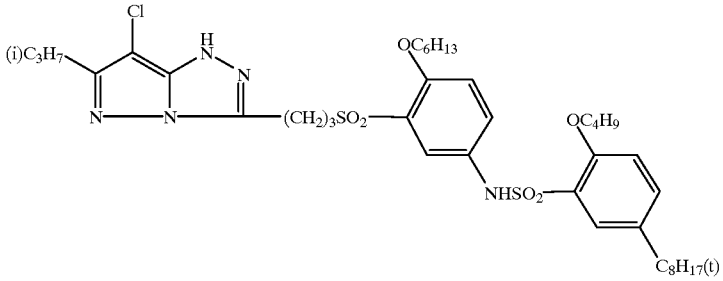

-continued
M-15
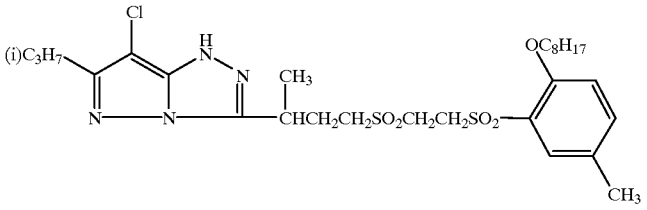
M-16
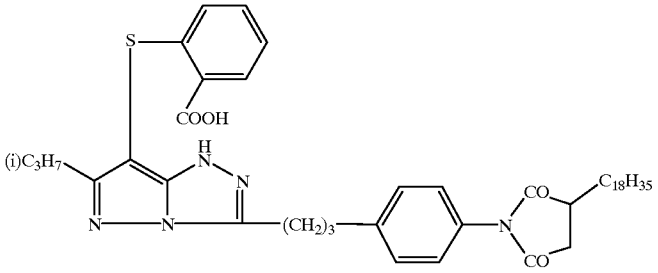
M-17
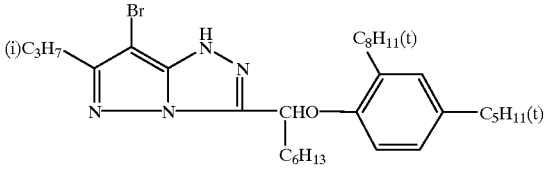
M-18
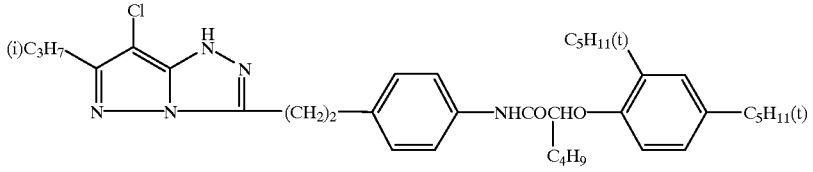
M-19
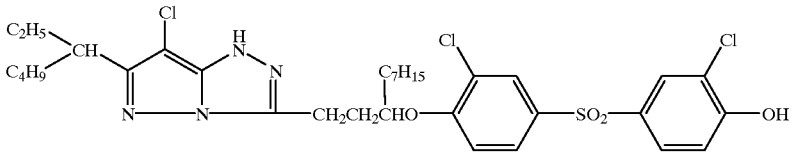
M-20
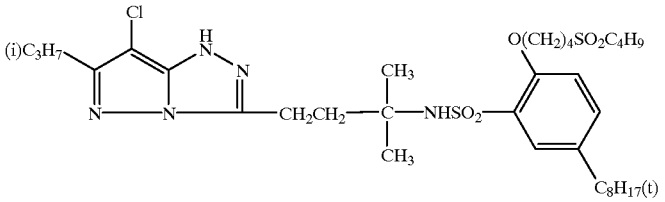
M-21
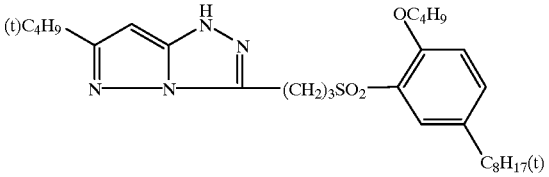

-continued
M-22
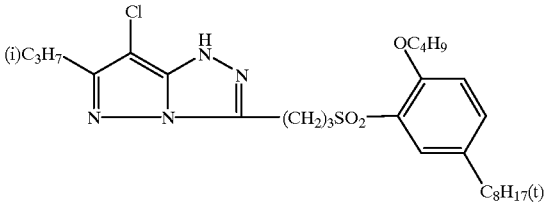
M-23
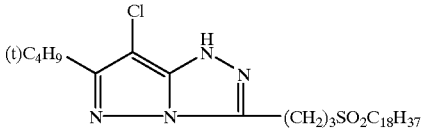
M-24
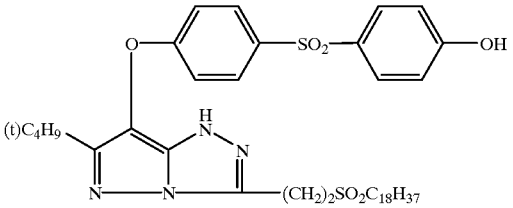
M-25
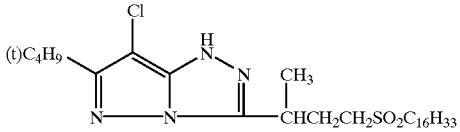
M-26
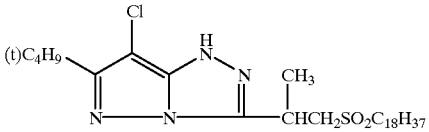
M-27
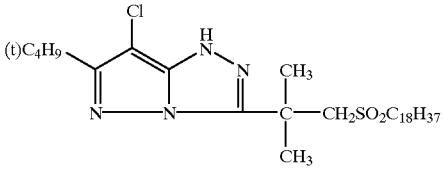
M-28
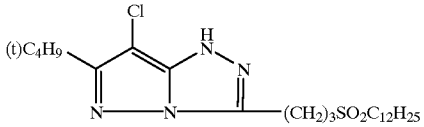
M-29
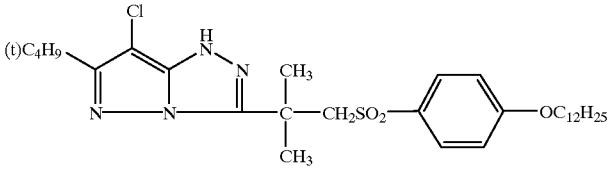
M-30
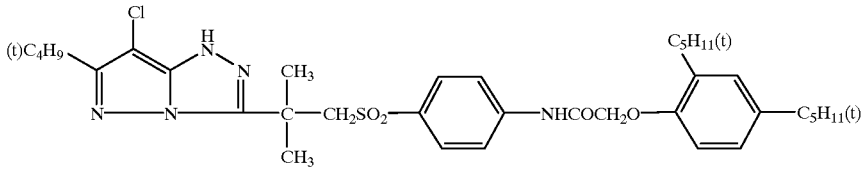

-continued
M-31
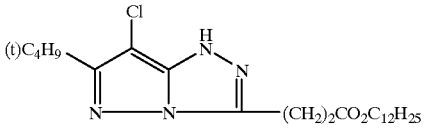
M-32
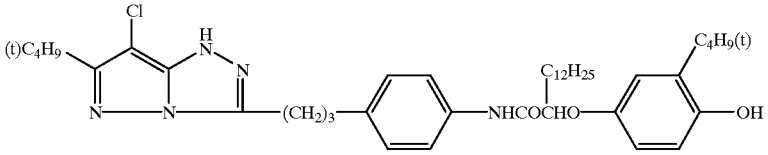
M-33
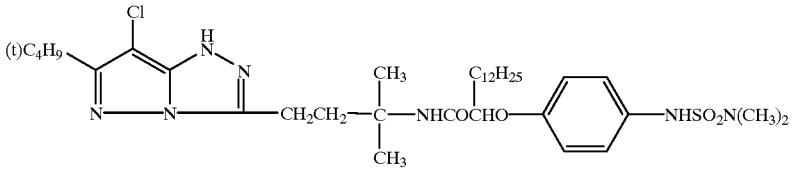
M-34
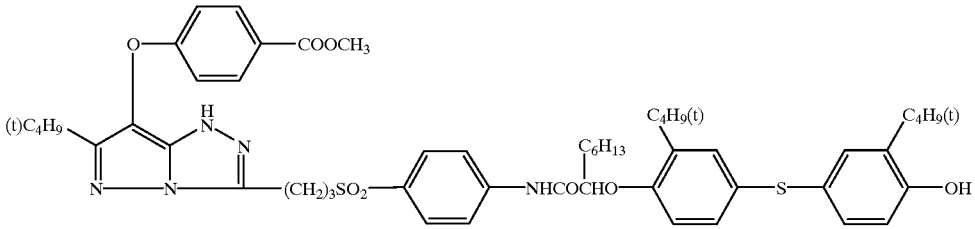
M-35
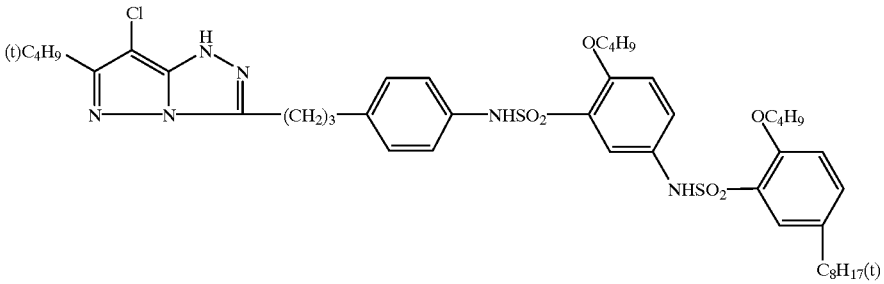
M-36
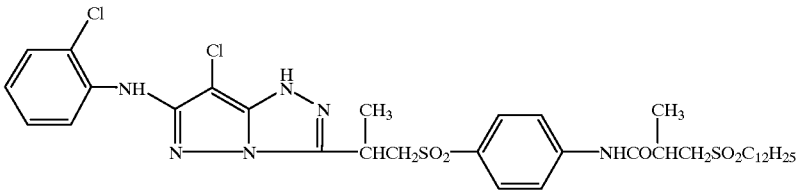
M-37
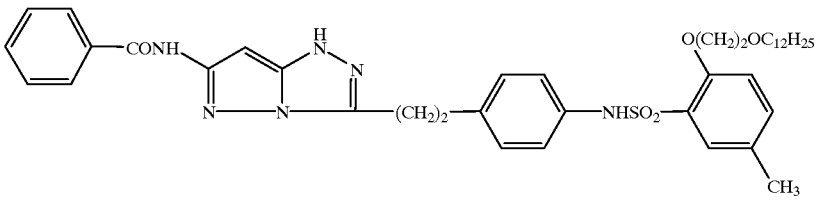

-continued
M-38
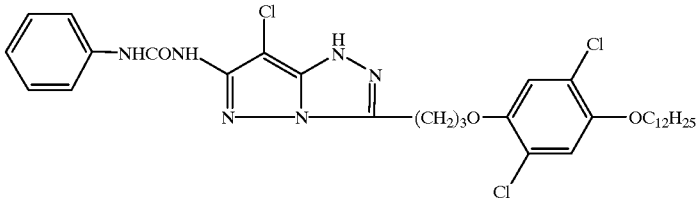
M-39
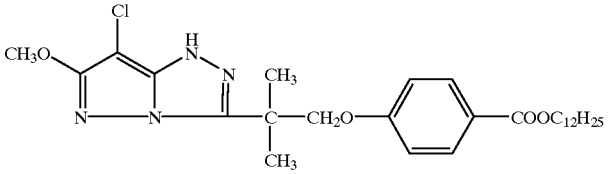
M-40
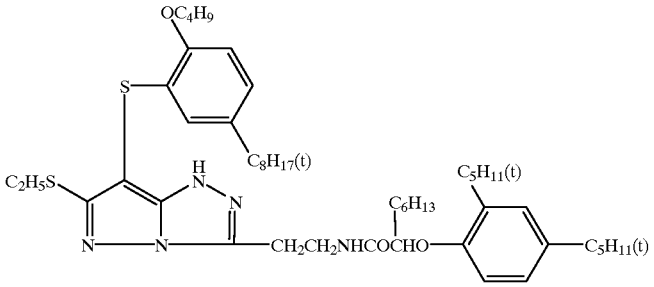
M-41
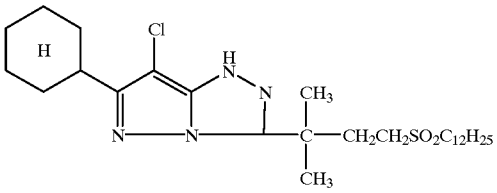
M-42
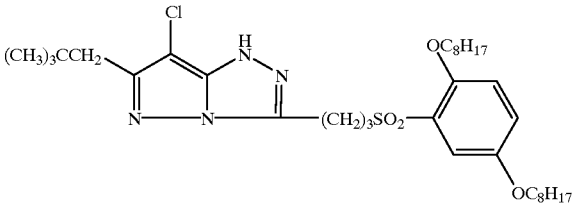
M-43
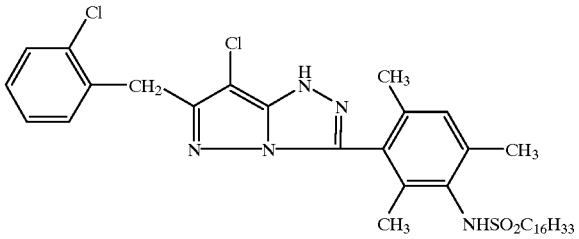
M-44
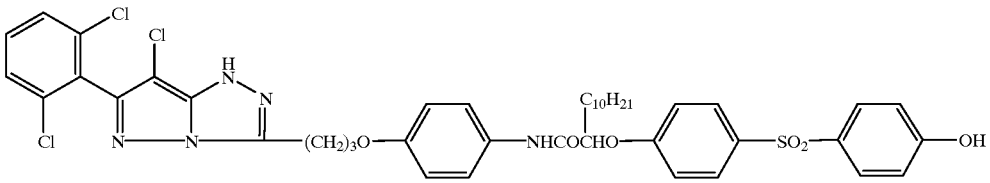

-continued
M-45
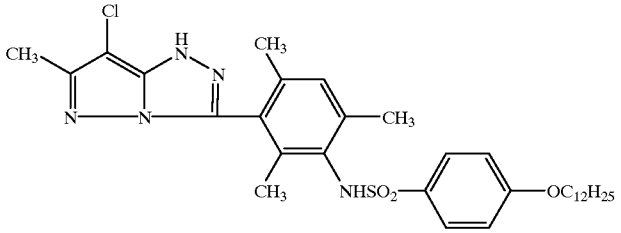
M-46
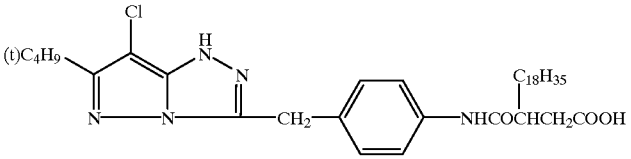
M-47
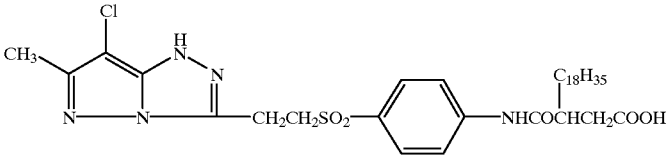
M-48
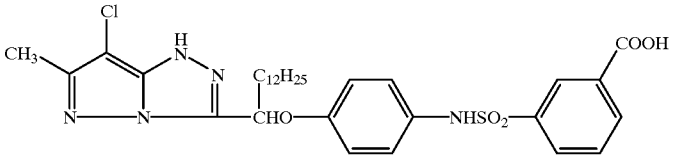
M-49
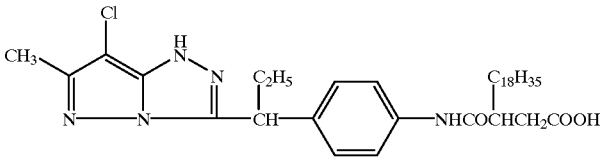
M-50
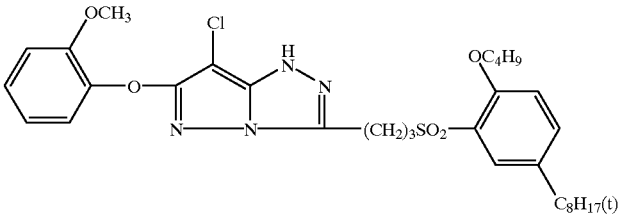
M-51
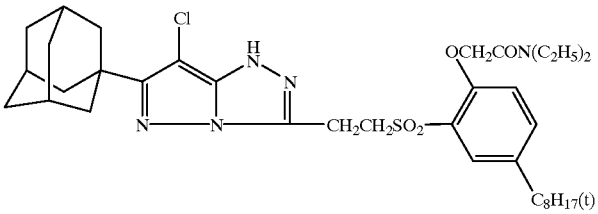

-continued
M-52
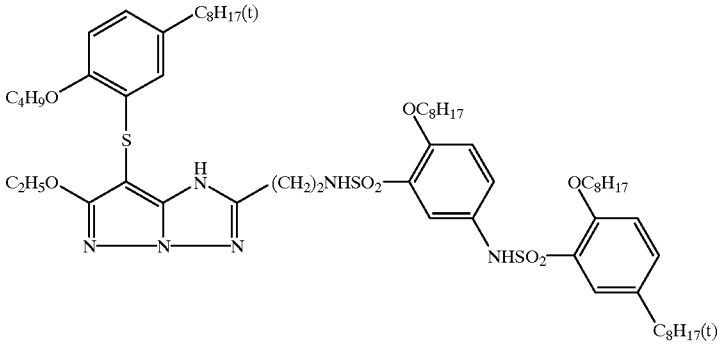
M-53
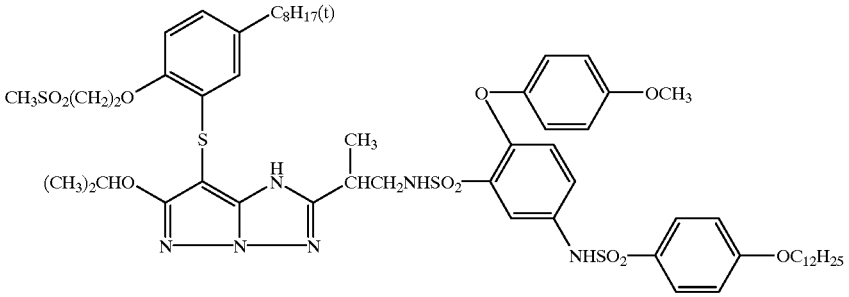
M-54
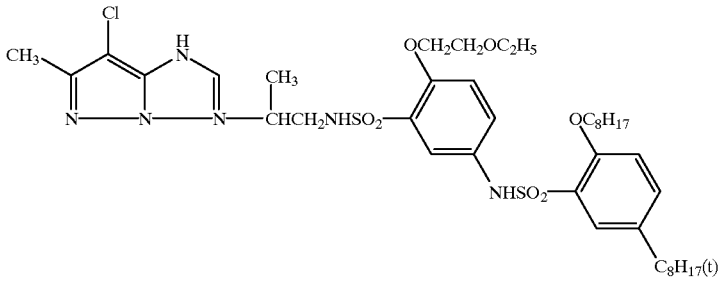
M-55
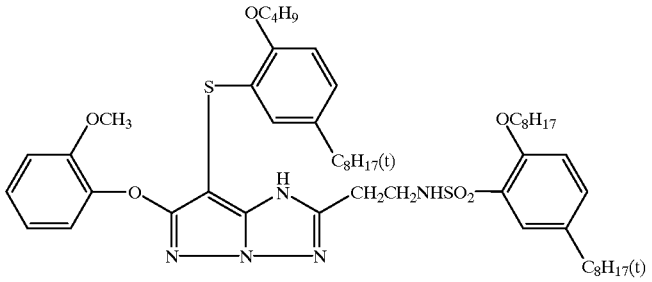
M-56
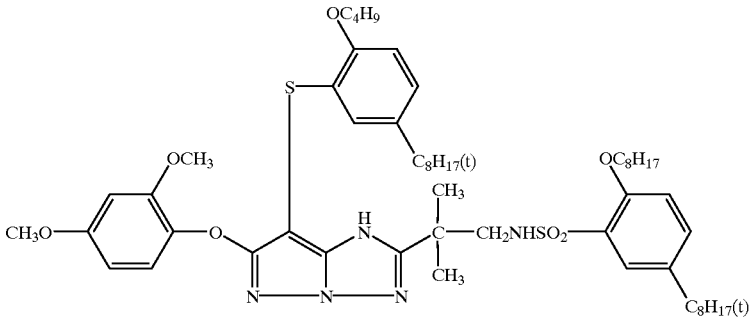

-continued
M-57
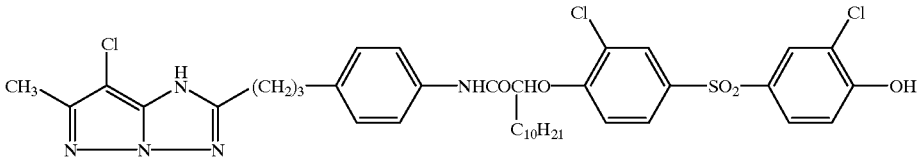
M-58
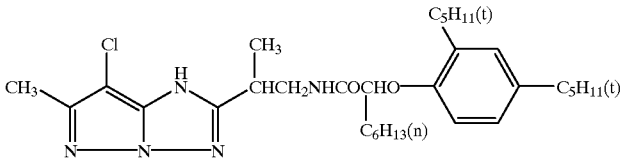
M-59
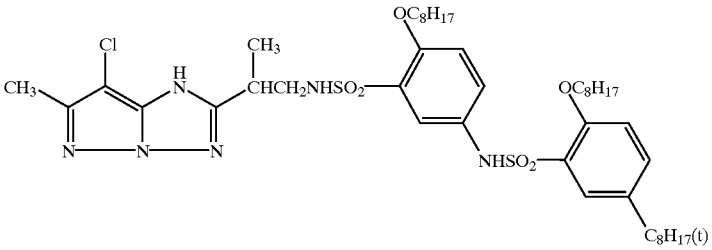
M-60
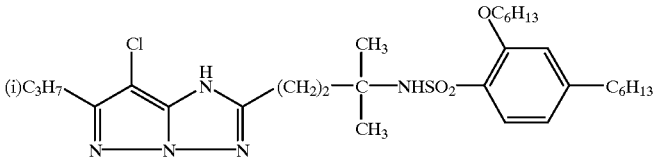
M-61
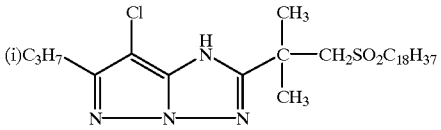
M-62
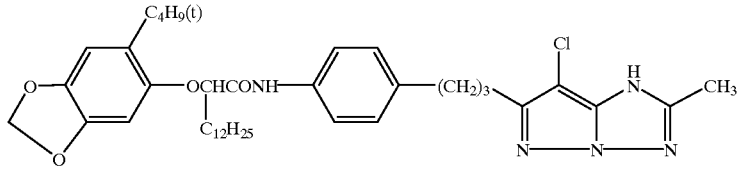
M-63
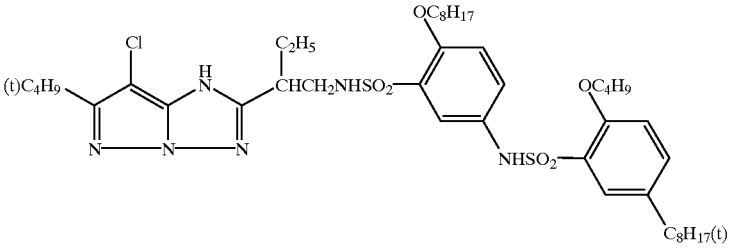
M-64
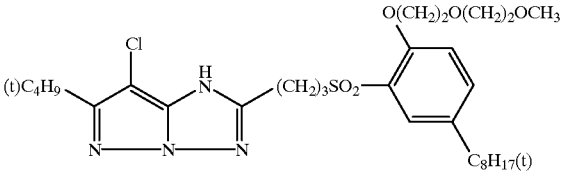

-continued
M-65
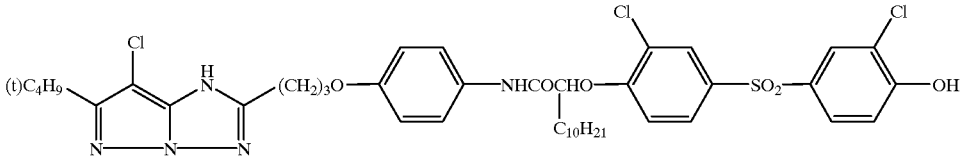
M-66
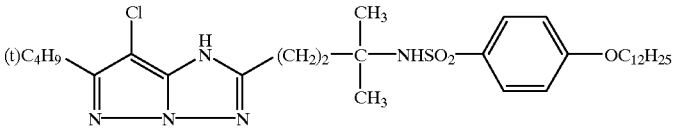
M-67
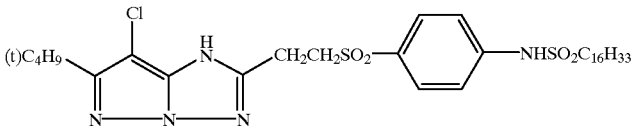
M-68
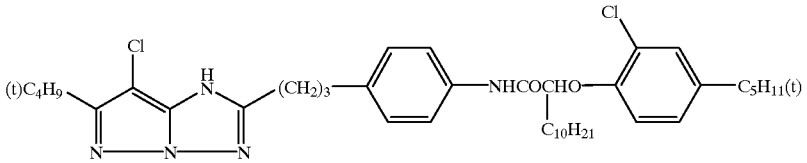
M-69
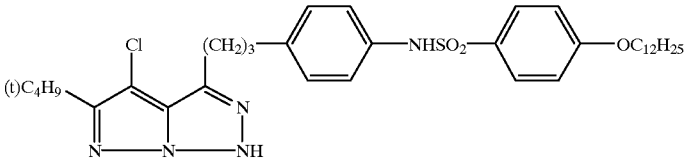
M-70
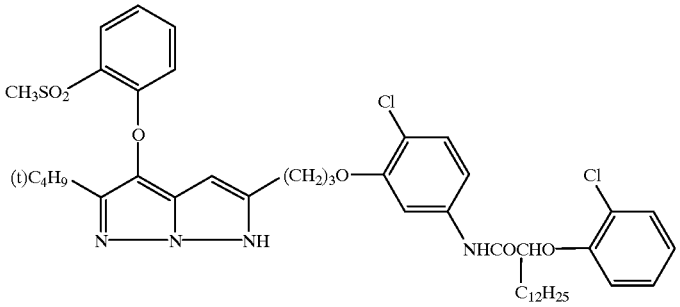
M-71
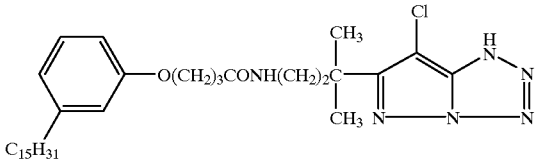
M-72
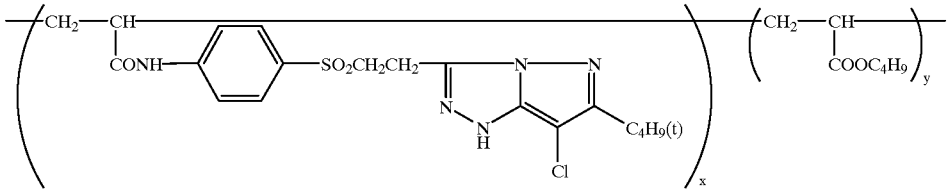
x:y = 50:50

-continued

M-73

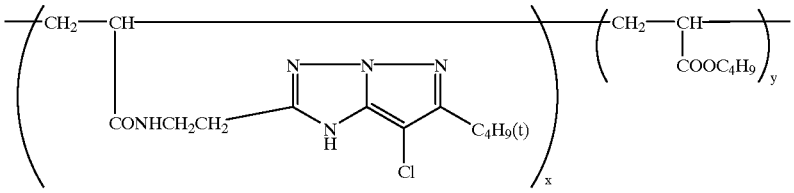

x:y = 50:50

Compounds represented by general formulas (I) to (IV) are explained below.

In each of the above-mentioned general formulas (I) to (IV), representative groups of substituents represented by each of $R_1$, $R_2$, and $R_3$ include an alkyl, aryl, anilino, acylamino, sulfonamido, alkylthio, arylthio, cycloalkyl group, etc. In addition to these, is included a halogen atom, and a cycloalkenyl, alkynyl, heterocyclic, sulfonyl, sulfinyl, phosphonyl, acyl, carbamoyl, sulfamoyl, cyano, alkoxy, aryloxy, heterocycloxy, siloxy, acyloxy, sulfonyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclothio, thioureido, carboxy, hydroxy, mercapto, nitro, sulfo group, etc., and a spiro compound residual group, a bridge-containing hydrocarbon compound residual group, etc.

In each substituent represented by each of $R_1$, $R_2$, and $R_3$, an alkyl group preferably contains from 1 to 32 carbon atoms and may have a straight or branched chain.

As the aryl group, a phenyl group is preferred.

The acylamino groups include an alkylcarbonylamino group, an arylcarbonylamino group, etc.

The sulfonamide groups include an alkylsulfonylamino group, an arylsulfonylamino group, etc.

The alkyl component and aryl component in the alkylthio group and arylthio group include the same as those included in the above-mentioned alkyl group and aryl group.

The alkenyl groups include those having from 2 to 32 carbon atoms, and the cycloalkyl groups include those having from 3 to 12 carbon atoms and preferably from 5 to 7 carbon atoms. The alkenyl groups may have a straight or branched chain.

The cycloalkenyl groups include those having from 3 to 12 carbon atoms, and preferably from 5 to 7 carbon atoms.

The sulfonyl groups include an alkylsulfonyl group, an arylsulfonyl group, etc.;

the sulfinyl groups include an alkylsulfinyl group, an arylsulfinyl group, etc.;

the phophonyl groups include an alkylphosphonyl group, an alkoxyphosphonyl group, an aryloxyphophonyl group, an arylphosphonyl group, etc.;

the acyl groups include an alkylcarbonyl group, an arylcarbonyl group, etc.;

the carbamoyl groups include an alkylcarbamoyl group, an arylcarbamoyl group, etc.;

the sulfamoyl groups include an alkylsulfamoyl group, an arylsulfamoyl group, etc.;

the acyloxy groups include an alkylcarbonyloxy group, an arylcarbonyloxy group, etc.;

the sulfonyloxy groups include an alkylsulfonyloxy group, an arylsulfonyloxy group, etc.;

the carbamoyloxy groups include an alkylcarbamoyloxy group, an arylcarbamoyloxy group, etc.;

the ureido groups include an alkylureido group, an arylureido group, etc.;

the sulfamoylamino groups include an alkylsulfamoylamino group, an arylsulfamoylamino group, etc.;

the heterocyclic groups are preferably 5 to 7 member rings and specifically include a 2-furyl group, a 2-thienyl group, a 2-primidinyl group, a 2-benzothiazolyl group, a 1-pyrolyl group, a 1-tetrazolyl group, etc.;

the heterocyclic oxy groups preferably comprise 5- to 7-member heterocyclic rings, and for example, include 3,4,5,6-tetrahydropyranyl-2-oxy group, a 1-phenyltetrazole-5-oxy group, etc.;

the heterocyclic thio groups preferably include a 5- to 7-member heterocyclic thio group, and for example, a 2-pyridylthio group, a 2-benzothiazolylthio group, a 2,4-diphenoxy-1,3,5-triazole-6-thio group, etc.;

the siloxy groups include a trimethylsiloxy group, a triethylsiloxy group, a dimethylbutylsiloxy group, etc.;

the imido groups include a succinimido group, a 3-heptadecylsuccinimido group, a phthalimido group, a glutarimido group, etc.;

the spirocompound residual groups include spiro[3.3]heptane-1-il, etc.;

the bridge-containing hydrocarbon compound residual groups include bicyclo[2.2.1]heptane-1-il, tricyclo[3.3.1. $1^{3,7}$]decane-1-il, 7,7-dimethyl-bicyclo[2.2.1]heptane-1-il, etc.

The above-mentioned groups may comprise substituents such as an nondiffusion type group e.g. a long-chain hydrocarbon group or a polymer residual group, etc.

Of substituents represented by $R_2$ and $R_3$, those are preferably electron attractive groups having a substituent constant $\sigma_P$ of not less than 0.3, and such representative substituents include a cyano group, a nitro group, a sulfonyl group (e.g. an octylsulfonyl group, a phenylsulfonyl group, a torifluoromethylsulfonyl group, pentafluorophenylsulfinyl group, etc.), a β-carboxyvinyl group, a sulfinyl group (e.g. a t-butylsulfinyl group, a trisulfinyl group, a trifluoromethylsulfinyl group, a pentafluorophenylsulfinyl group, etc.), a β,β-dicyanovinyl group, a halogenated alkyl group (e.g. a trifluoromethyl group, a perfluorooctyl group, an ω-hydroperfluorododecyl group, etc.), a formyl group, a carboxyl group, a carbonyl group (e.g. an acetyl group, a pivaloyl group, a benzoyl group, a trifluoroacetyl group, etc.), an alkyl and aryloxycarbonyl group (e.g. an ethoxycarbonyl group, a phenoxycarbonyl group, etc.), a 1-tetrazolyl group, a 5-chloro-1-tertazolyl group, a carbamoyl group (e.g. a dodecycarbamoyl group, a phenylcarbamoyl group, etc.), a sulfamoyl group (e.g. a trifluoromethylsulfamoyl group, a phenylsulfamoyl group, an ethylsulfamoyl group, etc.).

Of substituents represented by $R_2$ and $R_3$, those particularly preferred are an alkyl group and an aryloxycarbonyl group.

In the general formulas (I) to (IV), the substituent represented by EWG is an electron attractive group having a Hammett substituent constant $\sigma_P$ of 0.3 or more, and such representative substituents include a cyano group, a nitro group, a sulfonyl group (for example, an octylsulfonyl group, a phenylsulfonyl group, a trifluoromethylsulfonyl group, a pentafluorophenylsulfonyl group, etc.), a β-carboxyvinyl group, a sulfinyl group (e.g. a t-butylsulfinyl group, a trisulfinyl group, a trifluoromethylsulfinyl group, a pentafluorophenylsulfinyl group, etc.), a β,β-dicyanovinyl group, a halogenated alkyl group (e.g. a trifluoromethyl groun, a perfluorooctyl group, an ω-hydroperfluorododecyl group, etc.), a formyl group, a carboxyl group, a carbonyl group (e.g. an acetyl group, a pivaloyl group, a benzoyl group, a trifluoroacetyl group, etc.), an alkyl and aryloxycarbonyl group (e.g. an ethoxycarbonyl group, a phenoxycarbonyl group, etc.), a 1-tetrazolyl group, a 5-chloro-1-tertazolyl group, a carbamoyl group (e.g. a dodecycarbamoyl group, a phenylcarbamoyl group, etc.), a sulfamoyl group (e.g. a trifluoromethylsulfamoyl group, a phenylsulfamoyl group, an ethylsulfamoyl group, etc.). Of substituents represented by EWG, those preferred are a cyano group, a sulfonyl group, a sulfinyl group, and a halogenated alkyl group.

X represents substituents which can be coupled off on reaction with the oxide of a color developing agent, and the substituents include, for example, a halogen atom (a chlorine atom, a bromine atom, a fluorine atom, etc.) and alkoxy, aryloxy, heterocycloxy, acyloxy, sulfonyloxy, alkoxy, carbonyloxy, aryloxycarbonyl, alkyloxaryloxy, alkoxyoxaryloxy, alkylthio, arylthio, heterocylothio, alkyloxythiocarbonylthio, acylamino, aulfonamido, nitrogen atom-containing heterocyclic ring linked through a nitrogen atom, alkyloxycarbonylamino, aryloxycarbonylamino, carboxyl group, etc. The substituents represented by X are preferably a hydrogen atom, a halogen atom, an alkoxy group, an aryloxy group, an alkylthio group, an arylthio group or a nitrogen containing heterocyclic ring bonded through nitrogen.

Y represents a hydrogen atom or a substituent. Preferred substituents are those which are coupled off after reacting with the oxide of a developing agent. The substituents represented by Y include, for example, those which can leave under alkaline conditions as described in Japanese Patent Publication Open to Public Inspection No. 61-228444, and those which are subjected to coupling-off on reaction with the oxide of developing agent as described in Japanese Patent Publication Open to Public Inspection No. 56-133734. However, Y is preferably a hydrogen atom.

Accordingly, of compounds represented by general formulas (I) to (IV) (photographic cyan couplers), those particularly preferred are represented by following general formulas (V) to (VIII).

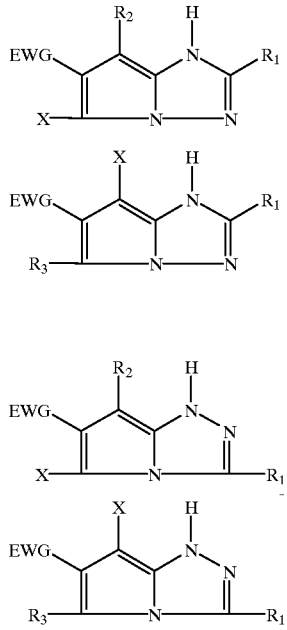

In the above-mentioned general formulas (V) to (VIII), $R_1$, $R_2$, $R_3$, EWG, and X are the same $R_1$, $R_2$, $R_3$, EWG, and X as defined in general formulas (I) to (IV), respectively.

Representative compounds represented by general formulas (I) to (IV) of the present invention are shown below.

(A-1)

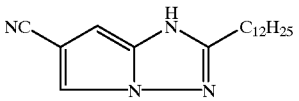

(A-2)

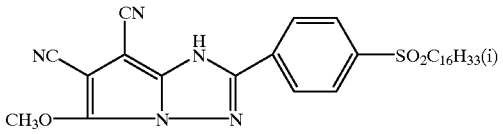

-continued
(A-3)
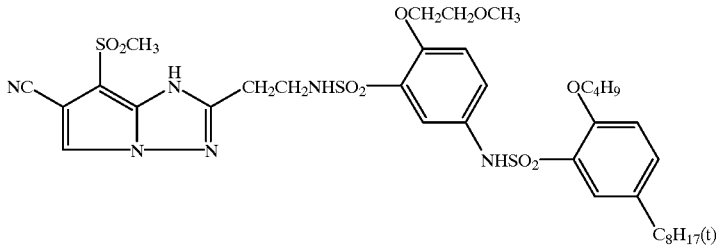
(A-4)
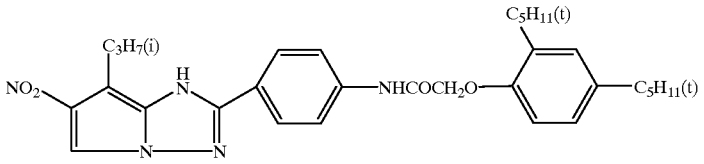
(A-5)
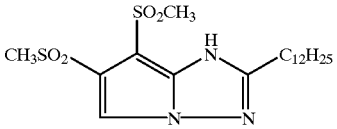
(A-6)
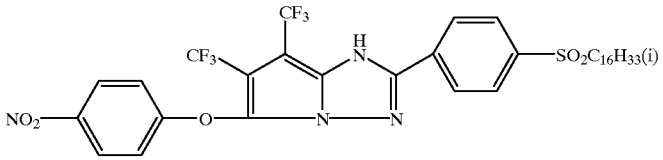
(A-7)
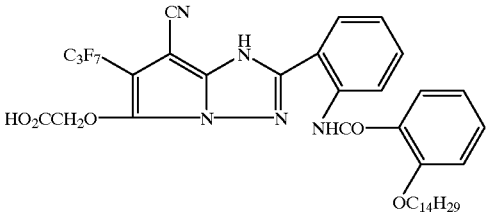
(A-8)
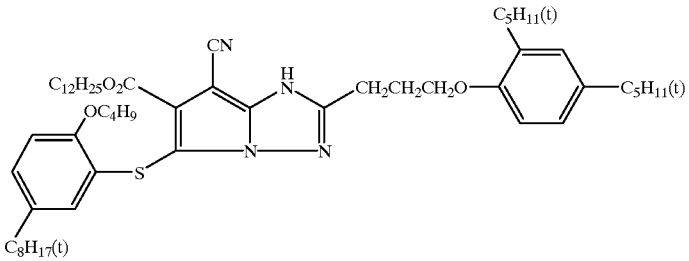
(A-9)
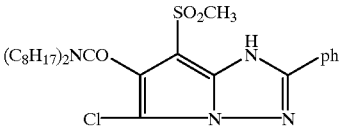
(A-10)
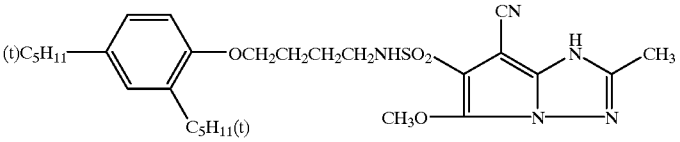

-continued
(A-11)
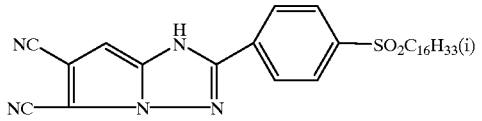
(A-12)
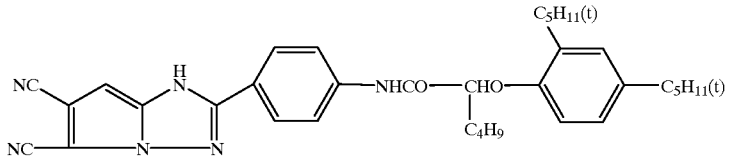
(A-13)
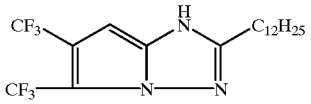
(A-14)
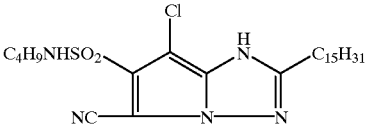
(A-15)
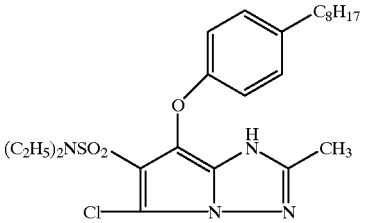
(A-16)
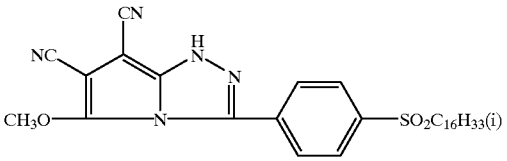
(A-17)
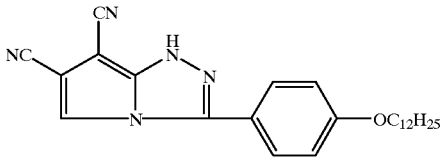
(A-18)
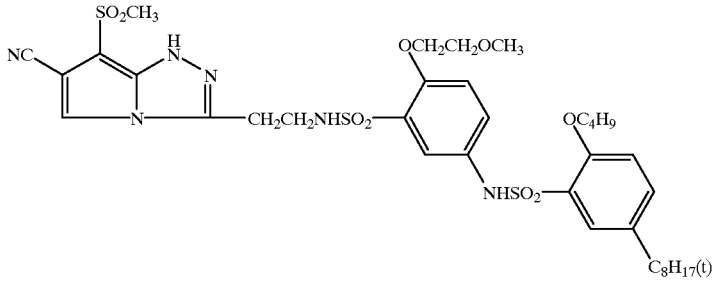

-continued
(A-19)
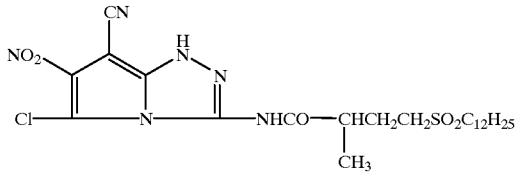
(A-20)
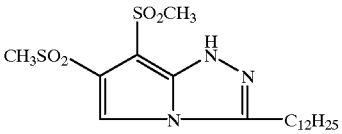
(A-21)
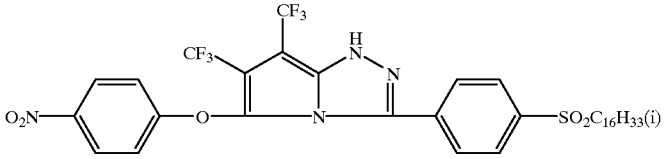
(A-22)
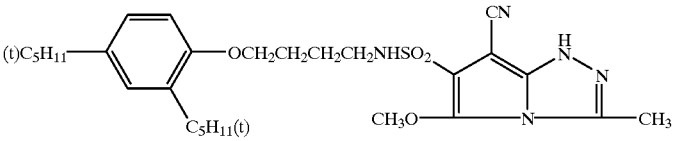
(A-23)
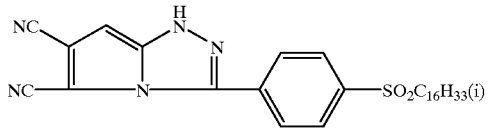
(A-24)
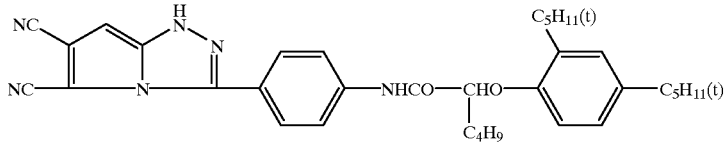
(A-25)
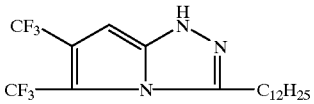
(A-26)
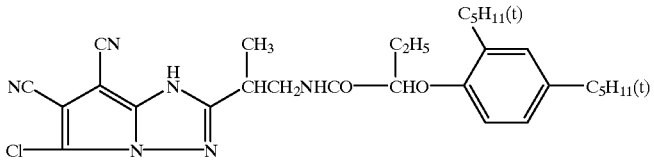
(A-27)
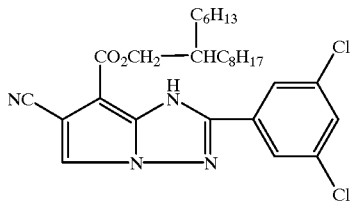

-continued
(A-28)
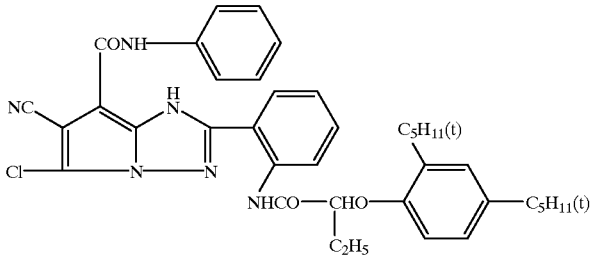
(A-29)
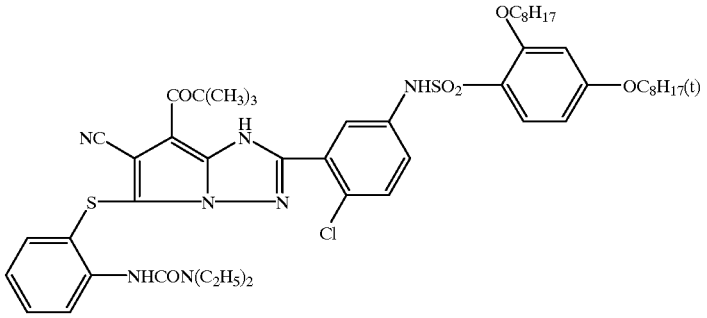
(A-30)
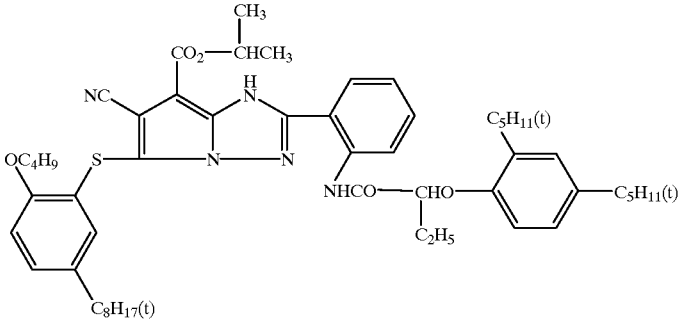
(A-31)
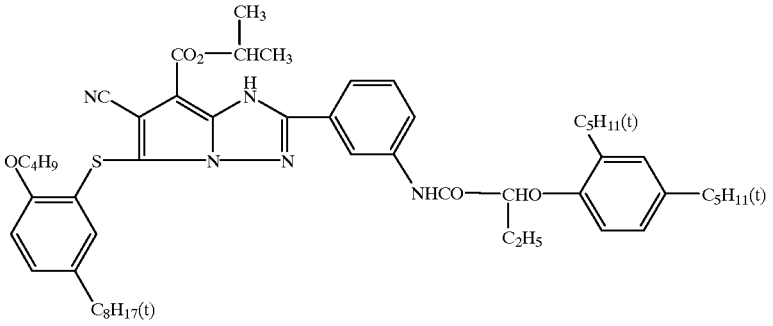
(A-32)
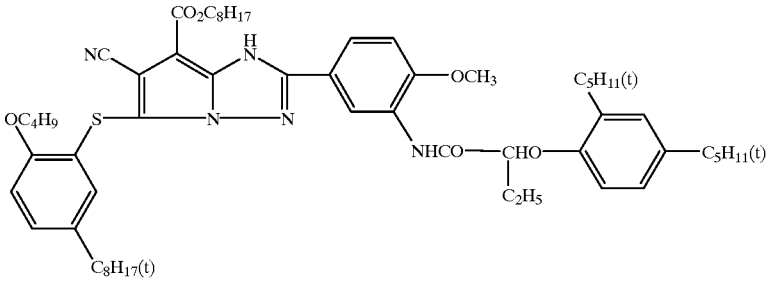

-continued
(A-33)
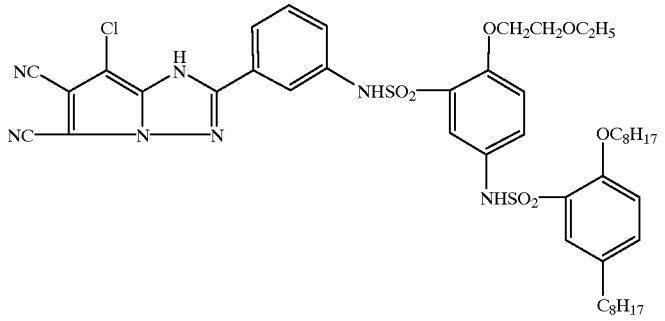
(A-34)
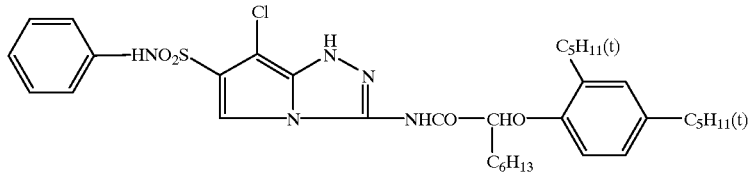
(A-35)
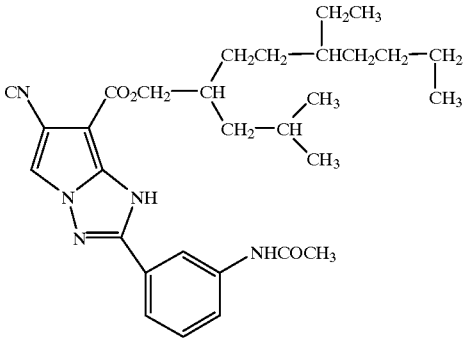
(A-36)
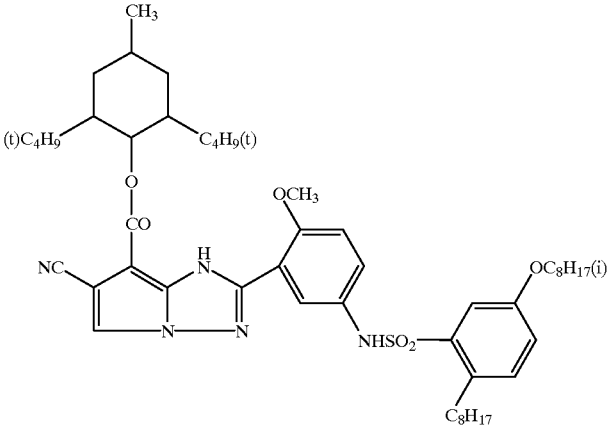
(A-37)
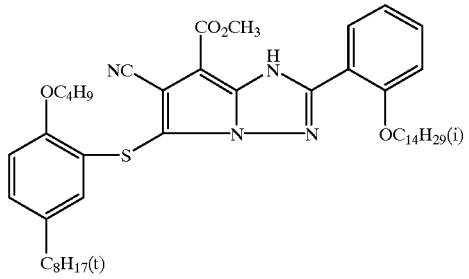

-continued (A-38)

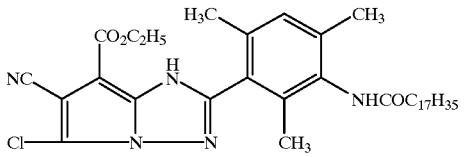

(A-39)

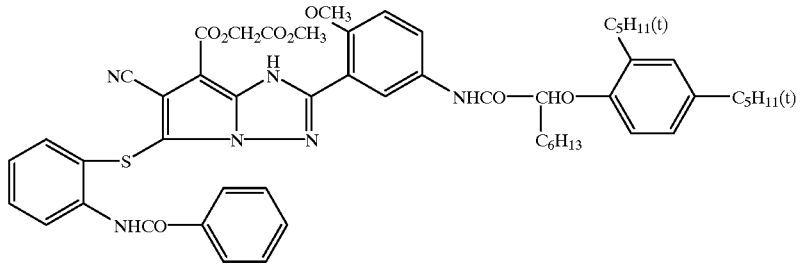

(A-40)

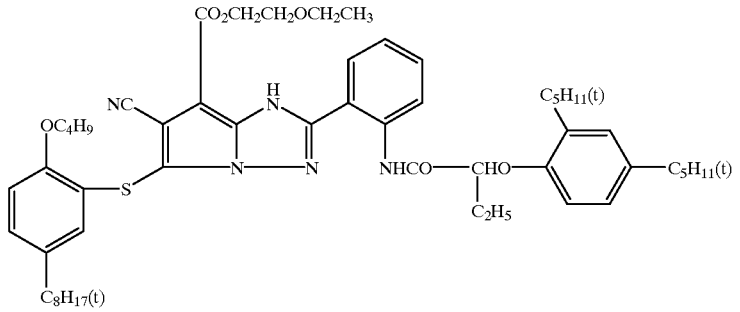

Compounds represented by formulae (IX) and (X) are described more in detail.

The branched alkyl groups, reoresented by $R_{21}$ and $R_{23}$ in the general formula (IX) and (X), include, for example, an i-propyl, t-butyl, sec-butyl, i-butyl, t-octyl group, etc.

The alkyl components of the substituted alkyl groups may comprise a straight or branched chain or a ring, and include, for example, a methyl, ethyl, butyl, i-propyl, t-butyl, sec-butyl, i-butyl, t-octyl, cyclohexyl group, etc.

The aryl components of the substituted aryl groups include a phenyl group, etc.

The heterocyclic groups include, for example, a 2-furyl, 2-thienyl, 2-imidazolyl, 2-thiazolyl, 3-isooxazolyl, 3-pyrimidyl, 3-pyrazolyl, 2-benzothiazole group, etc.

However, when $R_{21}$ and $R_{23}$ each represents a substituted alkyl group or a substituted aryl group, these alkyl or aryl components always comprise a substituent.

When $R_{21}$ and $R_{23}$ each represents a branched alkyl group or a heterocyclic group, these substituents may have a substituent if desired.

These substituents include, for example, groups such as an alkyl, aryl, anilino, acylamino, sulfonamido, alkylthio, arylthio, alkenyl, cycloalkyl group, etc. In addition to these, are included a halogen atom, and a cycloalkenyl, alkynyl, heterocyclic, sulfonyl, sulfinyl, phosphonyl, acyl, carbamoyl, sulfamoyl, cyano, alkoxy, aryloxy, heterocyclic oxy, siloxy, acyloxy, sulfonyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclic thio, thioureido, carboxyl, hydroxyl, mercapto, nitro, sulfo group. And a spiro compound residual group and a bridge-containing hydrocarbon compound residual group are also included.

In each of the above-mentioned general formulas (IX) and (X), substituents represented by each of $R_{22}$ and $R_{24}$ include an alkyl, aryl, anilino, acylamino, sulfonamido, alk-lthio, arylthio, cycloalkyl group, etc. In addition to these, is included a halogen atom, and a cycloalkenyl, alkynyl, heterocyclic, sulfonyl, sulfinyl, phosphonyl, acyl, carbamoyl, sulfamoyl, cyano, alkoxy, aryloxy, heterocycloxy, siloxy, acyloxy, sulfonyloxy, carbamoyloxy, amino, alkylamino, imido, ureido, sulfamoylamino, alkoxycarbonylamino, aryloxycarbonylamino, alkoxycarbonyl, aryloxycarbonyl, heterocyclothio, thioureido, carboxy, hydroxy, mercapto, nitro, sulfo group, etc., and a spiro compound residual group, a bridge-containing hydrocarbon compound residual group, etc.

In a branched alkyl group, a substituted alkyl group, a substituted aryl group, and a heterocyclic group represented by the above-mentioned $R_{21}$ and $R_{23}$, and a substituent represented by each of $R_{22}$ and $R_{24}$, an alkyl group preferably contains from 1 to 32 carbon atoms and may have a straight or branched chain.

The aryl group is preferably a phenyl group.

The acylamino groups include, for example, an alkylcarbonylamino group, an arylcarbonylamino group, etc.

The sulfonamide groups include, for example, an alkylsulfonylamino group, an arylsulfonylamino group, etc.

The alkyl component and aryl component in the alkylthio group and arylthio group include the same as those included in the above-mentioned alkyl group and aryl group represented by $R_{22}$ and $R_{24}$.

The alkenyl groups include, for example, those having from 2 to 32 carbon atoms, and the cycloalkyl groups include, for example, those having from 3 to 12 carbon atoms and preferably from 5 to 7 carbon atoms. The alkenyl groups mav have a straight or branched chain.

The cycloalkenyl groups include those having from 3 to 12 carbon atoms and preferably from 5 to 7 carbon atoms.

The sulfonyl groups include, for example, an alkylsulfonyl group, an arylsulfonyl group, etc.;

the sulfinyl groups include an alkylsulfinyl group, an arylsulfinyl group, etc.;

the phosphonyl groups include, for example, an alkylphosphonyl group, an alkoxyphosphonyl group, an aryloxyphophonyl group, an arylphosphonyl group, etc.;

the acyl groups include, for example, an alkylcarbonyl group, an arylcarbonyl group, etc.;

the carbamoyl groups include, for example, an alkylcarbamoyl group, an arylcarbamoyl group, etc.;

the sulfamoyl groups include, for example, an alkylsulfamoyl group, an arylsulfamoyl group, etc.;

the acyloxy groups include, for example, an alkylcarbonyloxy group, an arylcarbonyloxy group, etc.;

the sulfonyloxy groups include, for example, an alkylsulfonyloxy group, an arylsulfonyloxy group, etc.;

the carbamoyloxy groups include, for example, an alkylcarbamoyloxy group, an arylcarbamoyloxy group, etc.;

the ureido groups include an alkylureido group, an arylureido group, etc.;

the sulfamoylamino groups include an alkylsulfamoylamino group, an arylsulfamoylamino group, etc.;

the heterocyclic groups are preferably 5 to 7 member rings and specifically include a 2-furyl group, a 2-thienyl group, a 2-pyrimidinyl group, a 2-benzothiazolyl group, a 1-pyrolyl group, a 1-tetrazolyl group, etc.;

the heterocycloxy groups preferably comprise 5- to 7-member heterocyclic ring, and for example, include 3,4,5,6-tetrahydropyranyl-2-oxy group, a 1-phenyltetrazole-5-oxy group, etc.:

the heterocyclic thio groups preferably include a 5- to 7-member heterocyclic thio group, and for example, a 2-pyridylthio group, a 2-benzothiazolylthio group, a 2,4-diphenoxy-1,3,5-triazole-6-thio group, etc.;

the siloxy groups include a trimethylsiloxy group, a triethylsiloxy group, a dimethylbutylsiloxy group, etc.;

the imido groups include a succinimido group, a 3-heptadecylsuccinimido group, a phthalimido group, a glutarimido group, etc.;

the spiro compound residual groups include spiro[3.3]heptane-1-il, etc.;

the bridge-containing hydrocarbon compound residual groups include bicyclo[2.2.1]heptane-1-il, tricyclo[3.3.1$^{3,7}$]decane-1-il, 7,7-dimethyl-bicyclo[2.2.1]heptane-1-il, etc.

The substituents represented by $R_{22}$ and $R_{24}$ are preferably an alkyl group and an aryl group, and more preferably an aryl group.

The above-mentioned groups may further comprise substituents such as an anti-diffusible group, etc. of a long chain hydrocarbon group, a polymer residual group, etc.

$X_{21}$ and $X_{22}$ each represents a hydrogen atom and a halogen atom (for example, a chlorine atom, a bromine atom, a fluorine atom, etc.), and, as substituents which can be coupled off on reaction with the oxide of a color developing agent, for example, an alkoxy, aryloxy, heterocyclic oxy, acyloxy, sulfonyloxy, alkoxycarbonyloxy, aryloxycarbonyloxy, alkyloxalyloxy, alkoxyoxalyloxy, alkylthio, arylthio, heterocyclic thio, alkyloxythiocarbonylthio, acylamino, aulfonamido, nitrogen atom-containing heterocyclic ring linked through a nitrogen atom, alkyloxycarbonylamino, aryloxycarbonylamino, carboxyl group, etc. The substituents are preferably a hydrogen atom, a halogen atom, an alkoxy group, an aryloxy group, an alkylthio group, an arylthio group or a nitrogen atom-containing heterocyclic ring linked thorouah a nitrogen atom.

Of cyan couplers represented by general formulas (IX) and (X), those represented by general formula (IX) are preferred.

Specific examples of representative cyan couplers represented by general formulas (IX) and (X) in the present invention are shown below.

(B-1)

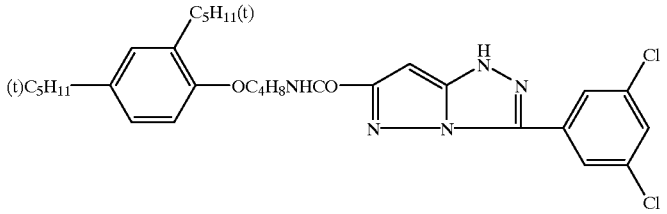

(B-2)

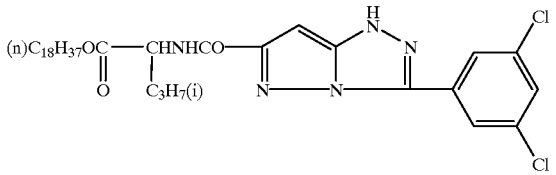

-continued
(B-3)
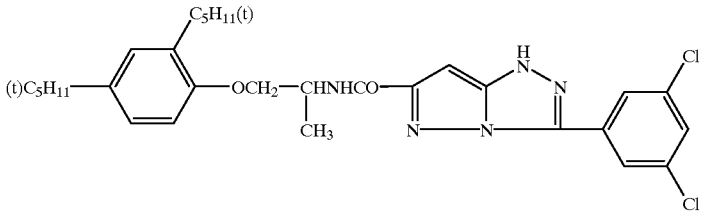
(B-4)
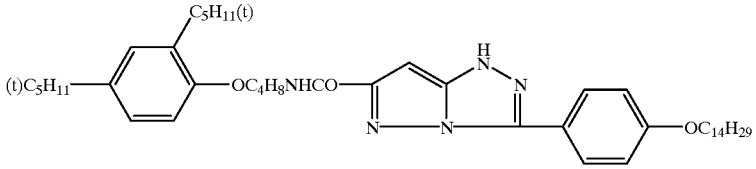
(B-5)
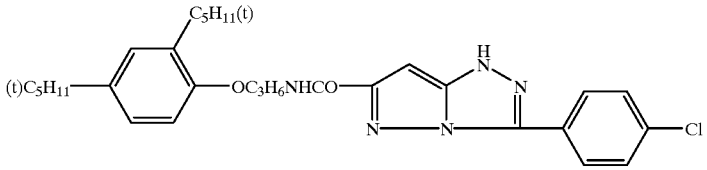
(B-6)
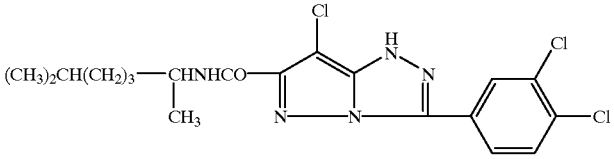
(B-7)
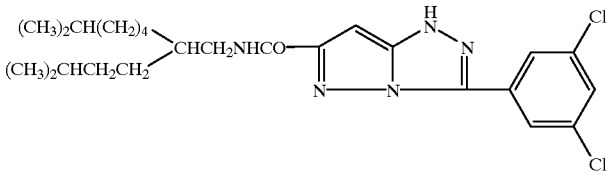
(B-8)
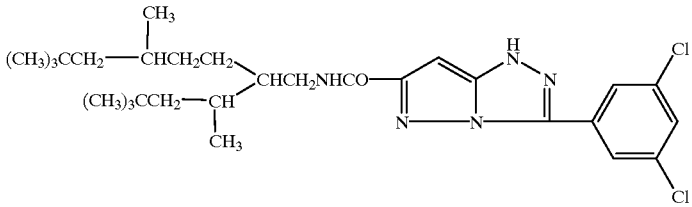
(B-9)
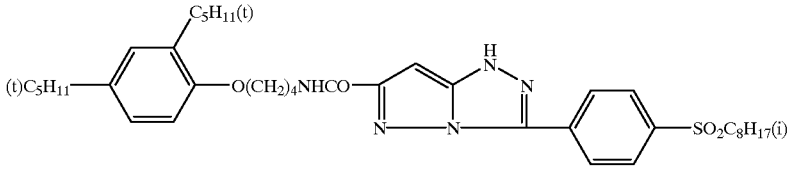

-continued
(B-10)
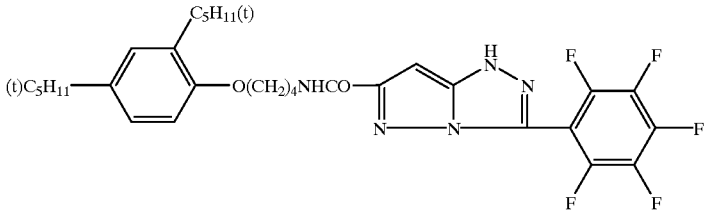
(B-11)
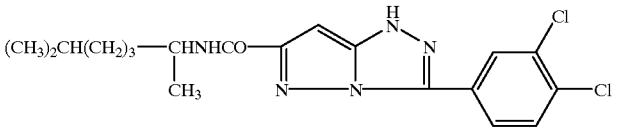
(B-12)
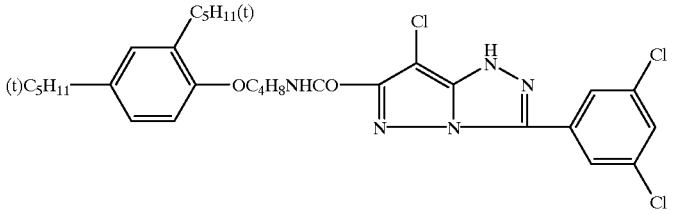
(B-13)
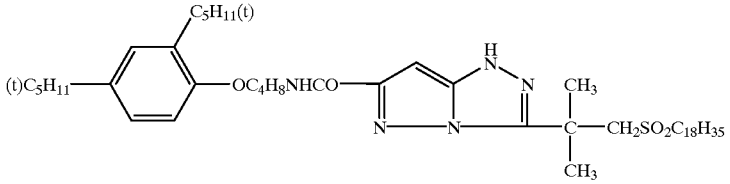
(B-14)
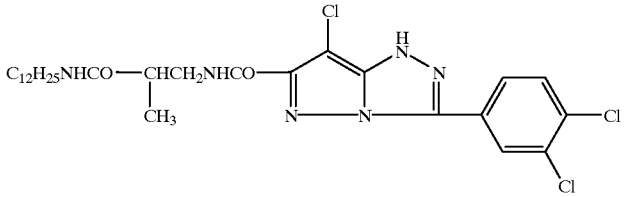
(B-15)
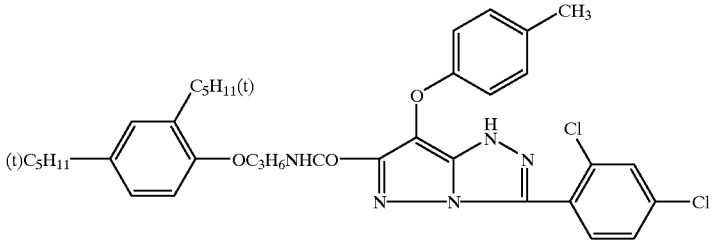
(B-16)
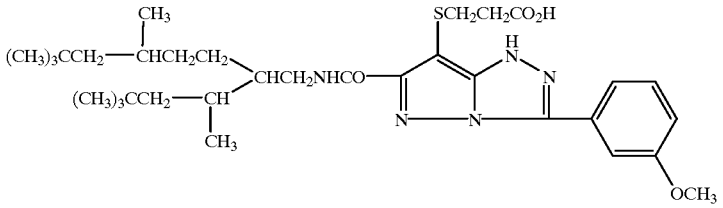

-continued
(B-17)
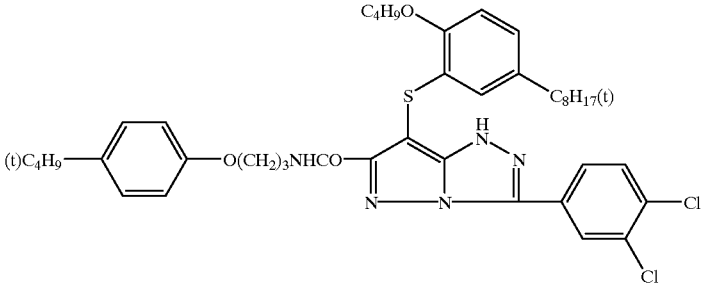
(B-18)
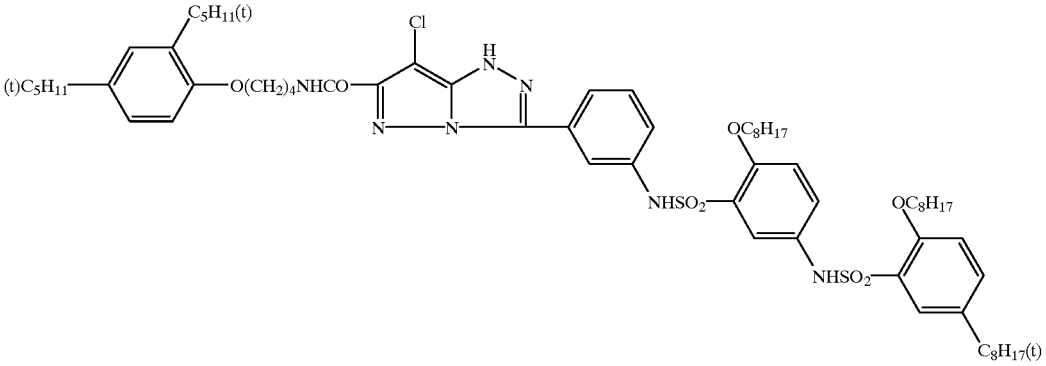
(B-19)
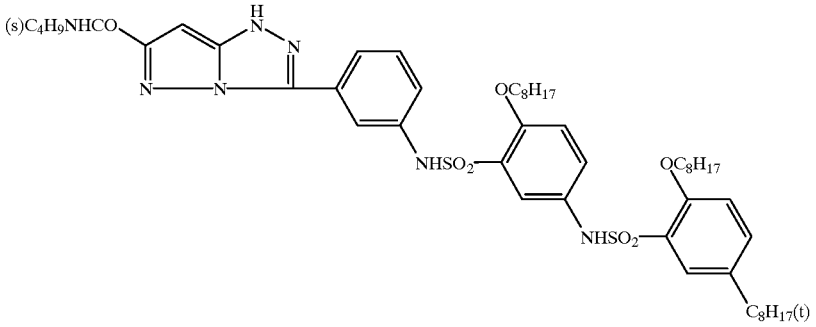
(B-20)
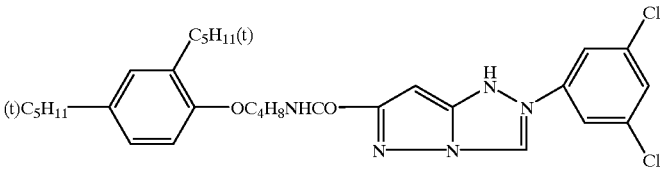
(B-21)
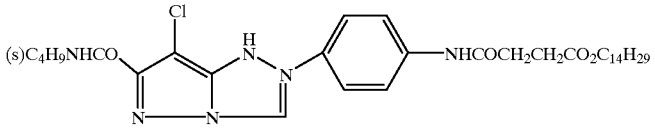
(B-22)
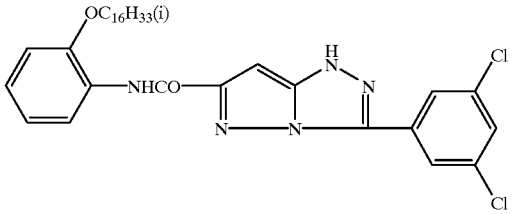

-continued
(B-23)
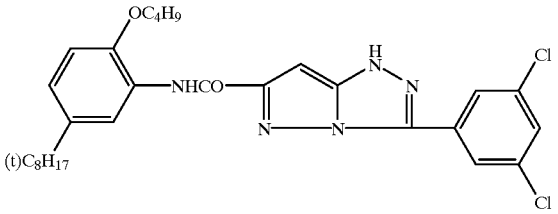
(B-24)
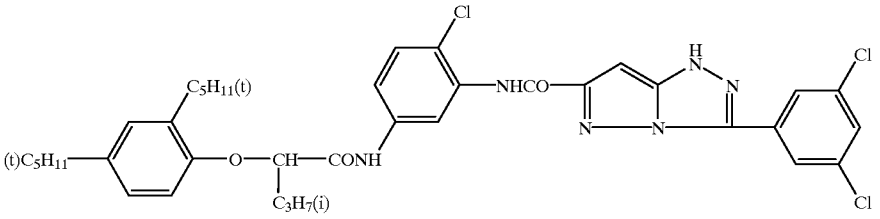
(B-25)
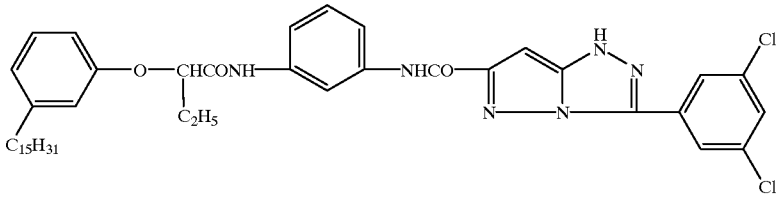
(B-26)
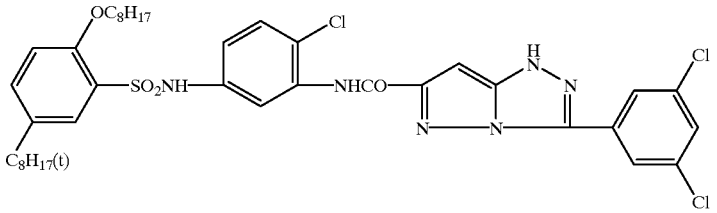
(B-27)
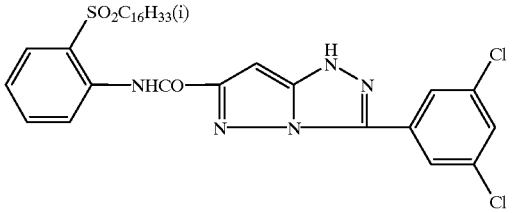
(B-28)
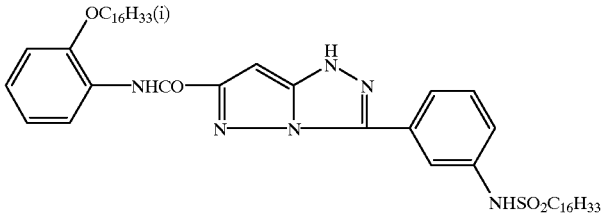
(B-29)
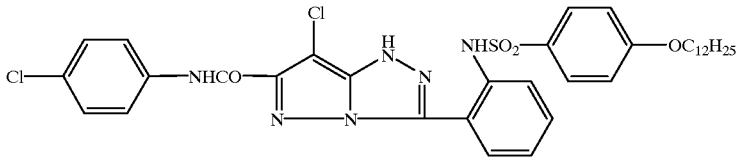

-continued
(B-30)
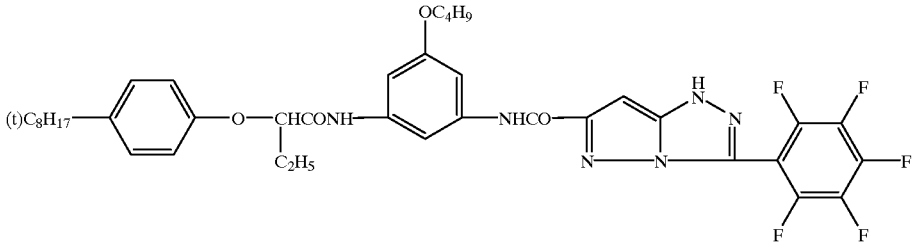
(B-31)
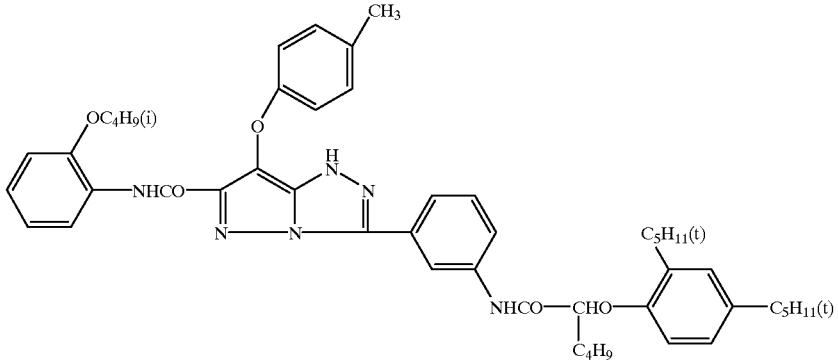
(B-32)
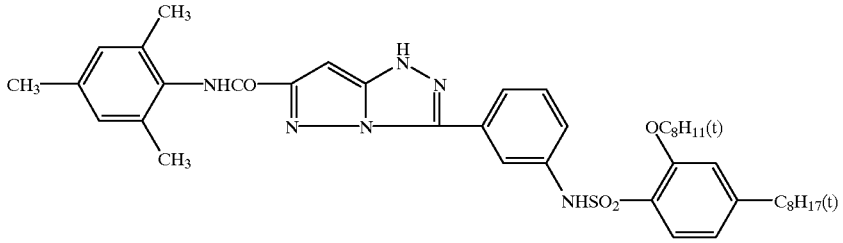
(B-33)
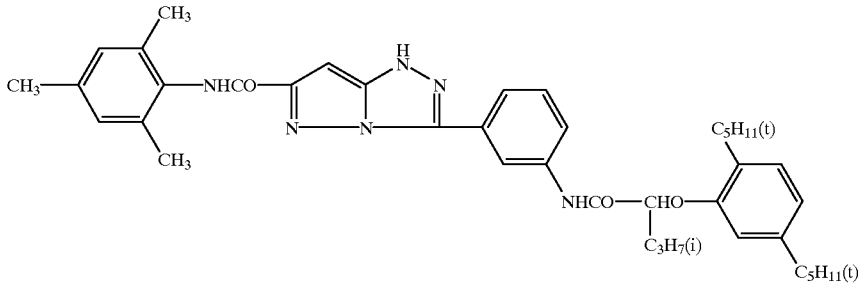
(B-34)
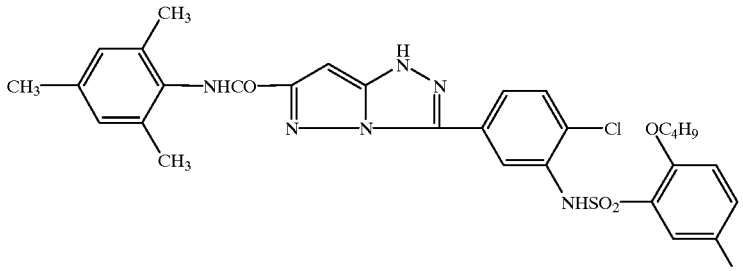

-continued
(B-35)
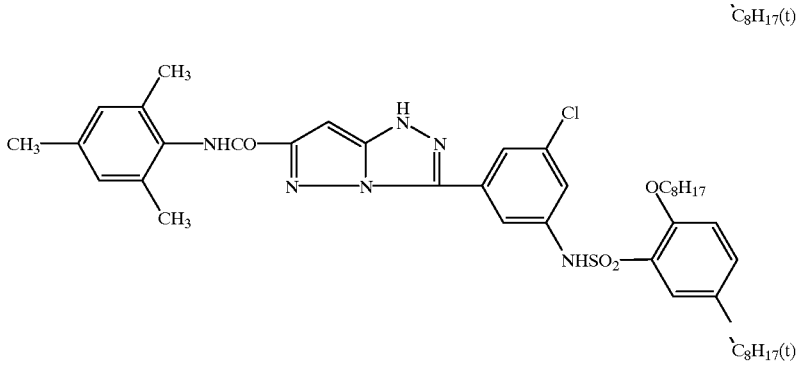
(B-36)
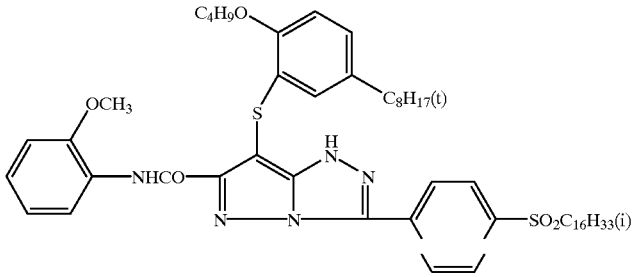
(B-37)
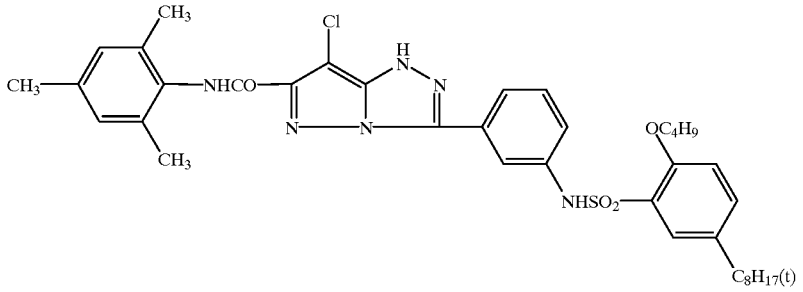
(B-38)
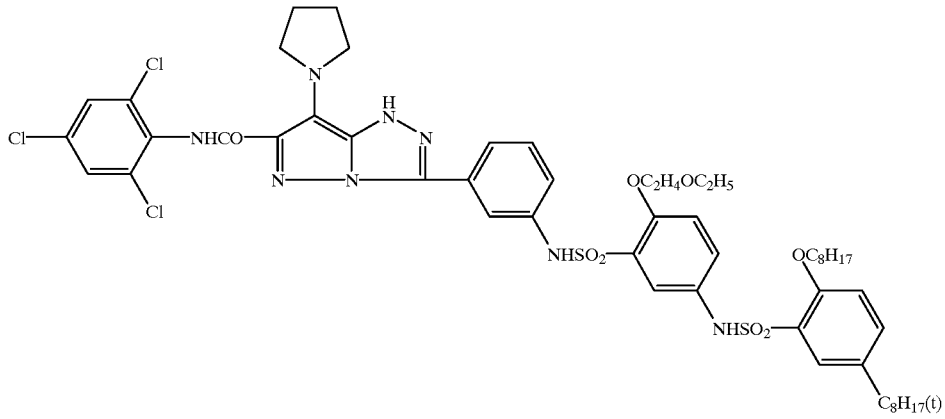
(B-39)
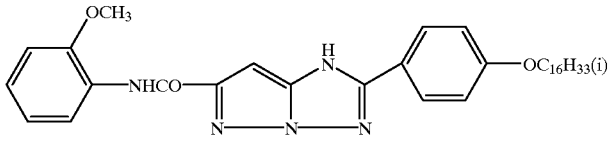

-continued
(B-40)
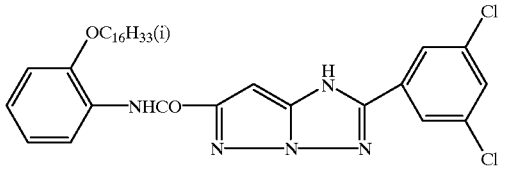
(B-41)
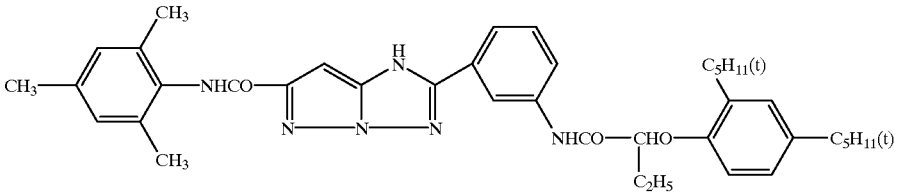
(B-42)
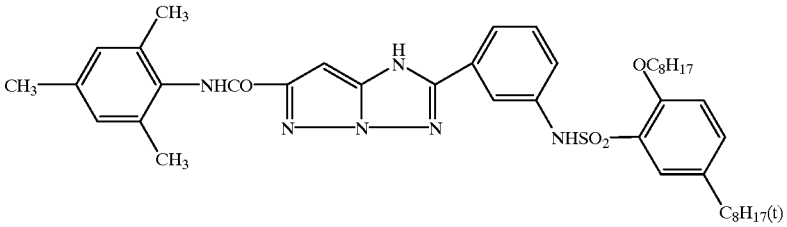
(B-43)
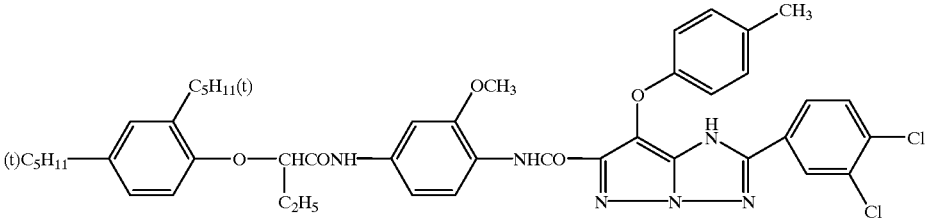
(B-44)
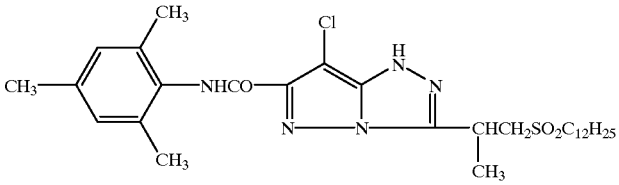
(B-45)
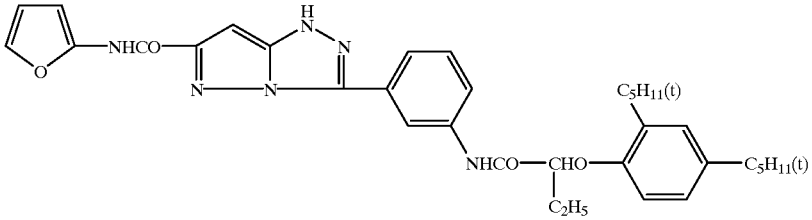
(B-46)
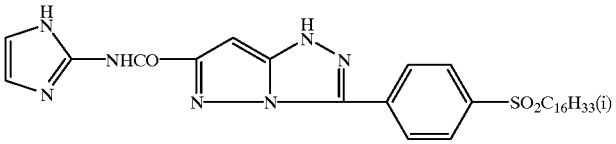

-continued
(B-47)
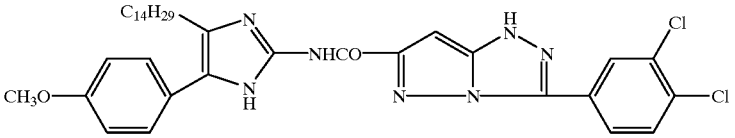
(B-48)
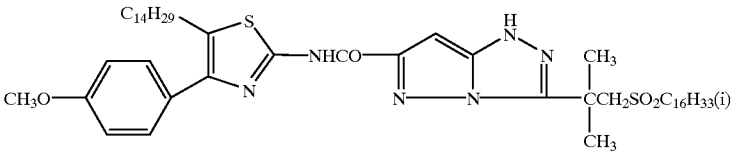
(B-49)
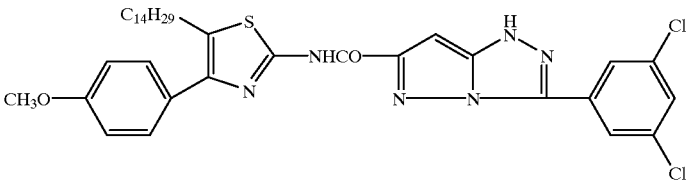
(B-50)
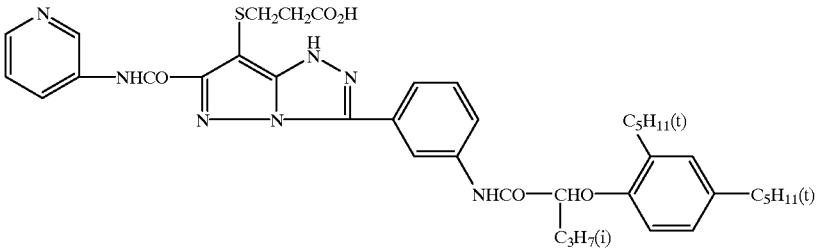
(B-51)
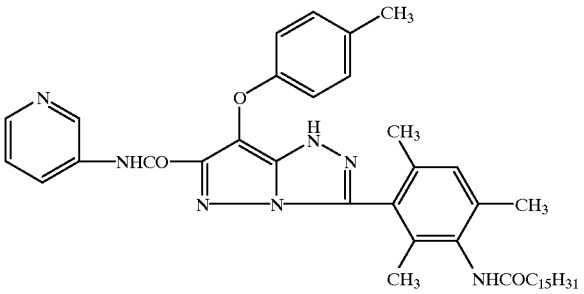
(B-52)
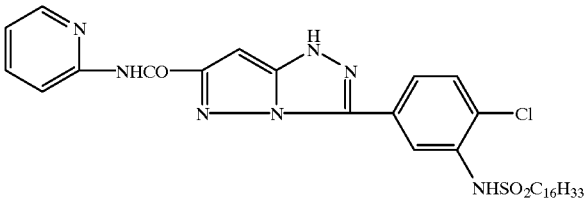
(B-53)
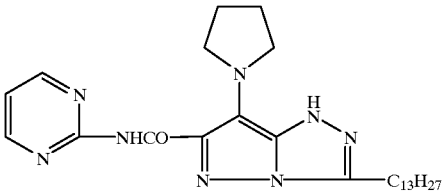

-continued
(B-54)
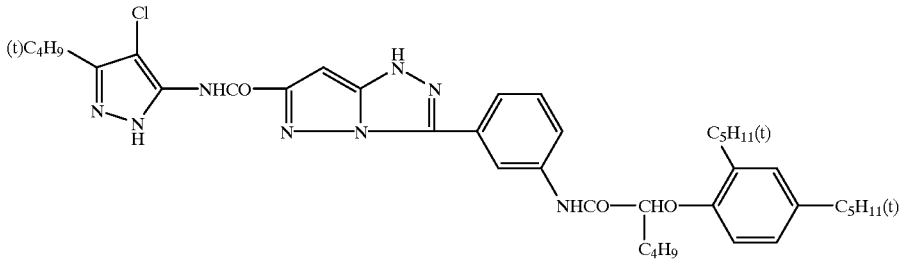
(B-55)
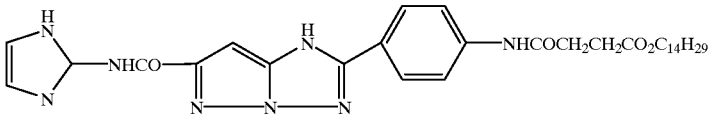
(B-56)
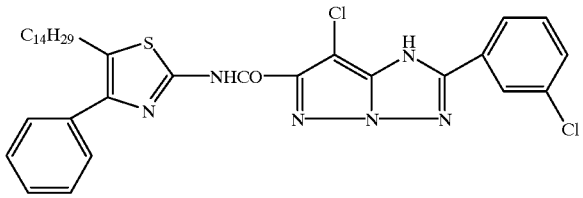
(B-57)
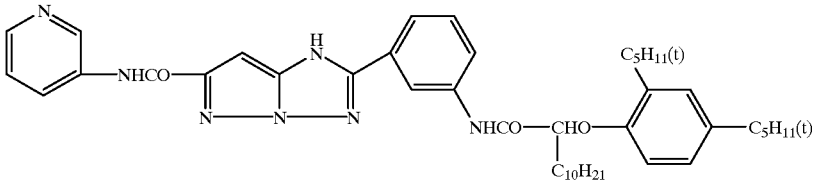
(B-58)
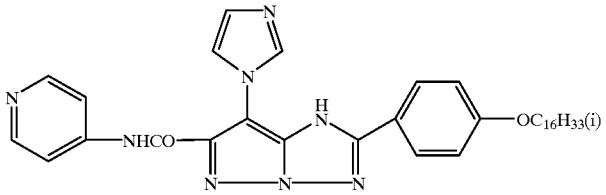
(B-59)
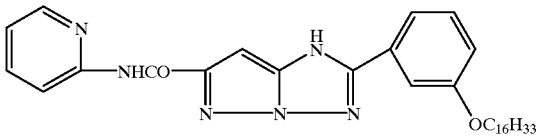
(B-60)
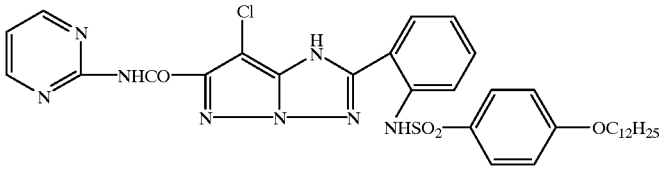
(B-61)
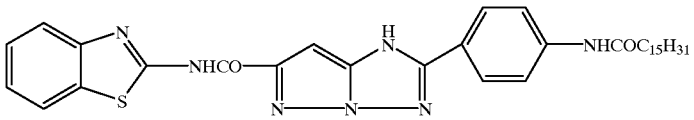

Cyan couplers represented by general formula (XI) incorporated in the silver halide light-sensitive color photographic material of the present invention are detailed below.

General formula (XI)

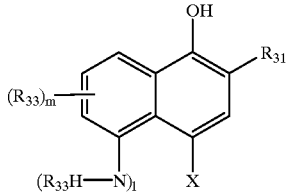

wherein $R_{31}$ represents —CON($R_{34}$)($R_{35}$), —NHCO$R_{34}$, —NHCOO$R_{36}$, —NHSO$_2$$R_{36}$, —NHCON($R_{34}$)($R_{35}$), —SO$_2$N($R_{34}$)($R_{35}$) or —NHSO$_2$N ($R_{34}$)($R_{35}$); $R_{32}$ represents a hydrogen atom or a substituent; $R_{33}$ represents a substituent; X represents a hydrogen atom or a coupling-off group upon reaction with the oxide of an aromatic primary amine developing agent; 1 represents 0 or 1; m represents an integer of 0 to 3; $R_{34}$ and $R_{35}$ each represents a hydrogen atom, an aromatic group, an aliphatic group or a heterocyclic group; $R_{36}$ represents an aromatic group, an aliphatic group or a heterocyclic group; when m is 2 or 3, each $R_{33}$ may be the same or different or may form a ring through linking with each other, and $R_{34}$ and $R_{35}$, $R_{32}$ and $R_{33}$, $R_{32}$ and X may combine with each other to form a ring. However, when l is 0, m is 0 and $R_{31}$ is —CONH$R_{37}$ in which $R_{37}$ represents an aromatic group. Each group represented by $R_{32}$ to $R_{37}$ includes a group having a substituent.

In the compounds represented by the above-mentioned general formula (XI), $R_{36}$ is preferably an aliphatic group having from 1 to 30 carbon atoms, an aromatic group having from 6 to 30 carbon atoms, and a heterocyclic group having from 1 to 30 carbon atoms; $R_{34}$ and $R_{35}$ each is preferably a hydrogen atom and those shown as preferred groups as $R_{36}$.

$R_{32}$ is preferably a hydrogen atom bonded directly to NH via CO or SO$_2$, an aliphatic group having from 1 to 30 carbon atoms, an aromatic group having from 6 to 30 carbon atoms, a heterocyclic group having from 1 to 30 carbon atoms, —O$R_{38}$, —CO$R_{38}$, —N[($R_{38}$)($R_{39}$)], —CON[($R_{38}$)($R_{39}$)], —SO$_2$N{($R_{38}$)($R_{39}$)}—SO$_2$$R_{40}$ ($R_{38}$, $R_{39}$, and $R_{40}$ each is the same as those defined in the above-mentioned $R_{34}$, $R_{35}$, and $R_{36}$, and $R_{38}$ and $R_{39}$ may link with each other to form a heterocyclic ring). The substituent represented by $R_{32}$ includes one having a substituent.

$R_{37}$ is preferably an aromatic group having from 6 to 30 carbon atoms and includes those having a substituent. The representative examples of the substituents include a halogen atom, a hydroxyl group, an amino group, a carboxyl group, a sulfo group, a cyano group, an aromatic group, a heterocyclic group, a carbonamido group, a sulfonamido group, a carbamoyl group, a sulfamoyl group, a ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoyl group, a nitro group, an imido group, an aliphatic group, an aliphatic oxycarbonyl group, etc. Vlhen substituted with a plurality of substituents, a plurality of the substituents may link with each other to form a ring. As the example, a dioxymethylene group, etc. can be illustrated.

Representative example of $R_{33}$ include a halogen atom, a hydroxyl group, an amino group, a carboxyl group, a sulfon group, a cyano group, an aromatic group, a heterocyclic group, a carbonamido group, a sulfonamido group, a carbamoyl group, a sulfamoyl group, an ureido group, an acyl group, an acyloxy group, an aliphatic oxy group, an aromatic oxy group, an aliphatic thio group, an aromatic thio group, an aliphatic sulfonyl group, an aromatic sulfonyl group, a sulfamoylamino group, a nitro group, an imido group, etc., and $R_{33}$ preferably comprises from 0 to 30 carbon atoms. When m=2, the example of the ring-shaped $R_{33}$ includes a dioxymethylene group, etc.

When l is 1, $R_{31}$ is particularly preferably —CON$R_{34}$$R_{35}$ and m is preferably 0; $R_{32}$ is preferably —CO$R_{38}$, —COO$R_{40}$, —SO$_2$$R_{40}$, —CON$R_{38}$$R_{39}$, —SO$_2$N$R_{38}$$R_{39}$ which directly link with NH, and further preferably —COO$R_{40}$, —CO$R_{38}$, —SO$_2$$R_{40}$ which directly link with NH and most preferable is —COO$R_{40}$.

Furthermore, general formula (XI) includes those forming a dimer or polymer via $R_{31}$ to $R_{33}$, X.

When l=m=0, X preferably comprises no development inhibition portion.

Specific examples of cyan couplers represented by general formula (XI) are described in Japanese Patent Publication Open to Public Inspection Nos. 60-237448, 61-153640, 61-145557, 62-85242, 48-15529, 50-117422, 52-18315, 52-90932, 53-52423, 54-48237, 54-66129, 55-32071, 55-65957, 55-105226, 56-1938, 56-12643, 56-27167, 56-126832, 58-95346, 62-123157, 62-123158, 63-93754, and 63-208042; Research Disclosure Item No. 29,015; U.S. Pat. No. 3,488,193, etc. and can be synthesized according to methods therein.

Specific examples of representative couplers represented by general formula (XI) are shown below.

C-1

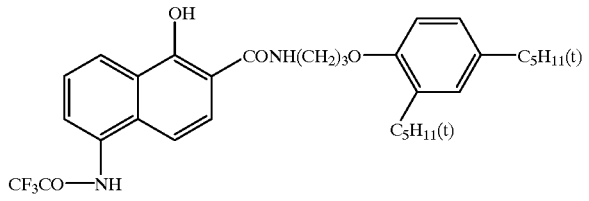

-continued
C-2
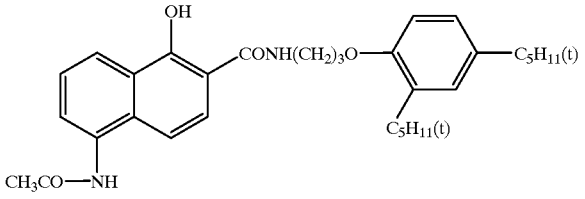
C-3
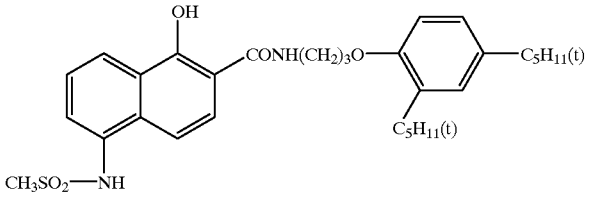
C-4
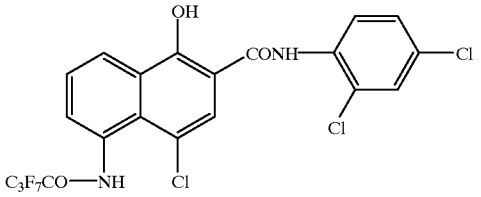
C-5
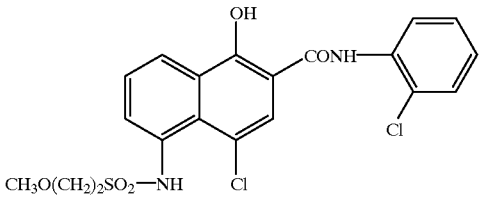
C-6
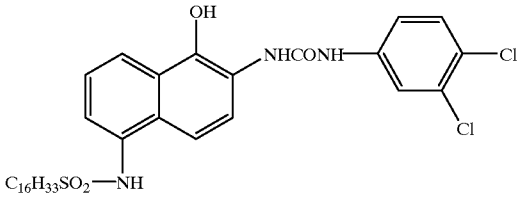
C-7
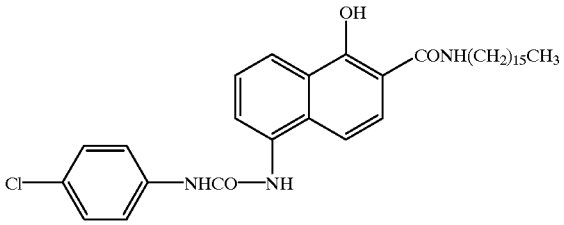
C-8
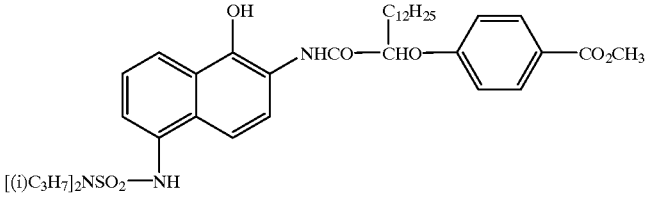

-continued
C-9
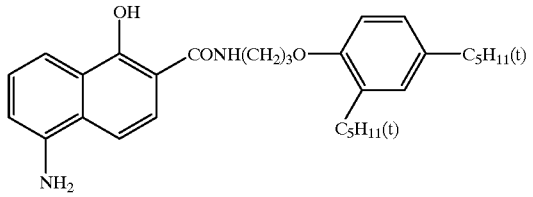
C-10
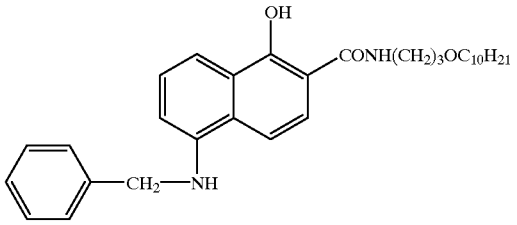
C-11
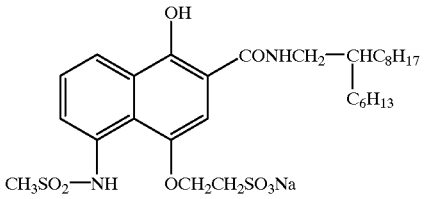
C-12
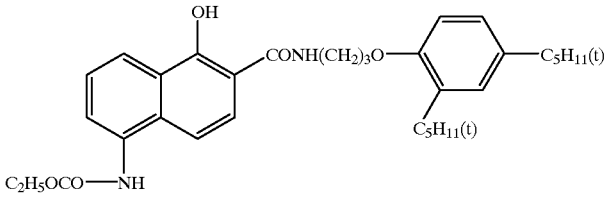
C-13
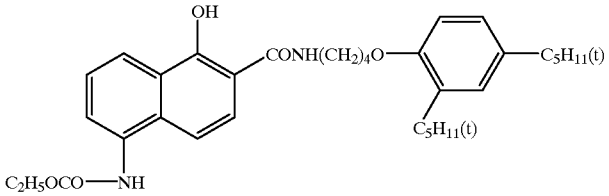
C-14
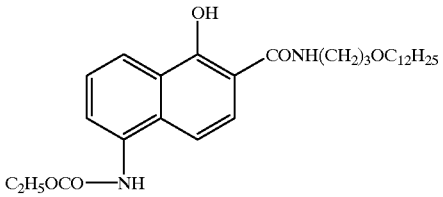
C-15
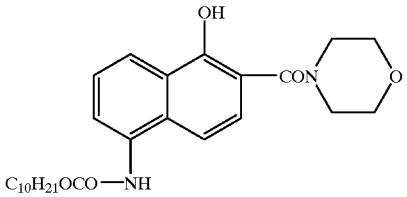

-continued
C-16
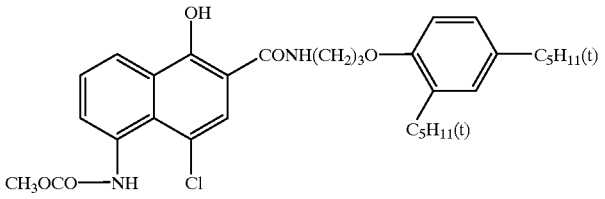
C-17
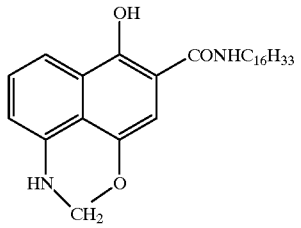
C-18
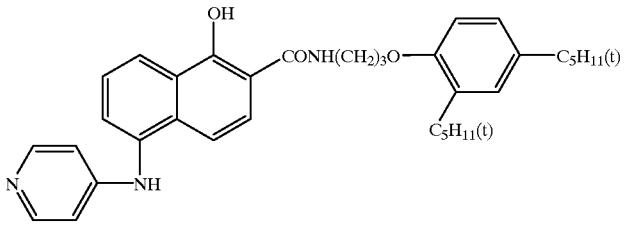
C-19
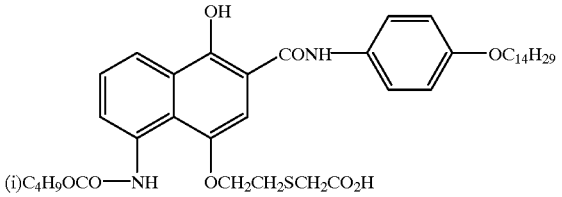
C-20
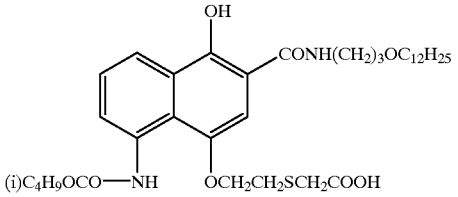
C-21
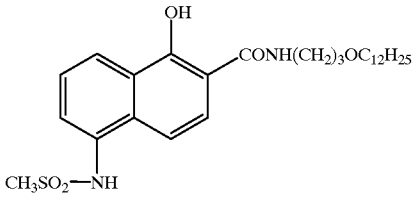
C-22
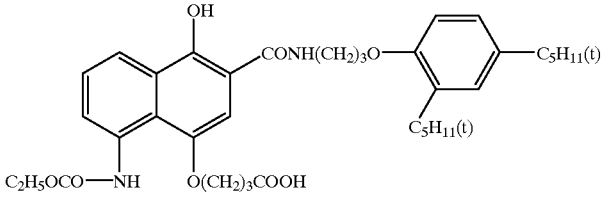

-continued
C-23
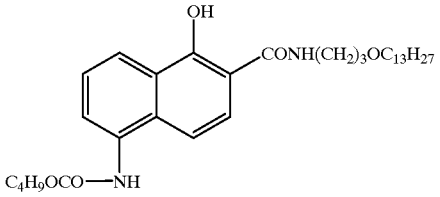
C-24
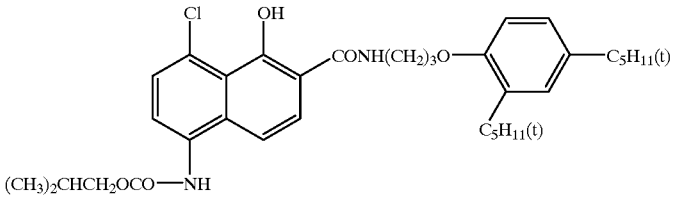
C-25
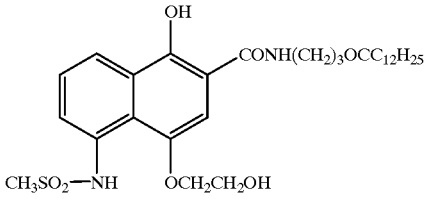
C-26
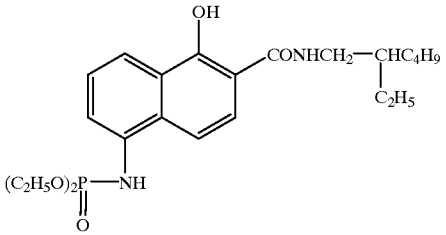
C-27
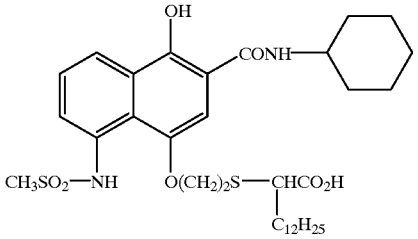
C-28
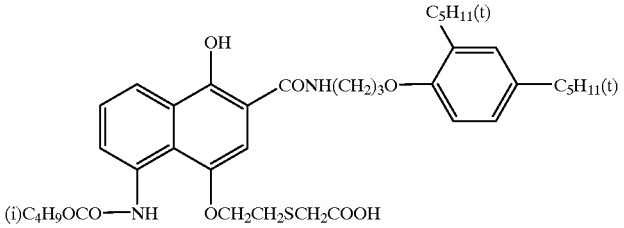

-continued
C-29
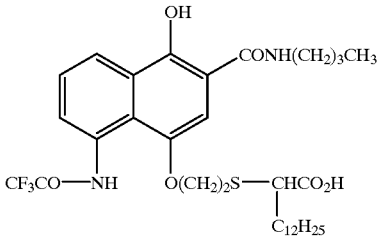
C-30
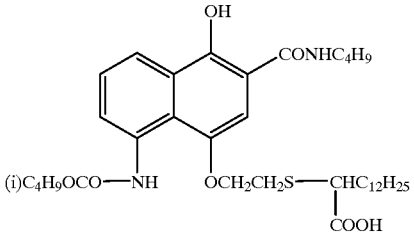
C-31
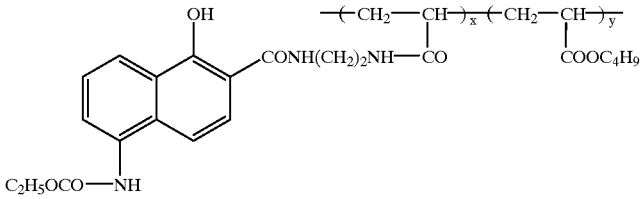
x:y = 60:40 (mole ratio)
C-32
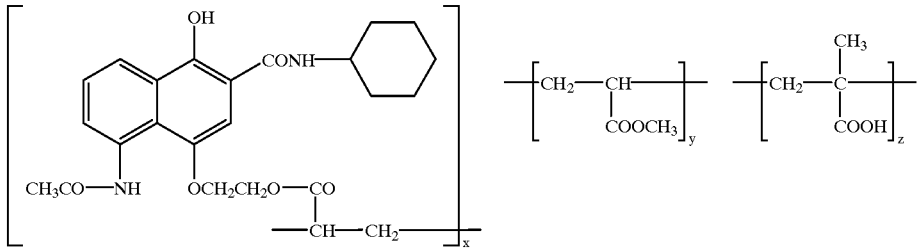
x:y:z = 5:4:1 (weight ratio)
C-33
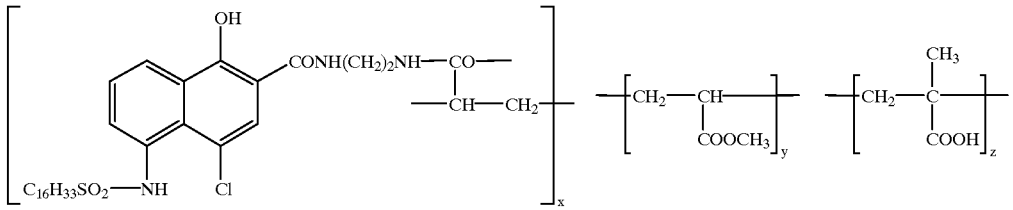
x:y:z = 67:26:7 (weight ratio)
C-34
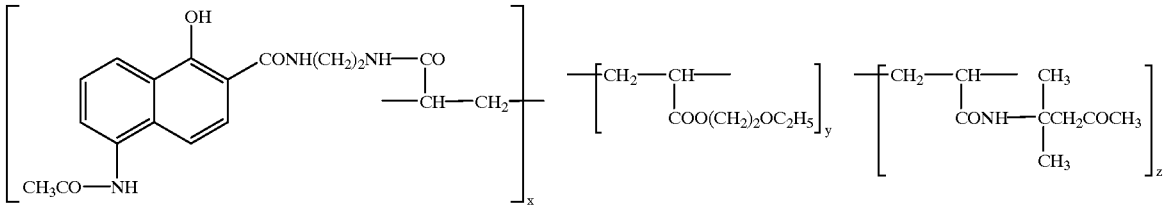
x:y:z = 2:1:1 (weight ratio)

-continued
C-35
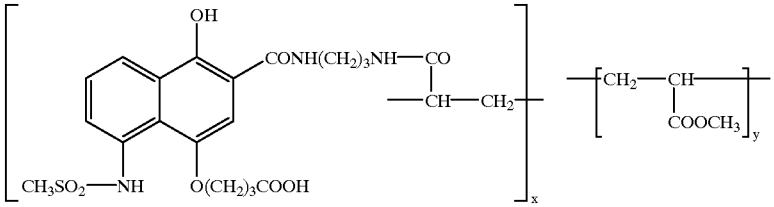
x:y = 1:4 (weight ratio)
C-36
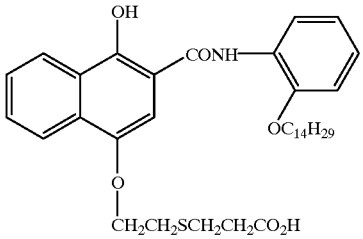
C-37
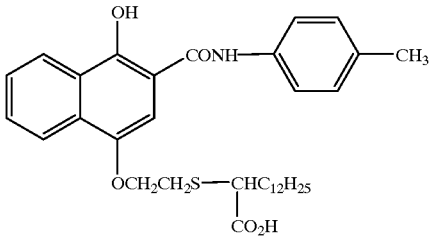
C-38
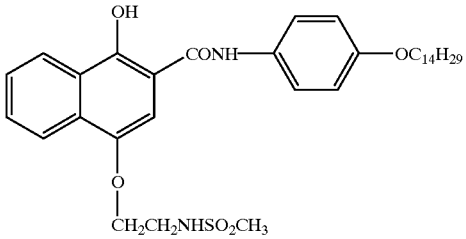
C-39
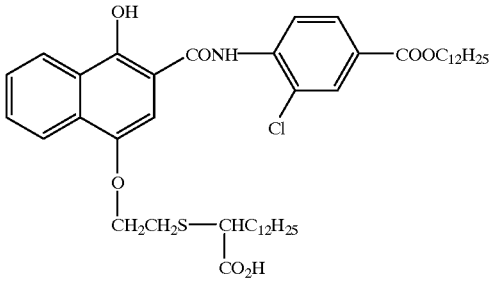
C-40
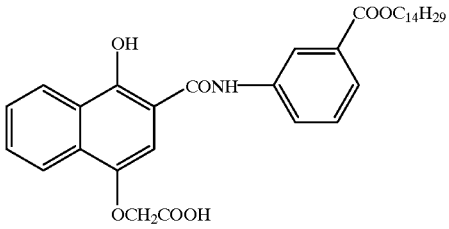

-continued
C-41
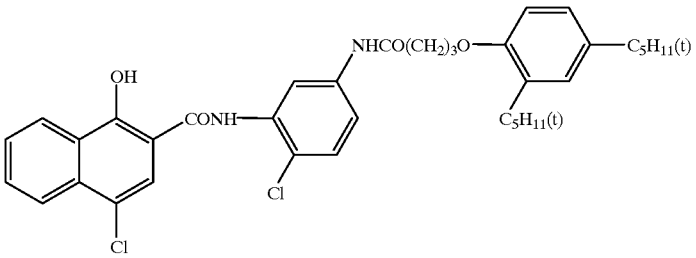
C-42
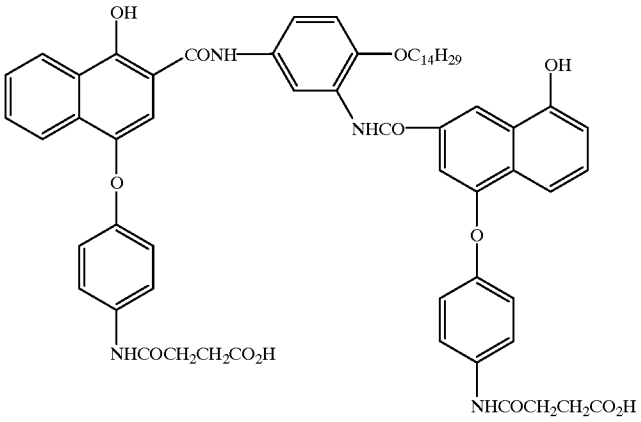
C-43
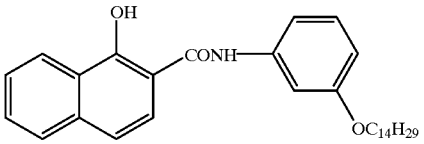
C-44
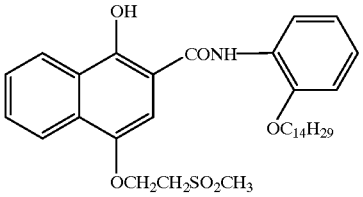
C-45
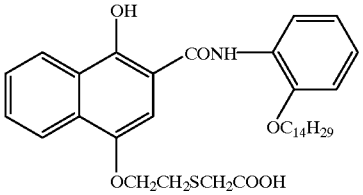
C-46
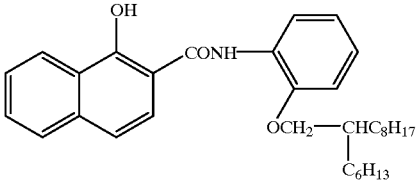

-continued
C-47
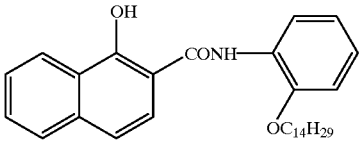
C-48
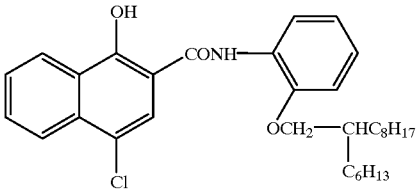
C-49
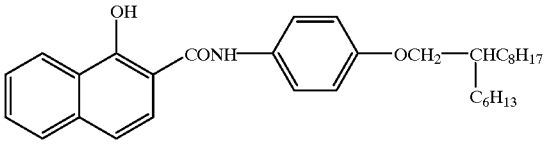
C-50
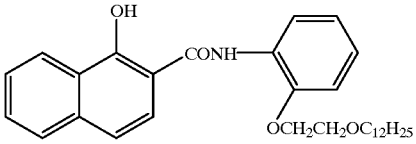
C-51
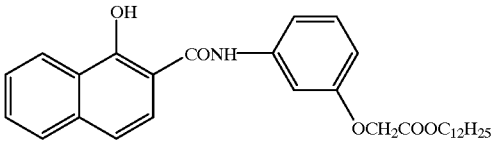
C-52
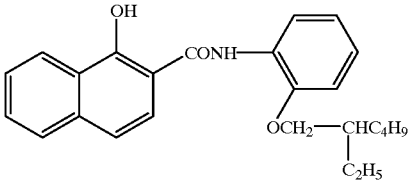
C-53
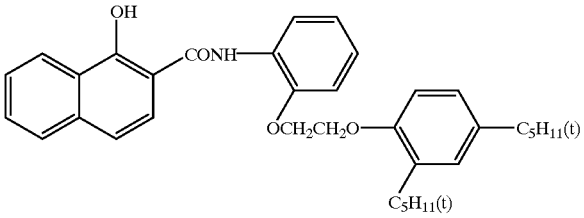
C-54
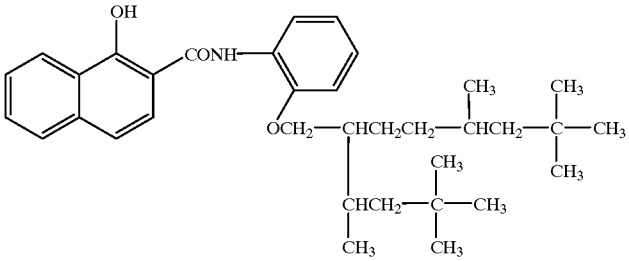

-continued
C-55
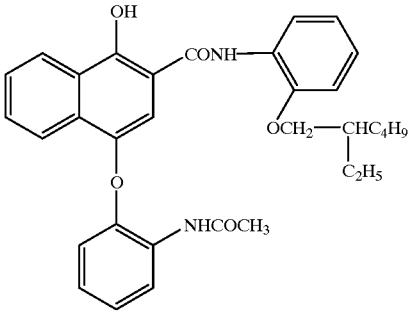
C-56
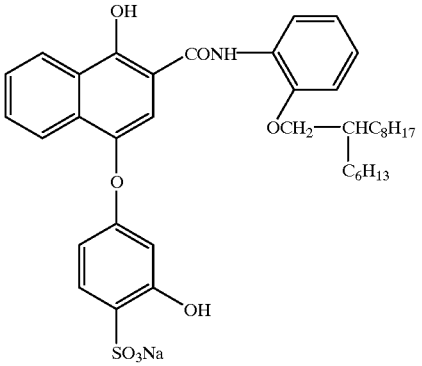
C-57
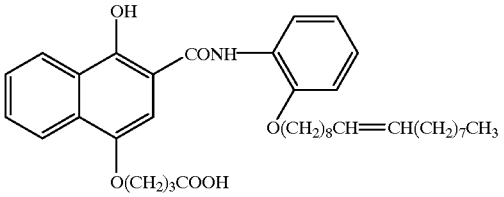
C-58
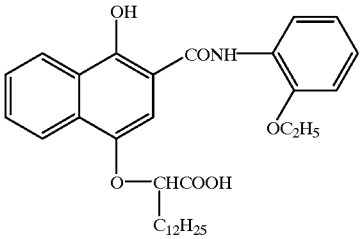
C-59
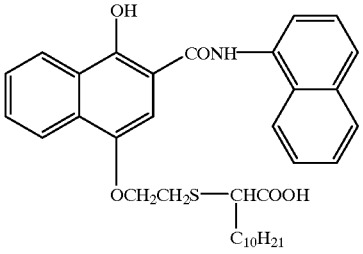

-continued
C-60
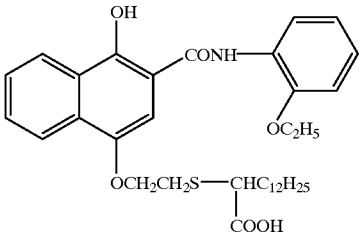
C-61
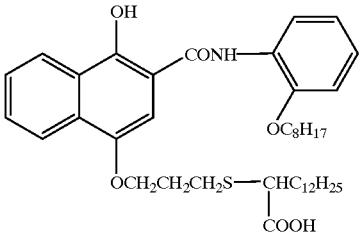
C-62
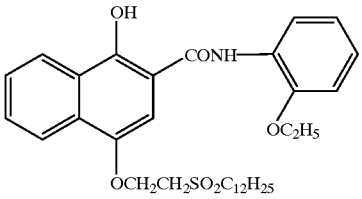
C-63
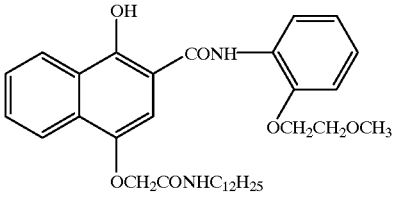
C-64
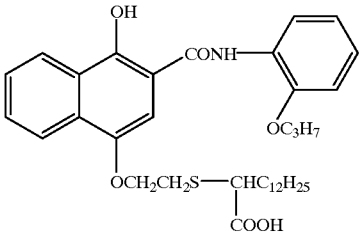
C-65
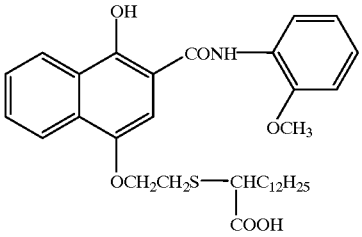

-continued
C-66
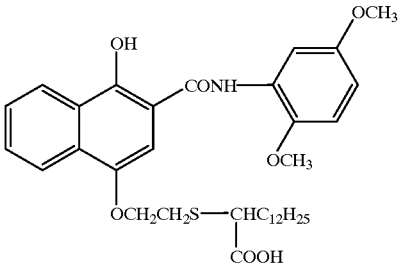
C-67
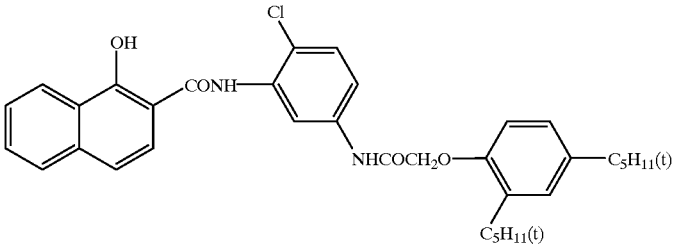
C-68
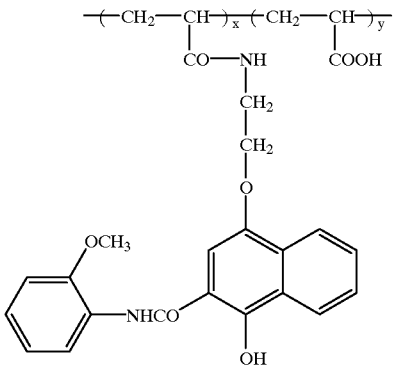
x:y = 50:50
(mole ratio)
C-69
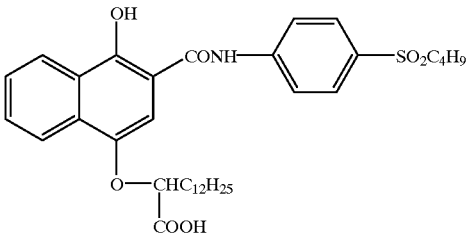
C-70
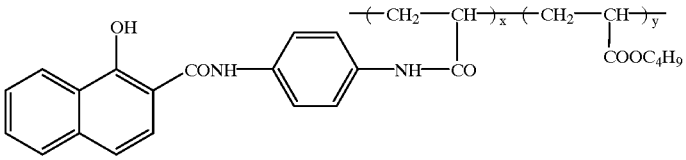
x:y = 50:50
(mole ratio)
C-71
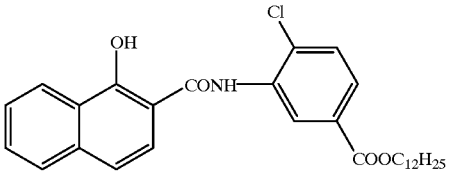

-continued

C-72

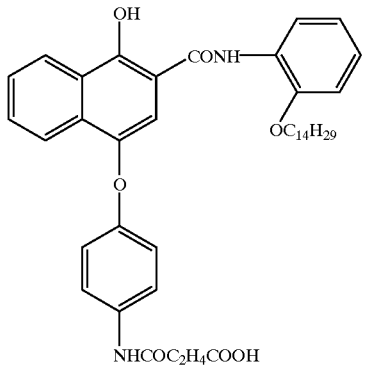

C-73

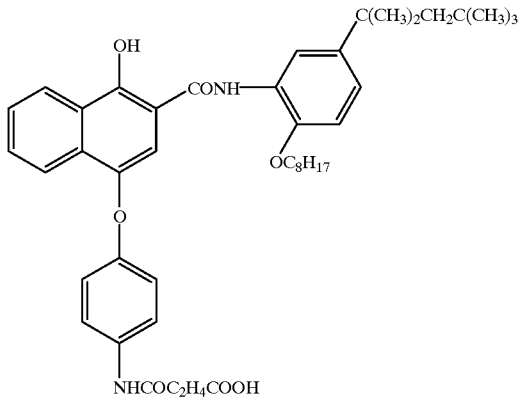

The liquid crystal compound and a coupler may be individually dispersed according to the above-mentioned dispersion method and may be added to a silver halide emulsion. However, a method is preferably employed in which both compounds are dissolved and dispersed at the same time and then added to the emulsion.

The added amount of the liquid crystal compound of the present invention is preferably in the range of 0.01 to 20 g per g of the coupler and more preferably, in the range of 0.5 to 8.0 g per g of the coupler, and these compounds may be employed in combination of 2 or more.

The added amount of the magenta coupler represented by general formula (M-1) is preferably in the range of $1\times10^{-3}$ to 10 moles/$m^2$ per mole of silver halide and more preferably, in the range of $1\times10^{-2}$ to 1 mole/$m^2$ per mole of silver halide.

As a silver halide emulsion employed for the light-sensitive material of the present invention, any of ordinary silver halide emulsions may be employed. The emulsion can be chemically sensitized according to an ordinary method and can be optically sensitized to the predetermined long wavelength region employing a sensitizing dye.

To the silver halide emulsion, antifoggants, stabilizers, etc. may be added. As a binder for the above-mentioned emulsion, gelatin is advantageously employed.

An emulsion layer and other hydrophilic colloid layers may be hardened and may comprise plasticizers, synthetic polymer dispersion (latex) which is insoluble or barely soluble in water. In the emulsion layer of a light-sensitive color photographic material, couplers are employed.

Further, there may be employed colored couplers having a color correction effect, competing couplers, and compounds which is coupled off, on coupling with oxidized developing agent, photographically effective fragments such as a development accelerator, a bleach accelerator, a developing agent, a silver halide dissolving agent, a toning agent, a hardening agent, a fogging agent, an antifoggant, a chemical sensitizer, a spectral sensitizer, and a desensitizer.

In light-sensitive materials, there can be provided auxiliary layers such as a filter layer, an antihalation layer, an antirradiation layer, and the like. In these layers and/or in emulsion layers, there may be incorporated dyes which are flown out from the light-sensitive material during the development process or are bleached. To light-sensitive materials, may be added formalin scavengers, optical brightening agents, matting agents, lubricants, image stabilizing agents, surface active agents, color fog inhibitors, development accelerators, development retarders, bleach accelerators.

Employed a support, may be paper laminated with polyethylene, etc., polyethylene terephthalate film, baryta paper, cellulose triacetate film, etc.

In order to obtain a dye image employing the light-sensitive material of the present invention, the material is a exposed and then processed employing a color photographic processing commonly known in the art.

As silver halide grains incorporated in a silver halide emulsion layer, there is available any of several grains of silver halide such as silver chloride, silver bromide, silver iodide, silver chlorobromide, silver iodobromide, silver chloroiodobromide, etc. which are commonly employed in this industry.

The composition of the silver halide grains may be uniform from the interior of the grain to the surface or there may be a difference between the interior and the surface. Ve-n the composition of the interior is different from the surface, the composition may vary continuously or discontinuously.

As for the grain diameter of the silver halide grains, with consideration of photographic properties such as rapid processing, sensitivity, etc., the diameter is preferably in the range of 0.2 to 1.6 μm and more preferably in the range of 0.25 to 1.2 μm. Further, the above-mentioned diameter can be measured employing various methods which are generally used in this technical field. The representative methods are described in Rapland, "Ryushikei Bunsekiho" ("Analytical Methods of Grain Diameter"), A.S.T.M. Symposium on Light Microscopy, pages 94 to 122, 1955; or Mees and James, "The Theory of Photographic Process", Third Edition, Chapter 2, MacMillan, 1966.

This diameter can be measured employing the projection area of a grain or a approximate diameter value.

The grain diameter distribution of silver halide grains may be of multidisperse or monodisperse grains. In the grain diameter distribution of the silver halide grains, is preferred monodisperse silver halide grains exhibiting preferably a variation coefficient of 0.22 or less and more preferably 0.15 or less. Further, the variation coefficient is calculated as mentioned below.

Variation coefficient=standard deviation of grain diameter distribution/average grain diameter The silver halide grains may be prepared employing any of several methods such as an acid method, a neutral method, or an ammonia method. The grains may be allowed to grow at one time or grow after preparing seed grains. The seed preparing method and the grain growing method may be the same or different.

Furthermore, as types of water-soluble silver salts to react with water-soluble halide salts, any of a normal mixing method, a reverse mixing method, a double-jet mixing method, and combinations t hereof may be employed. However, that prepared employing the double-jet mixing method is preferred. Further, as one type of double-jet mixing method, a pAg-controlled double-jet method can be emoloyed which is described in Japanese Patent Publication Open to Public Inspection No. 54-48521, among others.

Further, silver halide solvents such as thioether, etc. mnay be added, if desired. in addition, mercapto group-containing compounds, nitrogen-containing heterocyclic compounds, or sensitizing dye-like compounds may be added during formation of silver halide grains or after the formation of the grains.

Various shapes of silver halide grain may be optionally employed. one of the preferred examples is a cube having a (100) plane as the crystal surface.

Furthermore, grains having an octahedron, tetradecahedron, or dodecahedron shape, etc. may be employed. In addition, grains having twinned planes may also be employed.

Silver halide grains may be employed which consist of single-shaped grains or variously shaped-grains.

During the grain-forming process and/or the grain-growing process, metal ions are added to silver halide grains employing cadmium salts, zinc salts, lead salts, thallium salts, iridium salts (including their complexes), rhodium salts (including complexes), or iron salts (including their complexes), so that ions can be incorporated in the interior of the grain and/or on the surface of the grain. Furthermore, by placing grains in a reducing environment, reduction sensitization nuclei may be formed in the interior of the grain and/or on the surface of the grain.

The emulsion comprising silver halide grains may be subjected to removal or retention of unnecessary water-soluble salts after completing the growth of silver halide grains. The salts can be removed employing methods described in Research Disclosure Item No. 17643.

The silver halide grains employed in the present invention are preferably subjected to formation of a latent image on the grain surface. However, grains may be acceptable which are subjected to formation of a latent image in the interior of the grain.

In the present invention, chalcogen sensitizers can be employed. Chalcogen sensitizer is a general term for sulfur sensitizers, selenium sensitizers, and tellurium sensitizers. Of these, the sulfur sensitizers and selenium sensitizers are preferred. The sulfur sensitizers include, for example, thiosulfate salts, allylthiocarbazide, thiourea, allylisocyanate, cystine, p-toluenethiosoufonate salts, rhodanine, etc. In addition to these, employed can be sulfur sensitizers described in U.S. Pat. Nos. 1,574,944, 2,410,689, 2,27.8, 947, 2,728,668, 3,501,313, 3,656,955; West German Patent Publication (OLS) No. 1,422,869; Japanese Patent Publication Open to Public Inspection Nos. 56-24937, 55-45015, etc. The added amount of the sulfur sensitizer varies to a fairly large extent depending on various conditions such as pH, temperature, sliver halide grain size, etc., and as a rule of thumb, is preferably between $10^{-7}$ and $10^{-1}$ mole per mole of silver halide.

The silver halide emulsion may in practice be subjected to combination of a reduction sensitization method and noble metal sensitization employing noble metal compounds.

The light-sensitive material may comprise water-soluble dyes in the hydrophilic colloid layer as filter dyes or for various other purposes, such as antirradiation.

The light-sensitive material may comprise various other additives. For example, employed may be; antifoggants, development accelerators, development retarders, bleach accelerators, stabilizers, UV absorbers, color antistaining agents, optical brightening agents, color image fading inhibition agents, antistatic agents, hardening agents, surface active agents, plasticizers, wetting agents, etc. (In regard to these, Research Disclosure Item No. 17643 may be employed as a reference.)

Furthermore, there may be employed competing couplers, and compounds which release, on coupling with oxidized developing agent, photographically effective fragments such as a development accelerator, a bleach accelerator, a developing agent, a silver halide dissolving agent, a toning agent, a hardening agent, a fogging agent, an antifoggant, a chemical sensitizer, a spectral sensitizer, and a desensitizer.

Supports of the present invention include, for example, baryta paper, polyethylene-coated paper, polypropylene synthetic paper, glass plates, cellulose acetate film, cellulose nitrate film, polyester film such as polyethylene terephthalate film, polyamide film, polycarbonate film, polystyrene film, etc. In the case of transparent supports, a reflection layer may be employed together. These supports are suitably selected in accordance with specific purposes of a light-sensitive material.

For coating emulsion layers and other composition layers, employed can be various coating methods such as dipping coating, air doctor coating, curtain coating, hopper coating, etc. Furthermore, a simultaneous two or more-layer coating method can be employed which is described in U.S. Pat. Nos. 2,781,791 and 2,941,898.

The coating position of each emulsion layer can be optional. However, it is preferred to arrange, from the support side, successively a blue-sensitive emulsion layer, a green-sensitive emulsion layer, and a red-sensitive emulsion layer.

In the light-sensitive material, interlayers having a suitable thickness are optionally provided in accordance with specific purposes. Furthermore, various layers such as a filter layer, a curl control layer, a protective layer, an antihalation layer, etc. are appropriately combined as a composition layer and employed.

These composition layers can comprise hydrophilic colloid as a binder and gelatin is preferably employed. Furthermore, in the layer, various photographic additives described in the above-mentioned emulsion layer can be incorporated.

The light-sensitive material is processed in usual way. For example, as the representative method, there are methods in which after color development, bleach-fixing processing is carried out and further, washing and/or stabilizing is carried out, if desired, and after color development, bleach and fixing are carried out individually, and wash and/or stabilizing is carried out, if desired. Though either method may be employed for processing, the color light-sensitive material of the present invention is suitable for rapid processing composed of the subsequential steps of color development, bleach-fixing, washing (or stabilizing).

EXAMPLE

The present invention is detailed in reference to Examples below.

Example 1

Multilayer silver halide light-sensitive color photographic material 101 was prepared by coating each layer having compositions, shown in Table 1 and Table 2 below, on the titanium oxide-containing polyethylene layer side of a paper support laminated with polyethylene on one side and titanium oxide-containing polyethylene on the opposite side. The coating compositions were prepared as mentioned below.

1st Coating Composition

To a mixture consisting of 26.7 g of yellow coupler (Y-1), 190.0 g of dye image stabilizing agent (ST-1), 6.67 g of dye image stabilizing agent (ST-2), 0.67 g of antistaining agent (HQ-1), and 6.67 g of high-boiling point organic solvent (DNP), 60 ml of ethyl acetate was added and dissolved. The resultant solution was emulsify-dispersed in 220 ml of a 10% aqueous gelatin solution containing 7 ml of a 20% surface active agent (SU-2) solution, and thus a yellow coupler dispersion was prepared.

This resultant dispersion was mixed with a blue-sensitive silver halide emulsion (comprising 8.67 g of silver), and further added with antirradiation dye (AI-3) to prepare the first layer coating composition.

Coating compositions for a second layer to a seventh layer were prepared in the same manner as for the first laver coating composition as described above. Furthermore, hardening agent (H-1) was added to the second layer and fourth layer coating compositions, and (H-2) was added to the seventh layer coating composition. Surface tension was adjusted by the addition of surface active agents (SU-1) and (SU-3) as coating aids. F-1 was added as an antiseptic.

TABLE 1

| Layer | Compositions | Added Amount ($g/m^2$) |
|---|---|---|
| 7th Layer (Protective Layer) | Gelatin | 1.00 |
| 6th Layer (UV Absorbing | Gelatin | 0.40 |
| | UV absorbing agent (UV-1) | 0.10 |
| | UV absorbing agent (UV-2) | 0.04 |

TABLE 1-continued

| Layer | Compositions | Added Amount ($g/m^2$) |
|---|---|---|
| Layer) | UV absorbing agent (UV-3) | 0.16 |
| | Antistaining agent (HQ-1) | 0.01 |
| | DNP | 0.20 |
| | PVP | 0.03 |
| | Antirradiation dye (AI-2) | 0.02 |
| 5th Layer | Gelatin | 1.30 |
| (Red- | Red-sensitive chlorobromide emulsion | 0.21 |
| sensitive | (Em-R) | |
| Layer) | Cyan coupler (C-101) | 0.24 |
| | Cyan coupler (C-102) | 0.08 |
| | Dye image stabilizing agent (ST-1) | 0.20 |
| | Antistaining agent (HQ-1) | 0.01 |
| | HBS-1A | 0.20 |
| | DOP | 0.20 |
| 4th Layer | Gelatin | 0.94 |
| (UV | UV absorbing agent (UV-1) | 0.28 |
| Absorbing | UV absorbing agent (UV-2) | 0.09 |
| Layer) | UV absorbing agent (UV-3) | 0.38 |
| | Antistaining agent (HQ-1) | 0.03 |
| | DNP | 0.40 |

TABLE 2

| Layer | Compositions | Added Amount ($g/m^2$) |
|---|---|---|
| 3rd Layer | Gelatin | 1.40 |
| (Green- | Green-sensitive chlorobromide | 0.17 |
| sensitive | emulsion (Em-G) | |
| Layer) | Magenta coupler (M-3) | 0.75* |
| | DNP | 0.20 |
| | Antirradiation dye (AIM-1) | 0.01 |
| 2nd Layer | Gelatin | 1.20 |
| (Inter- | Antistaining agent (HQ-2) | 0.03 |
| layer) | Antistaining agent (HQ-3) | 0.03 |
| | Antistaining agent (HQ-4) | 0.05 |
| | Antistaining agent (HQ-5) | 0.23 |
| | DIDP | 0.06 |
| | Antiseptic (F-1) | 0.002 |
| 1st Layer | Gelatin | 1.20 |
| (Blue- | Blue-sensitive chlorobromide | 0.26 |
| sensitive) | emulsion (Em-B) | |
| Layer) | Yellow coupler (Y-1) | 0.80 |
| | Dye image stabilizing agent (ST-1) | 0.30 |
| | Dye image stabilizing agent (ST-2) | 0.20 |
| | Antistaining agent (HQ-1) | 0.02 |
| | Antirradation dye (AI-3) | 0.01 |
| | DNP | 0.20 |
| Support | Polyethylene-laminated paper | |

*millimole/$m^2$

Added amount of silver halide emulsion is shown in terms of silver.

Structural formulas of the compounds employed in each above-mentioned layer are shown below.

Y-1
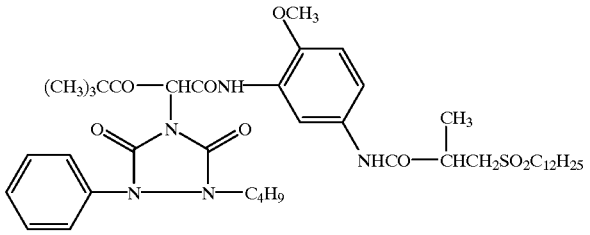
C-101
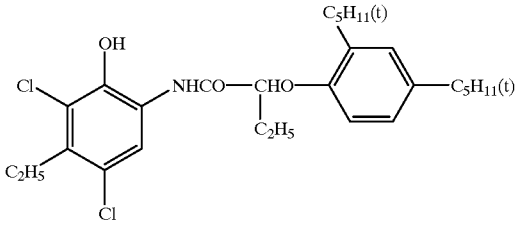
C-102
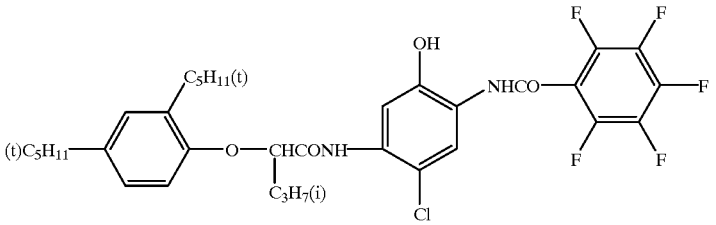
ST-1
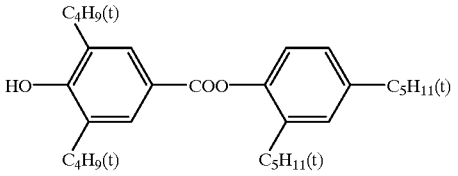
ST-2
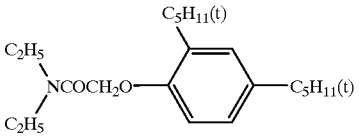
UV-1
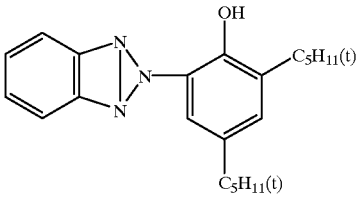
UV-2
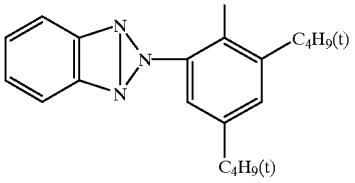

-continued
UV-3
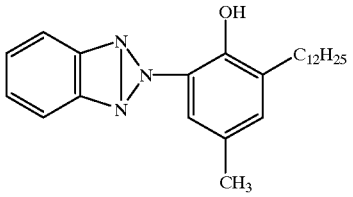
DOP Dioctyl phthalate
DNP Dinonyl phthalate
DIDP Diisodecyl phthalate
PVP Polyvinylpyrrolidone
HQ-1
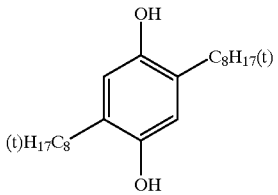
HQ-2
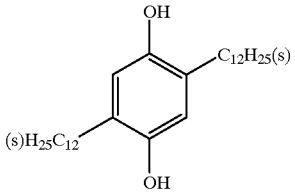
HQ-3
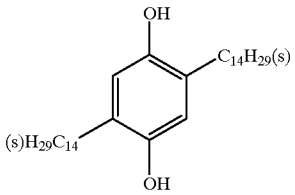
HQ-4
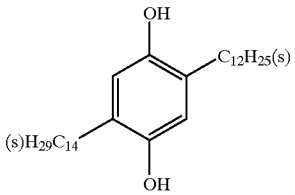
HQ-5
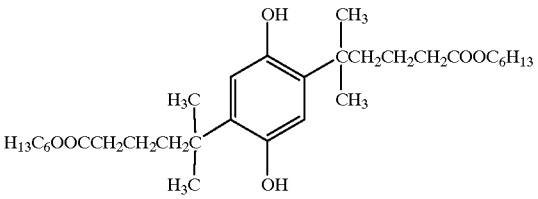
HBS-1A
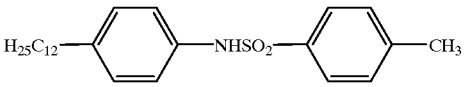

-continued
AIM-1
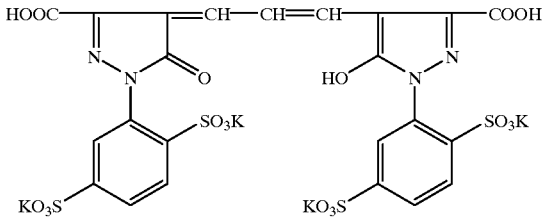
AI-2
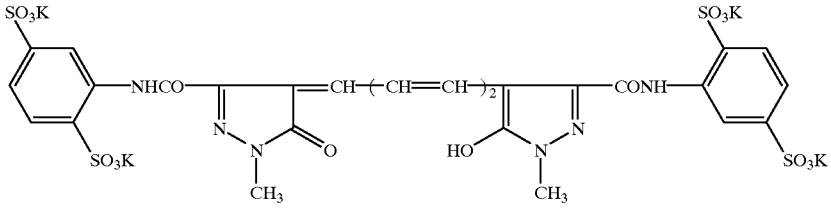
AI-3
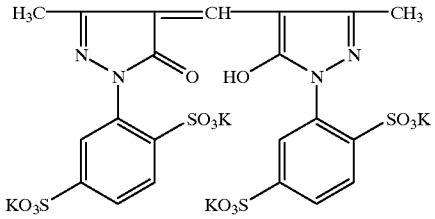
SU-1
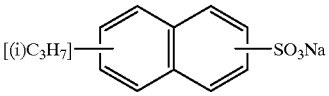
SU-2
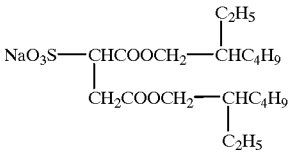
SU-3
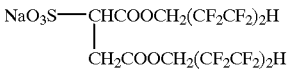
H-1
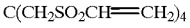
H-2
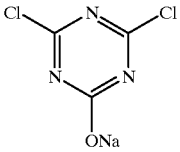
F-1
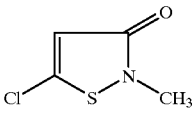
Blue-sensitive Silver Halide Emulsion (Em-B)
Monodispersed cubic grain emulsion having an average grain diameter of 0.85 $\mu$m, a variation coefficient of 0.07 and a silver chloride containing ratio of 99.5 mole percent
| | |
|---|---|
| Sodium thiosulfate | 0.8 mg/mole of AgX |
| Chloroauric acid | 0.5 mg/mole of AgX |
| Stabilizer STAB-1 | $6 \times 10^{-4}$ mole/mole of AgX |

-continued

| | |
|---|---|
| Sensitizing dye BS-1 | $4 \times 10^{-4}$ mole/mole of Agx |
| Sensitizing dye BS-2 | $1 \times 10^{-4}$ mole/mole of AgX |

Green-sensitive Silver Halide Emulsion (Em-G)

Monodispersed cubic grain emulsion having an average grain diameter of 0.43 μm, a variation coefficient of 0.08 and a silver chloride content ratio of 99.5 mole percent

| | |
|---|---|
| Sodium thiosulfate | 1.8 mg/mole of AgX |
| Chloroauric acid | 2.0 mg/mole of AgX |
| Stabilizer STAB-1 | $6 \times 10^{-4}$ mole/mole of AgX |
| Sensitizing dye RS-1 | $1 \times 10^{-4}$ mole/mole of AgX |

Structural formulas of the compounds employed in each monodisperse cubic grain emulsion are shown below.

BS-1

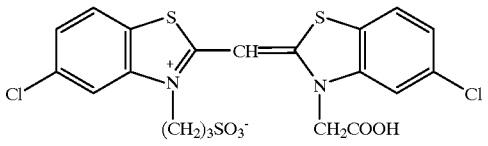

BS-2

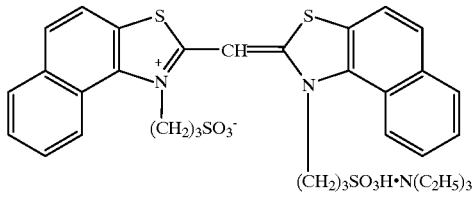

GS-1

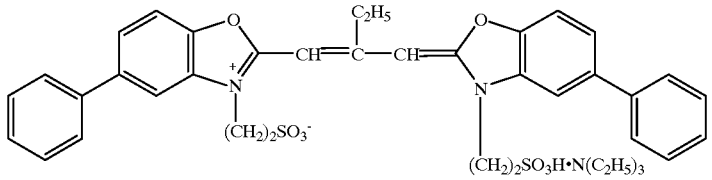

RS-1

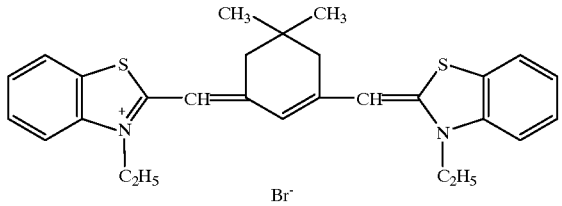

STAB-1

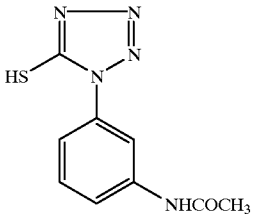

| | |
|---|---|
| Sodium thiosulfate | 1.5 mg/mole of AgX |
| Chloroauric acid | 1.0 mg/mole of AgX |
| Stabilizer STAB-1 | $6 \times 10^{-4}$ mole/mole of AgX |
| Sensitizing dye GS-1 | $4 \times 10^{-4}$ mole/mole of AgX |

Red-sensitive Silver Halide Emulsion (Em-R)

Monodispersed cubic grain emulsion having an average grain diameter of 0.50 μm, a variation coefficient of 0.08 and a silver chloride containing ratio of 99.5 mole percent Samples 102 to 120 and 121 to 131 were prepared by replacing high-boiling point organic solvent DNP in the third layer of sample 101 with comparative high-boiling point organic solvents shown in Table 3 below and liquid crystal compounds of the present invention.

Samples prepared as mentioned above were subjected to wedge exposure using green lignt according to a common method and were subjected to processing according to the processing steps listed below.

| Processing Step | Temperature | Time |
|---|---|---|
| Color development | 35.0 ± 0.3° C. | 45 seconds |
| Bleach-fixing | 35.0 ± 0.5° C. | 45 seconds |
| Stabilizing | 30 to 34° C. | 90 seconds |
| Drying | 60 to 80° C. | 60 seconds |

Composition of each processing liquids is shown below.

| Color Developer | Tank Solution | Replenisher |
|---|---|---|
| Deionized water | 800 ml | 800 ml |
| Triethanolamine | 10 g | 18 g |
| N,N-diethylhydroxylamine | 5 g | 9 g |
| Potassium chloride | 2.4 g | |
| 1-Hydroxyethylidene-1,-disulfonic acid | 1.0 g | 1.8 g |
| N-ethyl-N-β-methane-sulfonamidoethyl-3-methyl-4-aminoaniline sulfonic acid salt | 5.4 g | 8.2 g |
| Optical Brightening agent (4,4'-diaminostylbene-sulfonic acid derivative) | 1.0 g | 1.8 g |
| Potassium carbonate | 27.0 g | 27.0 g |
| Water to make | 1000 ml | 1000 ml |
| pH | adjusted to 10.10 | 10.60 |

Bleach-fixing Solution (Tank solution and replenisher are the same)

| | |
|---|---|
| Ethylenediaminetetraacetic acid ferric ammonium dihydride | 60.0 g |
| Ethylenediaminetetraacetic acid | 3.0 g |
| Ammonium thiosulfate (70% aqueous solution) | 100 ml |
| Ammonium sulfite (40% aqueous solution) | 27.5 ml |
| Water to make | 1,000 ml |

pH is adjusted to 5.7 employing sodium carbonate or glacial acetic acid.

Stabilizing Solution (Tank solution and replenisher are the same)

| | |
|---|---|
| 5-Chloro-2-methyl-4-isothiazoline-3-on | 1.0 g |
| Ethylene glycol | 1.0 g |
| 1-Hydroxyethylidene-1,1-disulfonic acid | 2.0 g |
| Ethylenediaminetetraacetic acid | 1.0 g |
| Ammonium hydroxide (20% aqueous solution) | 3.0 g |
| Optical brightening agent (4,4'-diaminostylbenesulfonic acid derivative) | 1.5 g |
| Water to make | 1,000 ml |

pH is adjusted to 7.0 employing sulfuric acid or potassium hydroxide.

The following evaluation was carried out employing Samples subjected to continuos processing.

(Light Fastness)

The prepared Sample was subjected to exposure for 10 days employing a Xenon Fademeter and the residual ratio (%) of a dye image was obtained, at an initial density of 1.0.

$D_{max}$ represents maximum formed dye density.

Table 3 shows the results.

TABLE 3

| Sample No. | Third Layer HBS | Added Amount of HBS (g/m$^2$) | $D_{max}$ | Light Fastness (residual ratio %) |
|---|---|---|---|---|
| 101 | DNP | 0.20 | 1.95 | 49 |
| 102 | HBS-1 | 0.20 | 2.01 | 53 |
| 103 | HBS-2 | 0.20 | 1.98 | 51 |
| 104 | L-7 | 0.20 | 2.28 | 61 |
| 105 | L-15 | 0.20 | 2.28 | 60 |
| 106 | L-23 | 0.20 | 2.25 | 62 |
| 107 | DNP | 0.60 | 1.91 | 52 |
| 108 | HBS-1 | 0.60 | 2.05 | 55 |
| 109 | HBS-2 | 0.60 | 2.04 | 55 |
| 110 | L-7 | 0.60 | 2.29 | 68 |
| 111 | L-15 | 0.60 | 2.31 | 68 |
| 112 | L-23 | 0.60 | 2.28 | 69 |
| 113 | L-45 | 0.60 | 2.24 | 67 |
| 114 | L-47 | 0.60 | 2.25 | 66 |
| 115 | L-52 | 0.60 | 2.25 | 68 |
| 116 | L-58 | 0.60 | 2.28 | 69 |
| 117 | L-60 | 0.60 | 2.27 | 67 |
| 118 | L-64 | 0.60 | 2.20 | 61 |
| 119 | L-76 | 0.60 | 2.14 | 60 |
| 120 | L-77 | 0.60 | 2.15 | 62 |
| 121 | PL-1 | 0.60 | 2.32 | 67 |
| 122 | PL-3 | 0.60 | 2.28 | 68 |
| 123 | PL-9 | 0.60 | 2.27 | 68 |
| 124 | PL-11 | 0.60 | 2.28 | 66 |
| 125 | PL-19 | 0.60 | 2.29 | 67 |
| 126 | PL-23 | 0.60 | 2.28 | 66 |
| 127 | PL-35 | 0.60 | 2.25 | 67 |
| 128 | PL-44 | 0.60 | 2.22 | 67 |
| 129 | PL-26 | 0.60 | 2.18 | 61 |
| 130 | PL-38 | 0.60 | 2.19 | 60 |
| 131 | PL-43 | 0.60 | 2.18 | 63 |

Comparative HBS

HBS-1

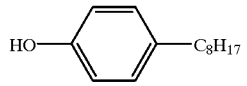

HBS-2

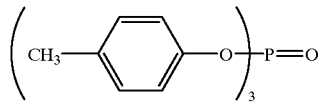

As can be clearly seen from Table 3, Samples 104 to 106, in which the liquid crystal compound of the present invention is employed as a high-boiling point organic solvent (HBS), exhibit remarkable improvement in light fastness and improvement in dye-forming efficiency. In Comparative Samples 102 and 103 in which HBS-1 and HBS-2 are employed exhibit some improvement in light fastness and dye-forming efficiency. However, the improvement is not sufficient.

Samples 107 to 109, in which the high-boiling point organic solvent is added to be three times as much, exhibit almost no improvement in light fastness. On the other hand, it is found that Samples 110 to 120 and 121 to 131 which the liquid crystal compound is added to be three times as much, exhibit remarkable improvement in light fastness due to effective performance of the liquid crystal compounds in the system.

Example 2

Samples 201 to 206 were prepared in the same manner as en Example 1, except that the magenta coupler and high-boiling point organic solvent of the third layer of Sample 101 was replaced with combinations shown in Table 4. The prepared Samples were subjected to evaluation in the same way as in Example1.

Table 4 shows the results thereof.

TABLE 4

| Sample No. | Magenta Coupler in 3rd Layer | HBS of 3rd Layer and Added Amount ($g/m^2$) | $D_{max}$ | Light Fastness (residual %) |
|---|---|---|---|---|
| 201 | M-5 | DNP (0.20) | 2.16 | 51 |
| 202 | M-5 | HBS-1 (0.20) | 2.15 | 53 |
| 203 | M-5 | L-7 (0.20) | 2.28 | 70 |
| 204 | M-5 | L-7 (0.60) | 2.31 | 78 |
| 205 | M-5 | PL-3 (0.20) | 2.25 | 72 |
| 206 | M-5 | PL-3 (0.60) | 2.30 | 75 |

The result shown in Table 4 illustrates that the liquid crustal compound is employed as a high-boiling point organic solvent for the pyrazoloazole series magenta coupler (M-5), in which the third position is substituted with a tertiary alkyl group. to result in remarkable improvement in light fastness and dye-forming efficiency and result in substantial improvement in light fastness among these.

Example 3

Multilayer silver halide light-sensitive color photographic material Sample 301 was prepared by coating each layer having compositions shown below on the titanium oxide-containing polyethylene layer side of a paper support laminated with polyethylene on one side and titanium oxide-containing polyethylene on the other side. The coating compositions were prepared as mentioned below.

First Layer Coating Composition

To a mixture consisting of 26.7 g of yellow coupler (Y-2), 10.0 g of dye image stabilizing agent (ST-1), 0.67 g of dye image stabilizing agent (ST-2), 0.67 g of additive (HQ-1), 0.33 g of antirradiation dye (AI-3), and 6.67 g of high-boiling point organic solvent (DNP), 60 ml of ethyl acetate is added and dissolved. The resultant solution was emulsify-dispersed in 220 ml of a 10% aqueous gelatin solution containing 7 ml of a 20% surface active agent (SU-1) solution employing a ultrasonic homogenize, and thus a yellow coupler dispersion was prepared. This resultant dispersion was mixed with a blue-sensitive silver halide emulsion (comprising 8.68 g of silver) to prepare the first layer coating composition.

Coating compositions from the second layer to the seventh layer were papered in the same manner as for the first layer coating composition, described above.

Furthermore, hardening agent (H-1) was added to the second and fourth layer coating compositions, and (H-2) was added to the seventh layer coating composition. Surface tension was adjusted by the addition of surface active agents (SU-2) and (SU-3) as coating aids. The added amount in the light-sensitive material is shown by $g/m^2$, unless otherwise specified.

TABLE 5

| Layer | Compositions | Added Amount ($g/m^2$) |
|---|---|---|
| 7th Layer (Protective Layer) | Gelatin | 1.00 |
| | DIDP | 0.005 |
| | Additive (HQ-2) | 0.002 |
| | Additive (HQ-3) | 0.002 |

TABLE 5-continued

| Layer | Compositions | Added Amount ($g/m^2$) |
|---|---|---|
| | Additive (HQ-4) | 0.004 |
| | Additive (HQ-5) | 0.02 |
| | Compound (F-2) | 0.002 |
| 6th Layer (UV Absorbing Layer) | Gelatin | 0.40 |
| | Additive (HQ-5) | 0.04 |
| | DOP | 0.20 |
| | PVP | 0.03 |
| | Antirradiation Dye (AI-2) | 0.02 |
| | Antirradiation Dye (AI-4) | 0.01 |
| 5th Layer (Red-sensitive Layer) | Gelatin | 1.30 |
| | Red-sensitive Chlorobromide Emulsion (Em-R) | 0.21 |
| | Cyan Coupler (A-36) | 0.40 |
| | DOP | 0.40 |

TABLE 6

| Layer | Compositions | Added Amount ($g/m^2$) |
|---|---|---|
| 4th Layer (UV Absorbing Layer) | Gelatin | 0.94 |
| | DNP | 0.40 |
| | Additive (HQ-5) | 0.10 |
| 3rd Layer (Green-sensitive Layer) | Gelatin | 1.40 |
| | Green-sensitive Chlorobromide Emulsion (Em-G) | 0.17 |
| | Magenta Coupler (M-201) | 0.23 |
| | Dye Image Stabilizing Agent (ST-3) | 0.20 |
| | Dye Image Stabilizing Agent (ST-4) | 0.17 |
| | DIDP | 0.13 |
| | DBP | 0.13 |
| | Antirradiation Dye (AI-1) | 0.01 |
| 2nd Layer (Interlayer) | Gelatin | 1.20 |
| | Additive (HQ-2) | 0.03 |
| | Additive (HQ-3) | 0.03 |
| | Additive (HQ-4) | 0.05 |
| | Additive (HQ-5) | 0.23 |
| | DIDP | 0.06 |
| | Compound (F-2) | 0.002 |
| 1st Layer (Blue-sensitive Layer) | Gelatin | 1.20 |
| | Blue-sensitive Chlorobromide Emulsion (EM-B) | 0.26 |
| | Yellow Coupler (Y-2) | 0.80 |
| | Dye Image Stabilizing Agent (ST-1) | 0.30 |
| | Dye Image Stabilizing Agent (ST-2) | 0.20 |
| | Additive (HQ-1) | 0.02 |
| | Antirradiation Dye (AI-3) | 0.01 |
| | DNP | 0.20 |
| Support | Polyethylene-laminated Paper (containing a very small amount of colorant) | |

The added amount of the silver halide emulsion is shown in terms of silver.

SU-1: sodium tri-i-propylnaphthalene sulfonate
SU-2: sodium di(2-ethylhexyl)sulfosuccinate salt
SU-3: sodium di(2,2,3,3,4,4,5,5-octafluoropentyl) sulfosuccinate salt
DBP: dibutyl phthalate
DNP: dinonyl phthalate
DOP: dioctyl phthalate
DIDP: di-i-decyl phthalate
PVP: polyvinylpyrrolidone
HQ-1: 2,5-di-t-octylhydroauione
HQ-2: 2,5-di-sec-dodecylhydroquinone
HQ-3: 2,5-di-sec-tetradecylhydroquinone
HQ-4: 2-sec-dodecyl-5-sec-tetradecylhydroquinone
HQ-5: 2,5-di(1,1-dimethyl-4-hexyloxycarbonyl) butylhydroquinone
H-1: tetrakis(vinylsulfonylmethyl)methane
H-2: 2,4-dichloro-6-hydroxy-s-triazine sodium Y-2
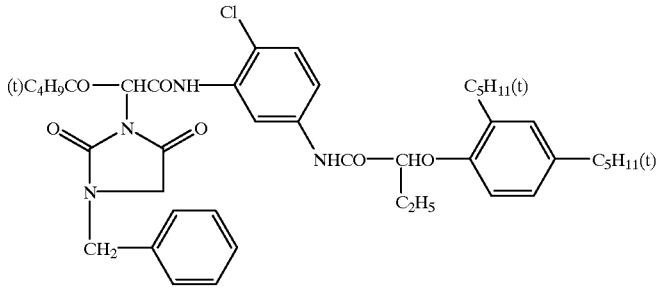
M-201
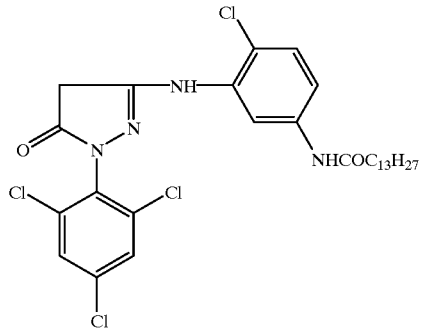
ST-1
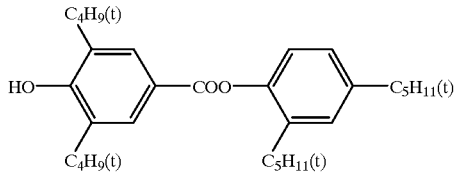
ST-2
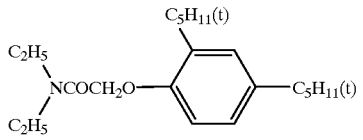
ST-3
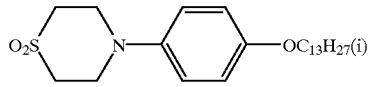
ST-4
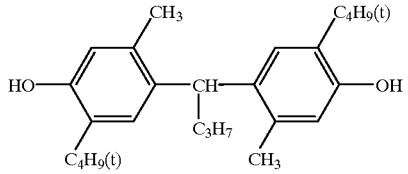
AI-1
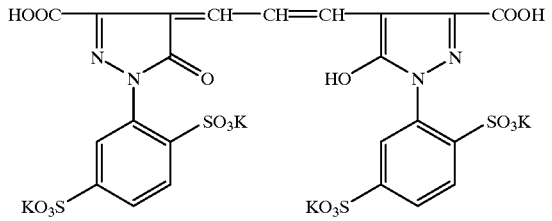

-continued

AI-2

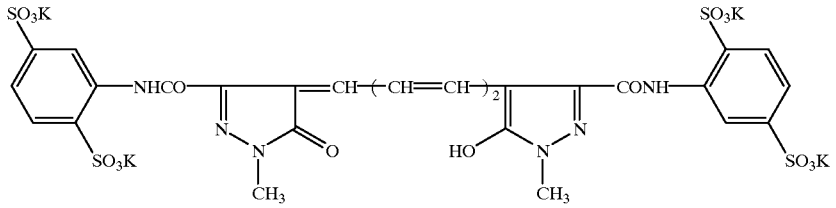

AI-3

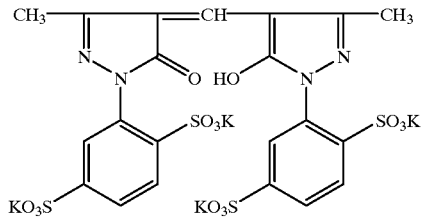

AI-4

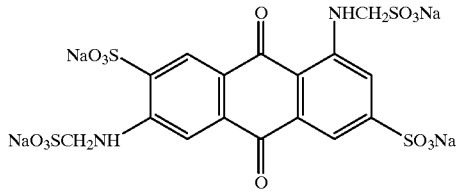

F-2

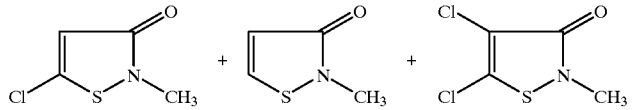

(50%) (46%) (4%) molar ratio (Preparation Method of the Blue-sensitive Silver Halide Emulsion)

Into 1,000 ml of a 2% aqueous gelatin solution kept at 40° C., (A Solution) and (B Solution) mentioned below, were simultaneously added for 30 minutes, while adjusting the pAg and the pH to 6.5 and 3.0 respectively, and further, (C Solution) and (D Solution) were added simultaneously for 180 minutes, while adjusting the pAg and the pH to 7.3 and 5.5, respectively. The pH was controlled employing an aqueous sulfuric acid solution and an aqueous sodium hydroxide solution, and the pAg was controlled employing a control solution having the following composition. The control solution was composed of an aqueous halide salt solution consisting of a mixture of sodium chloride and potassium sulfide. The ratio of chloride ions to bromide ions was determined to be 99.8:0.2, and the concentration of the control solution was 0.1 mole/liter when the A Solution and B Solution were mixed, and 1 mole/liter when the C Solution and the D Solution were mixed.

| (A Solution) | |
|---|---|
| Sodium chloride | 3.42 g |
| Potassium bromide | 0.03 g |
| Water to make | 200 ml |
| (B Solution) | |
| Silver nitrate | 10 g |
| Water to make | 200 ml |

-continued

| (C Solution) | |
|---|---|
| Sodium chloride | 102.7 g |
| Potassium bromide | 1.0 g |
| Water to make | 600 ml |
| (D Solution) | |
| Silver nitrate | 300 g |
| Water to make | 600 ml |

After the addition, water-soluble salts were removed employing an aqueous 5% Demol N (manufactured by Kao Atlas Co.) and an aqueous 2% magnesium sulfate solution. Thereafter, the resultant was mixed with an aqueous gelatin solution and a monodispersed cubic grain emulsion EMP-1 was then obtained having an average diameter of 0.85 $\mu$m, a variation coefficient of 0.07, and a silver chloride content ratio of 99.5 mole percent.

The above-mentioned emulsion EMP-1 was subjected to chemical ripening at 50° C. for 90 minutes employing compounds shown below and blue-sensitive silver halide emulsion (Em-B) was prepared.

| | |
|---|---|
| Sodium thiosulfate | 0.8 mg/mole of AgX |
| Chloroauric acid | 0.5 mg/mole of AgX |
| Stabilizer STAB-1 | $6 \times 10^{-4}$ mole/mole of AgX |
| Sensitizing dye BS-1 | $4 \times 10^{-4}$ mole/mole of AgX |

-continued

| | |
|---|---|
| Sensitizing dye BS-2 | $1 \times 10^{-4}$ mole/mole of AgX |

(Preparation Method of the Green-sensitive Silver Halide Emulsion)

Monodispersed cubic grain emulsion EMP-2, having an average grain diameter of 0.43 μm, a variation coefficient of 0.08 and a silver chloride content ratio of 99.5 mole percent, was obtained in the same manner as in EMP-1, except that the addition time of A Solution and B Solution, and of C solution and D Solution were varied.

EMP-2 was subjected to chemical ripening at 55° C. for 120 minutes employing compounds mentioned below, and greensensitive silver halide emulsion (Em-G) was prepared.

| | |
|---|---|
| Sodium thiosulfate | 1.5 mg/mole of AgX |
| Chloroauric acid | 1.0 mg/mole of AgX |
| Stabilizer STAB-1 | $6 \times 10^{-4}$ mole/mole of AgX |
| Sensitizing dye GS-1 | $4 \times 10^{-4}$ mole/mole of AgX |

(Preparation Method of the Red-sensitive Silver Halide Emulsion)

Monodispersed cubic grain emulsion (EMP-3) having an average grain diameter of 0.50 μm, a variation coefficient of 0.08, and a silver chloride content ratio of 99.5 mole percent was prepared in the same manner as in EMP-1, except that the addition time of A Solution and B Solution, and of C solution and D Solution were varied.

EMP-3 was subjected to chemical ripening at 60° C. for 90 minutes employing compounds mentioned below, and red-sensitive silver halide emulsion (Em-R) was prepared.

| | |
|---|---|
| Sodium thiosulfate | 1.8 mg/mole of AgX |
| Chloroauric acid | 2.0 mg/mole of AgX |
| Stabilizer STAB-1 | $6 \times 10^{-4}$ mole/mole of AgX |
| Sensitizing dye RS-1 | $1 \times 10^{-4}$ mole/mole of AgX |

STAB-1: 1-(3-acetoamido)phenyl-5-mercaptotetrazole

BS-1

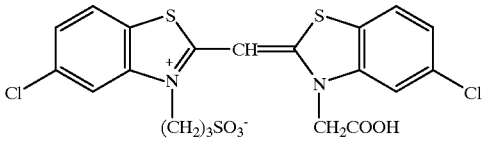

BS-2

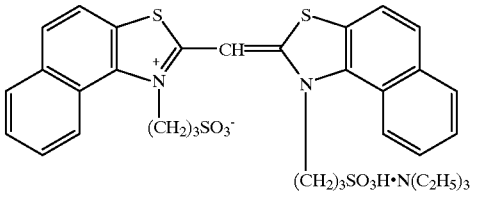

GS-1

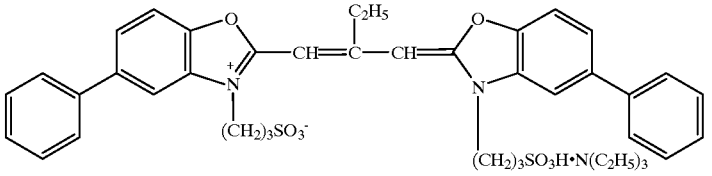

RS-1

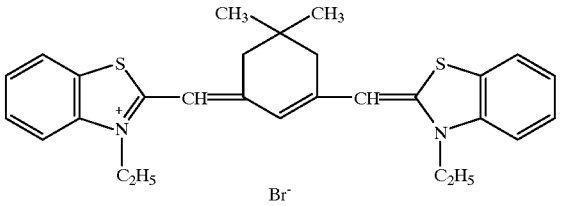

-continued

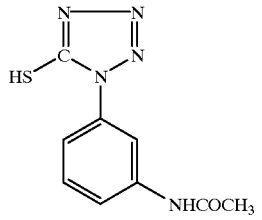

Samples 302 to 346 were prepared in the same manner as Sample 1, except that cyan coupler (C-1) and DOP in the 5th layer of Sample 301 were replaced with combinations equal to each weight shown in Table 7 and Table 8.

Samples prepared as mentioned above were subjected to evaluations for each property according to methods mentioned below.

(Dye-forming Efficiency, Light Fastness)

The above-mentioned Samples 301 to 346 were exposed to white light through an optical wedge and were then processed under the following conditions. The maximum color density of each Sample was measured, employing red light. Furthermore, each Sample was subjected to a fading test for 10 days, employing a Fademeter, and the residual ratio (%) of the dye image at a density of 1.0 was measured, employing red light.

(Color Reproduction)

Firstly, Color Checker, manufactured by Macbeth Co. was photographed employing a color negative film (Konica Color LV-400 manufactured by Konica Corp.) and a camera (Konica FT-1 manufactured by Konica Corp.). The exposed film was then processed employing a color negative photographic processing (CNK-4 manufactured by Konica Corp.). The resultant negative film image was printed onto each Sample in the size of 82 mm×117 mm employing a Konica Color Printer (CL-P2000 manufactured by Konica Corp.) (printer conditions were set so that gray color on the Color Checker was reproduced as an identical gray color on the print). The color reproduction on the practical print was visually evaluated by 20 persons and evaluation results were provided with the following 5 grades.

5: all 20 persons evaluated it to be good

4: 15 to 19 persons of 20 evaluated it to be good

3: 10 to 14 persons of 20 evaluated it to be good

2: 5 to 9 persons of 20 evaluated it to be good

1: 0 to 4 persons of 20 evaluated it to be good

Processing conditions were as follows.

(Processing Conditions)

| Processing Step | Temperature | Time |
|---|---|---|
| Color Development | 35.0 ± 0.3° C. | 45 seconds |
| Bleach-fixing | 35.0 ± 0.5° C. | 45 seconds |
| Stabilizing | 30 to 34° C. | 90 seconds |
| Drying | 60 to 80° C. | 60 seconds |

Color Developer

| | |
|---|---|
| Deionized water | 800 ml |
| Triethanolamine | 10 g |
| N,N-diethylhydroxylamine | 5 g |
| Potassium bromide | 0.02 g |

STAB-1

-continued

| | |
|---|---|
| Potassium chloride | 2 g |
| Potassium sulfite | 0.3 g |
| 1-Hydoxyethylidene-1,1-disulfonic acid | 1.0 g |
| Ethylenediaminetetraacetic acid | 1.0 g |
| Catechol-3,5-disulfonate 2 sodium salt | 1.0 g |
| Diethyleneglycol | 10 g |
| N-ethyl-N-β-methanesulfonamidoethyl-3-methyl-4-aminoaniline sulfonate salt (CD-3) | 4.5 g |
| Optical brightening agent (4,4'-diamino-stylbenesulfonic acid derivative) | 1.0 g |
| Potassium carbonate | 27 g |
| Water to make | 1 liter |

pH is adjusted to 10.1.

Bleach-fixing Solution

| | |
|---|---|
| Ethylenediaminetetraacetic acid ferric ammonium dihydride | 60 g |
| Ethylenediaminetetraacetic acid | 3 g |
| Ammonium thiosulfate (70% aqueous solution) | 100 ml |
| Ammonium sulfite (40% aqueous solution) | 27.5 ml |
| Water to make | 1,000 ml |

pH is adjusted to 5.7 employing sodium carbonate or glacial acetic acid.

Stabilizing Solution

| | |
|---|---|
| 5-Chloro-2-methyl-4-isothiazoline-3-on | 0.2 g |
| 1,2-Benzoisothiazoline-3-on | 0.3 g |
| Ethylene glycol | 1.0 g |
| 1-Hydroxyethylidene-1,1-disulfonic acid | 2.0 g |
| o-Phenylphenol sodium | 1.0 g |
| Ethylenediaminetetraacetic acid | 1.0 g |
| Ammonium hydroxide (20% aqueous solution) | 3.0 g |
| Optical brightening agent (4,4'-diaminostylbenesulfonic acid derivative) | 1.5 g |
| Water to make | 1,000 ml |

pH is adjusted to 7.0 employing sulfuric acid or potassium hydroxide.

Table 7 and Table 8 show the results.

TABLE 7

| Sample No. | Coupler | Compound | $D_{max}$ | Light Fastness | Color Reproduction |
|---|---|---|---|---|---|
| 301 | (A-36) | DOP | 1.88 | 75 | 4 |
| 302 | (A-12) | DOP | 1.80 | 78 | 4 |
| 303 | (A-19) | DOP | 1.81 | 73 | 4 |
| 304 | (A-24) | DOP | 1.78 | 76 | 4 |
| 305 | (A-36) | L-7 | 2.36 | 94 | 5 |
| 306 | (A-36) | L-15 | 2.37 | 92 | 5 |
| 307 | (A-36) | L-23 | 2.39 | 93 | 5 |

TABLE 7-continued

| Sample No. | Coupler | Compound | $D_{max}$ | Light Fastness | Color Reproduction |
|---|---|---|---|---|---|
| 308 | (A-12) | L-7 | 2.22 | 92 | 5 |
| 309 | (A-12) | L-15 | 2.20 | 91 | 5 |
| 310 | (A-12) | L-23 | 2.19 | 93 | 5 |
| 311 | (A-19) | L-7 | 2.18 | 89 | 5 |
| 312 | (A-19) | L-15 | 2.16 | 88 | 5 |
| 313 | (A-19) | L-23 | 2.14 | 90 | 5 |
| 314 | (A-24) | L-7 | 2.12 | 90 | 5 |
| 315 | (A-24) | L-15 | 2.13 | 89 | 5 |
| 316 | (A-24) | L-23 | 2.11 | 91 | 5 |
| 317 | (A-4) | L-7 | 2.29 | 92 | 5 |
| 318 | (A-4) | L-15 | 2.30 | 91 | 5 |
| 319 | (A-4) | L-23 | 2.28 | 92 | 5 |

TABLE 8

| Sample No. | Coupler | Compound | $D_{max}$ | Light Fastness | Color Reproduction |
|---|---|---|---|---|---|
| 320 | (A-27) | L-7 | 2.25 | 92 | 5 |
| 321 | (A-27) | L-15 | 2.29 | 90 | 5 |
| 322 | (A-27) | L-23 | 2.27 | 91 | 5 |
| 323 | (A-31) | L-7 | 2.20 | 91 | 5 |
| 324 | (A-31) | L-15 | 2.28 | 92 | 5 |
| 325 | (A-31) | L-23 | 2.26 | 90 | 5 |
| 326 | (A-18) | L-7 | 2.15 | 89 | 5 |
| 327 | (A-18) | L-15 | 2.17 | 88 | 5 |
| 328 | (A-18) | L-23 | 2.19 | 86 | 5 |
| 329 | (A-36) | L-45 | 2.20 | 88 | 5 |
| 330 | (A-36) | L-47 | 2.25 | 88 | 5 |
| 331 | (A-36) | L-52 | 2.23 | 90 | 5 |
| 332 | (A-36) | L-58 | 2.24 | 90 | 5 |
| 333 | (A-36) | L-60 | 2.22 | 89 | 5 |
| 334 | (A-36) | L-64 | 2.24 | 88 | 5 |
| 335 | (A-36) | L-65 | 2.23 | 89 | 5 |
| 336 | (A-36) | L-69 | 2.21 | 88 | 5 |
| 337 | (A-36) | L-74 | 2.24 | 90 | 5 |
| 338 | (A-36) | L-76 | 2.22 | 87 | 5 |
| 339 | (A-36) | L-77 | 2.23 | 87 | 5 |
| 340 | (A-36) | L-78 | 2.21 | 88 | 5 |
| 341 | (A-36) | L-79 | 2.24 | 86 | 5 |
| 342 | (A-36) | L-80 | 2.21 | 87 | 5 |

As can be clearly seen from Table 7 and Table 8, Samples 301, to 304, exhibit excellent color reproduction, but exhibit neither sufficient light fastness nor dye-forming efficiency. Contrary to this, Samples 305 to 342, in which couplers of the present invention and liquid crystal compounds of the present invention are employed, exhibit markedly excellent color reproduction, and markedly excellent light fastness and also dye-forming sufficiency.

According to the present invention, it is possible to provide, firstly, a silver halide light-sensitive color photographic material which exhibits improved color reproduction, and secondly, a silver halide light-sensitive color photographic material which exhibits remarkable improvement in light fastness of dye images, and thirdly, a silver halide light-sensitive color photographic material which exhibits excellent dye-forming efficiency.

Example 4

Multilayer silver halide light-sensitive color photographic material Sample 401 was prepared by coating each layer having compositions shown below on the titanium oxide-containing polyethylene layer side of a paper support laminated with polyethylene on one side and titanium oxide-containing polyethylene on the other side. The coating compositions were prepared as mentioned below.

First Layer Coating Composition

To a mixture consisting of 26.7 g of yellow coupler (Y-1), 10.0 g of dye image stabilizing agent (ST-1), 0.67 g of dye image stabilizing agent (ST-2), 0.67 g of additive (HQ-1), 0.33 g of antirradiation dye (AI-3), and 6.67 g of high-boiling point organic solvent (DNP), 60 ml of ethyl acetate is added and dissolved. The resultant solution was emulsify-dispersed in 220 ml of a 10% aqueous gelatin solution containing 7 ml of a 20% surface active agent (SU-1) solution employing a ultrasonic homogenize, and thus a yellow coupler dispersion was prepared. This resultant dispersion was mixed with a blue-sensitive silver halide emulsion (comprising 8.68 g of silver) to prepare the first layer coating composition.

Coating compositions from the second layer to the seventh layer were papered in the same manner as for the first layer coating composition, described above.

Furthermore, hardening agent (H-1) was added to the second and fourth layer coating compositions, and (H-2) was added to the seventh layer coating composition. Surface tension was adjusted by the addition of surface active agents (SU-2) and (SU-3) as coating aids. The added amount in the light-sensitive material is shown by g/m$^2$, unless otherwise specified.

TABLE 9

| Layer | Compositions | Added Amount (g/m$^2$) |
|---|---|---|
| 7th Layer (Protective Layer) | Gelatin | 1.00 |
| | DIDP | 0.005 |
| | Additive (HQ-2) | 0.002 |
| | Additive (HQ-3) | 0.002 |
| | Additive (HQ-4) | 0.004 |
| | Additive (HQ-5) | 0.02 |
| | Compound (F-2) | 0.002 |
| 6th Layer (UV Absorbing Layer) | Gelatin | 0.40 |
| | Antirradiation Dye (AI-4) | 0.03 |
| | UV Absorbant (UV-1) | 0.10 |
| | UV Absorbant (UV-2) | 0.04 |
| | UV Absorbant (UV-3) | 0.16 |
| | Additive (HQ-5) | 0.04 |
| | DNP | 0.20 |
| | PVP | 0.03 |
| 5th Layer (Red-sensitive Layer) | Gelatin | 1.30 |
| | Red-sensitive Chlorobromide Emulsion (Em-R) | 0.21 |
| | Cyan Coupler (Compound B-2) | 0.40 |
| | Additive (HQ-1) | 0.01 |
| | HBS-1A | 0.40 |

TABLE 10

| Layer | Compositions | Added Amount (g/m$^2$) |
|---|---|---|
| 4th Layer (UV Absorbing Layer | Gelatin | 0.94 |
| | UV Absorbant (UV-1) | 0.28 |
| | UV Absorbant (UV-2) | 0.09 |
| | UV Absorbant (UV-3) | 0.38 |
| | DNP | 0.40 |
| | Additive (HQ-5) | 0.10 |
| 3rd Layer (Green-sensitive Layer) | Gelatin | 1.40 |
| | Antirradiation Dye (AI-1) | 0.01 |
| | Green-sensitive Chlorobromide Emulsion (Em-G) | 0.17 |
| | Magenta Coupler (M-28) | 0.23 |
| | Dye Image Stabilizing Agent (ST-3) | 0.20 |
| | Dye Image Stabilizing Agent (ST-4) | 0.17 |
| | DIDP | 0.13 |
| | DBP | 0.13 |
| 2nd Layer (Interlayer) | Gelatin | 1.20 |
| | Additive (HQ-2) | 0.03 |
| | Additive (HQ-3) | 0.03 |

TABLE 10-continued

| Layer | Compositions | Added Amount ($g/m^2$) |
|---|---|---|
| | Additive (HQ-4) | 0.05 |
| | Additive (HQ-5) | 0.23 |
| | DIDP | 0.06 |
| | Compound (F-2) | 0.002 |
| 1st Layer (Blue-sensitive Layer) | Gelatin | 1.20 |
| | Blue-sensitive Chlorobromide Emulsion (EM-B) | 0.26 |
| | Yellow Coupler (Y-1) | 0.80 |
| | Dye Image Stabilizing Agent (ST-1) | 0.30 |
| | Dye Image Stabilizing Agent (ST-2) | 0.20 |
| | Additive (HQ-1) | 0.02 |
| | Antirradiation Dye (AI-3) | 0.01 |
| | DNP | 0.20 |
| Support | Polyethylene-laminated Paper (containing a very small amount of colorant) | |

The added amount of the silver halide emulsion is shown in terms of silver.

SU-1: sodium tri-i-propylnaphthalene sulfonate
SU-2: sodium di(2-ethylhexyl)sulfosuccinate salt
SU-3: sodium di(2,2,3,3,4,4,5,5-octafluoropentyl) sulfosuccinate salt
DBP: dibutyl phthalate
DOP: dioctyl phthalate
DIDP: di-i-decyl phthalate
PVP: polyvinylpyrrolidone
HQ-1: 2,5-di-t-octylhydroquione
HQ-2: 2,5-di-sec-dodecylhydroquinone
HQ-3: 2,5-di-sec-tetradecylhydroquinone
HQ-4: 2-sec-dodecyl-5-sec-tetradecylhydroquinone
HQ-5: 2,5-di(1,1-dimethyl-4-hexyloxycarbonyl) butylhydroquinone
H-1: tetrakis(vinylsulfonylmethyl)methane
H-2: 2,4-dichloro-6-hydroxy-s-triazine sodium

Y-1

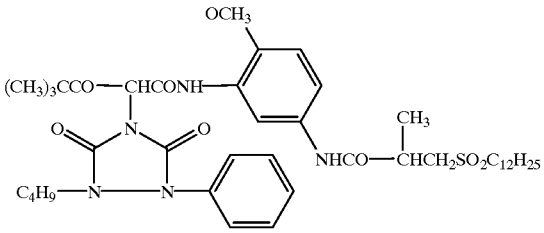

M-28

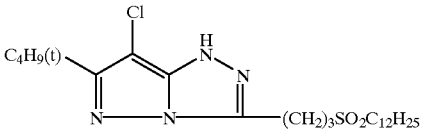

ST-1

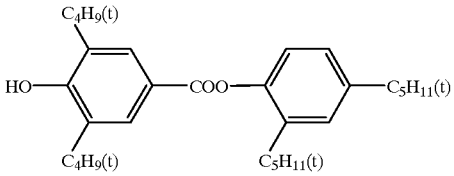

-continued

ST-2

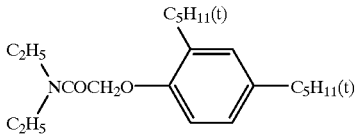

ST-3

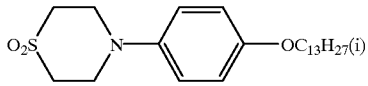

ST-4

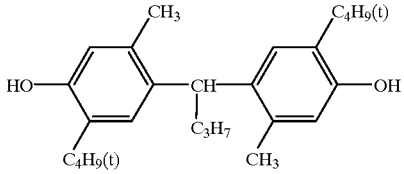

HBS-1A

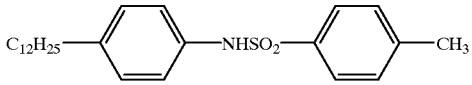

UV-1

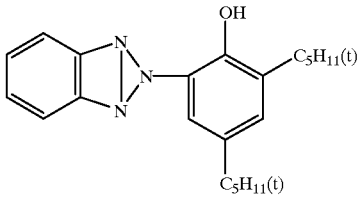

UV-2

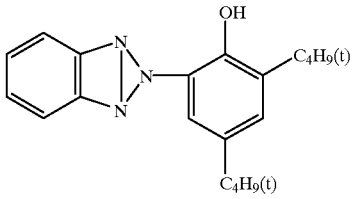

UV-3

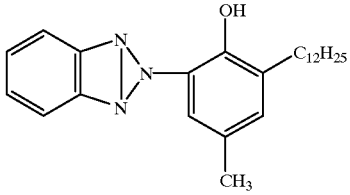

AI-1

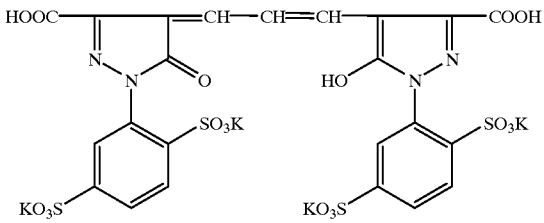

-continued

AI-4

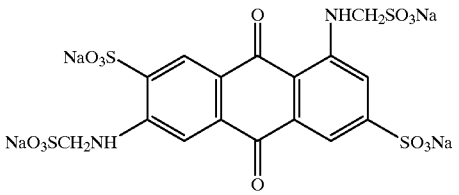

AI-3

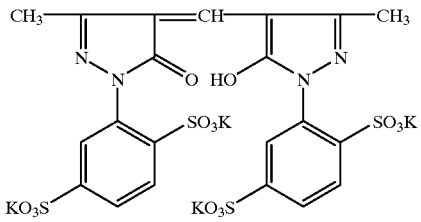

F-2

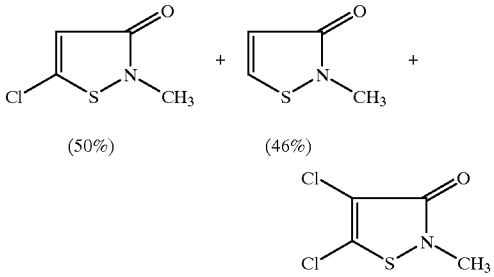

molar ratio (Preparation Method of the Blue-sensitive Silver Halide Emulsion)

Into 1,000 ml of a 2% aqueous gelatin solution kept at 40° C., (A Solution) and (B Solution) mentioned below, were simultaneously added for 30 minutes, while adjusting the pAg and the pH to 6.5 and 3.0 respectively, and further, (C Solution) and (D Solution) were added simultaneously for 180 minutes, while adjusting the pAg and the pH to 7.3 and 5.5, respectively. The pH was controlled employing an aqueous sulfuric acid solution and an aqueous sodium hydroxide solution, and the pAg was controlled employing a control solution having the following composition. The control solution was composed of an aqueous halide salt solution consisting of a mixture of sodium chloride and potassium sulfide. The ratio of chloride ions to bromide ions was determined to be 99.8: 0.2, and the concentration of the control solution was 0.1 mole/liter when the A Solution and B Solution were mixed, and 1 mole/liter when the C Solution and the D Solution were mixed.

| (A Solution) | |
|---|---|
| Sodium chloride | 3.42 g |
| Potassium bromide | 0.03 g |
| Water to make | 200 ml |
| (B Solution) | |
| Silver nitrate | 10 g |
| Water to make | 200 ml |
| (C Solution) | |
| Sodium chloride | 102.7 g |
| Potassium bromide | 1.0 g |
| Water to make | 600 ml |

-continued

| (D Solution) | |
|---|---|
| Silver nitrate | 300 g |
| Water to make | 600 ml |

After the addition, water-soluble salts were removed employing an aqueous 5% Demol N (manufactured by Kao Atlas Co.) and an aqueous 2% magnesium sulfate solution. Thereafter, the resultant was mixed with an aqueous gelatin solution and a monodispersed cubic grain emulsion EMP-1 was then obtained having an average diameter of 0.85 μm, a variation coefficient of 0.07, and a silver chloride content ratio of 99.5 mole percent.

The above-mentioned emulsion EMP-1 was subjected to chemical ripening at 50° C. for 90 minutes employing compounds shown below and blue-sensitive silver halide emulsion (Em-B) was prepared.

| | |
|---|---|
| Sodium thiosulfate | 0.8 mg/mole of AgX |
| Chloroauric acid | 0.5 mg/mole of AgX |
| Stabilizer STAB-1 | $6 \times 10^{-4}$ mole/mole of AgX |
| Sensitizing dye BS-1 | $4 \times 10^{-4}$ mole/mole of AgX |
| Sensitizing dye BS-2 | $1 \times 10^{-4}$ mole/mole of AgX |

(Preparation Method of the Green-sensitive Silver Halide Emulsion)

Monodispersed cubic grain emulsion BMP-2, having an average grain diameter of 0.43 μm, a variation coefficient of 0.08 and a silver chloride content ratio of 99.5 mole percent, was obtained in the same manner as in EMP-1, except that the addition time of A Solution and B Solution, and of C solution and D Solution were varied.

EMP-2 was subjected to chemical ripening at 55° C. for 120 minutes employing compounds mentioned below, and green-sensitive silver halide emulsion (Em-G) was prepared.

| | |
|---|---|
| Sodium thiosulfate | 1.5 mg/mole of AgX |
| Chloroauric acid | 1.0 mg/mole of AgX |
| Stabilizer STAB-1 | $6 \times 10^{-4}$ mole/mole of AgX |
| Sensitizing dye GS-1 | $4 \times 10^{-4}$ mole/mole of AgX |

(Preparation Method of the Red-sensitive Silver Halide Emulsion)

Monodispersed cubic grain emulsion (EMP-3) having an average grain diameter of 0.50 μm, a variation coefficient of 0.08, and a silver chloride content ratio of 99.5 mole percent was prepared in the same manner as in EMP-1, except that the addition time of A Solution and B Solution, and of C solution and D Solution were varied.

EMP-3 was subjected to chemical ripening at 60° C. for 90 minutes employing compounds mentioned below, and red-sensitive silver halide emulsion (Em-R) was prepared.

| | |
|---|---|
| Sodium thiosulfate | 1.8 mg/mole of AgX |
| Chloroauric acid | 2.0 mg/mole of AgX |
| Stabilizer STAB-1 | $6 \times 10^{-4}$ mole/mole of AgX |
| Sensitizing dye RS-1 | $1 \times 10^{-4}$ mole/mole of AgX |

STAB-1: 1-(3-acetoamido)phenyl-5-mercaptotetrazole

BS-1

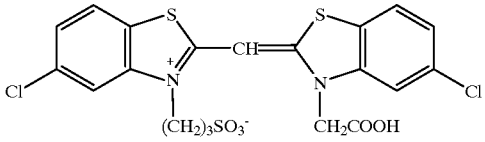

BS-2

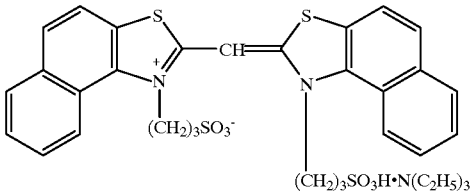

GS-1

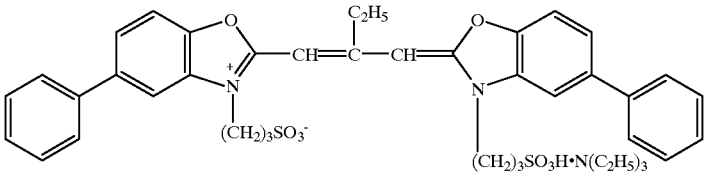

RS-1

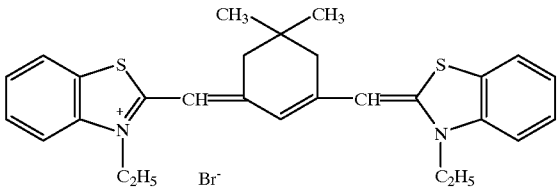

Samples 402 to 430 were prepared in the same manner as Sample 401, except that cyan coupler and HBS in the 5th layer of Sample 401 were replaced with Compound B-43 equal to weight of Compound B-2 and HBS shown in Table 11 and Table 12, respectively.

Samples prepared as mentioned above were subjected to evaluations for each property according to methods mentioned below.

(Processing Conditions)

| Processing Step | Temperature | Time |
|---|---|---|
| Color Development | 35.0 ± 0.3° C. | 45 seconds |
| Bleach-fixing | 35.0 ± 0.5° C. | 45 seconds |
| Stabilizing | 30 to 34° C. | 90 seconds |
| Drying | 60 to 80° C. | 60 seconds |

Color Developer

| | |
|---|---|
| Deionized water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-Hydoxyethylidene-1,1-disulfonic acid | 1.0 g |
| Ethylenediaminetetraacetic acid | 1.0 g |
| Catechol-3,5-disulfonate 2 sodium salt | 1.0 g |
| Diethyleneglycol | 10 g |
| N-ethy1-N-β-methanesulfonamidoethy1-3-methyl-4-aminoaniline sulfonate | 4.5 g |

-continued

| | |
|---|---|
| salt (CD-3) | |
| Optical brightening agent (4,4'-diamino-stylbenesulfonic acid derivative) | 1.0 g |
| Potassium carbonate | 27 g |
| Water to make | 1 liter |
| pH is adjusted to 10.1. | |

Bleach-fixing Solution

| | |
|---|---|
| Ethylenediaminetetraacetic acid ferric ammonium dihydride | 60 g |
| Ethylenediaminetetraacetic acid | 3 g |
| Ammonium thiosulfate (70% aqueous solution) | 100 ml |
| Ammonium sulfite (40% agueous solution) | 27.5 ml |
| Water to make | 1 l |

pH is adjusted to 5.7 employing sodium carbonate or glacial acetic acid.

Stabilizing Solution

| | |
|---|---|
| 5-Chloro-2-methyl-4-isothiazoline-3-on | 0.2 g |
| 1,2-Benzoisothiazoline-3-on | 0.3 g |
| Ethylene glycol | 1.0 g |
| 1-Hydroxyethylidene-1,1-disulfonic acid | 2.0 g |
| o-Phenylphenol sodium | 1.0 g |
| Ethylenediaminetetraacetic acid | 1.0 g |
| Ammonium hydroxide (20% agueous solution) | 3.0 g |

-continued

| | |
|---|---|
| Optical brightening agent (4,4'-diaminostylbenesulfonic acid derivative) | 1.5 g |
| Water to make | 1 l |

pH is adjusted to 7.0 employing sulfuric acid or potassium hydroxide.

The maximum color density ($D^R$max), stability against light and color reproduction characteristics of each Sample was measured in the following way.

(Maximum density)

The maximum color density ($D^R$max) of each Sample was measured, employing PDA-65 Densitometer made by Konica Corporation.

(Stability against light)

Each Sample was subjected to a fading test for 10 days, employing a Fademeter, and the residual ratio (%) of the dye image at a density of 1.0 was measured.

(Color Reproduction)

Color Checker, manufactured by Macbeth Co. was photographed employing a color negative film (Konica Color LV-400 manufactured by Konica Corp.) and a camera (Konica FT-1 manufactured by Konica Corp.). The exoosed film was then processed employing a color negative photographic processing (CNK-4 manufactured by Konica Corp.). The resultant negative film image was printed onto each Sample in the size of 82 mm×117 mm employing a Konica Color Printer (CL-P2000 manufactured by Konica Corporation)(printer conditions were set so that gray color on the Color Checker was reproduced as an identical gray color on the print).

The color reproduction on the practical print was visually evaluated by 20 persons and evaluation results were provided with the following 5 grades.

5: all 20 persons evaluated it to be good

4: 15 to 19 persons of 20 evaluated it to be good

3: 10 to 14 persons of 20 evaluated it to be good

2: 5 to 9 persons of 20 evaluated it to be good

1: 0 to 4 persons of 20 evaluated it to be good

TABLE 11

| Sample No. | 5th Layer Cyan Coupler | 5th Layer HBS | Added Amount of HBS (g/m$^2$) | $D_{max}^R$ | Light Fastness (residual ratio %) | Color Reproduction |
|---|---|---|---|---|---|---|
| 401 | (B-2) | HBS-1A | 0.4 | 1.98 | 33 | 3 |
| 402 | (B-2) | DOP | 0.4 | 1.78 | 14 | 1 |
| 403 | (B-2) | TCP | 0.4 | 1.71 | 27 | 1 |
| 404 | (B-2) | HBS-1A: TCP = 1:1 | 0.4 | 2.90 | 30 | 3 |
| 405 | (B-2) | L-5 | 0.4 | 2.33 | 53 | 4 |
| 406 | (B-2) | L-12 | 0.4 | 2.36 | 55 | 5 |
| 407 | (B-2) | L-23 | 0.4 | 2.28 | 53 | 5 |
| 408 | (B-2) | L-38 | 0.4 | 2.38 | 58 | 5 |
| 409 | (B-2) | HBS-1A | 0.8 | 2.08 | 38 | 2 |
| 410 | (B-2) | DOP | 0.8 | 2.93 | 19 | 1 |
| 411 | (B-2) | TCP | 0.8 | 1.80 | 30 | 1 |
| 412 | (B-2) | HBS-1A: TCP = 1:1 | 0.8 | 2.01 | 33 | 2 |
| 413 | (B-2) | L-5 | 0.8 | 2.35 | 58 | 4 |
| 414 | (B-2) | L-12 | 0.8 | 2.41 | 60 | 5 |
| 415 | (B-2) | L-23 | 0.8 | 2.31 | 58 | 4 |
| 416 | (B-2) | L-38 | 0.8 | 2.43 | 62 | 5 |
| 417 | (B-2) | L-44 | 0.8 | 2.25 | 61 | 5 |
| 418 | (B-2) | L-52 | 0.8 | 2.40 | 65 | 4 |
| 419 | (B-2) | L-75 | 0.8 | 2.28 | 63 | 5 |
| 420 | (B-2) | L-78 | 0.8 | 2.30 | 66 | 4 |

TABLE 11-continued

| Sample No. | 5th Layer Cyan Coupler | 5th Layer HBS | Added Amount of HBS (g/m$^2$) | $D_{max}^R$ | Light Fastness (residual ratio %) | Color Reproduction |
|---|---|---|---|---|---|---|
| 421 | (B-2) | L-79 | 0.8 | 2.27 | 65 | 5 |
| 422 | (B-2) | L-85 | 0.8 | 2.27 | 67 | 5 |
| 423 | (B-43) | L-5 | 0.8 | 2.42 | 64 | 5 |
| 424 | (B-43) | L-12 | 0.8 | 2.45 | 66 | 5 |

TABLE 12

| Sample No. | 5th Layer Cyan Coupler | 5th Layer HBS | Added Amount of HBS (g/m$^2$) | $D_{max}^R$ | Light Fastness (residual ratio %) | Color Reproduction |
|---|---|---|---|---|---|---|
| 425 | (B-43) | L-23 | 0.8 | 2.40 | 64 | 5 |
| 426 | (B-43) | L-38 | 0.8 | 2.38 | 58 | 4 |
| 427 | (B-43) | L-75 | 0.8 | 2.20 | 58 | 4 |
| 428 | (B-43) | L-78 | 0.8 | 2.27 | 62 | 4 |
| 429 | (B-43) | L-79 | 0.8 | 2.23 | 62 | 5 |
| 430 | (B-430 | L-85 | 0.8 | 2.24 | 65 | 4 |

As is clearly seen from Table 11 and Table 12, Samples 405 to 408, in which liquid crystal compounds of the present invention are employed as a high-boiling point organic solvent (HBS), exhibit remarkable improvement in light fastness and improvements in dye-forming efficiency and color reproduction as compared to Comparative Samples 401 to 404.

Into Samples 409 to 430, the double amount of high-point boiling point organic solvent was added. In such systems, it is found that the liquid crystal compound of the present invention effectively functions to remarkably improve the light fastness.

As proved in the above-mentioned Examples, the silver halide light-sensitive color photographic material according to the present invention is excellent in dye-forming efficiency and color reproduction and exhibits remarkable improvement in light fastness of a cyan dye image.

Example 5

(Preparation of the Light-sensitive Color Photographic Material)

On a triacetyl cellulose film support, each layer having compositions shown below was coated successively from the support side and light-sensitive color photographic material Sample 501 was prepared.

In the present Example, the added amount of a material in the silver halide light-sensitive photographic material is expressed as gram per m$^2$, unless otherwise specified. Furthermore, the amount of silver halide and colloidal silver are expressed in terms of silver. The added amount of a sensitizing dye is expressed in terms of mole per mole of silver.

1st Layer: Antihalation Layer (HC)

| 1st Layer: antihalation layer (HC) | |
|---|---|
| Black colloidal silver | 0.15 |
| UV absorbing agent (UV-1) | 0.20 |
| Colored cyan coupler (CC-1) | 0.02 |
| High-boiling point solvent (Oil-1) | 0.20 |
| High-boiling point solvent (Oil-2) | 0.20 |
| Gelatin | 1.6 |

-continued

| | |
|---|---|
| 2nd Layer: interlayer (IL-1) | |
| Gelatin | 1.3 |
| 3rd Layer: slow red-sensitive emulsion layer (RL) | |
| Silver iodobromide emulsion (Em-1) | 0.4 |
| Silver iodobromide emulsion (Em-2) | 0.3 |
| Sensitizing dye (S-1) | $3.2 \times 10^{-4}$ |
| Sensitizing dye (S-2) | $3.2 \times 10^{-4}$ |
| Sensitizing dye (S-3) | $0.2 \times 10^{-4}$ |
| Cyan coupler (C-20) | 0.30 |
| Colored cyan coupler (CC-1) | 0.07 |
| DIR compound (D-1) | 0.006 |
| DIR compound (D-2) | 0.01 |
| High-boiling point solvent (Oil-1) | 0.55 |
| Additive (SC-1) | 0.003 |
| Gelatin | 1.0 |
| 4th Layer: fast red-sensitive emulsion layer (RH) | |
| Silver iodobromide emulsion (Em-3) | 0.9 |
| Sensitizing dye (S-1) | $1.7 \times 10^{-4}$ |
| Sensitizing dye (S-2) | $1.6 \times 10^{-4}$ |
| Sensitizing dye (S-3) | $0.1 \times 10^{-4}$ |
| Cyan coupler (C-20) | 0.23 |
| Colored cyan coupler (CC-1) | 0.03 |
| DIR compound (D-2) | 0.02 |
| High-boiling point solvent (Oil-1) | 0.25 |
| Additive (SC-1) | 0.003 |
| Gelatin | 0.1 |
| 5th Layer: interlayer (IL-2) | |
| Gelatin | 0.8 |
| 6th Layer: slow green-sensitive emulsion layer (GL) | |
| Silver iodobromide emulsion (Em-1) | 0.6 |
| Silver iodobromide emulsion (Em-2) | 0.2 |
| Sensitizing dye (S-4) | $6.7 \times 10^{-4}$ |
| Sensitizing dye (S-5) | $0.8 \times 10^{-4}$ |
| Magenta coupler (M-501) | 0.17 |
| Magenta coupler (M-4) | 0.43 |
| Colored magenta coupler (CM-1) | 0.10 |
| DIR compound (D-3) | 0.02 |
| High-boiling point solvent (Oil-2) | 0.70 |
| Additive (SC-1) | 0.003 |
| Gelatin | 1.0 |
| 7th Layer: fast green-sensitive emulsion layer (GH) | |
| Silver iodobromide emulsion (Em-3) | 0.9 |
| Sensitizing dye (S-6) | $1.1 \times 10^{-4}$ |
| Sensitizing dye (S-7) | $2.0 \times 10^{-4}$ |
| Sensitizing dye (S-8) | $0.3 \times 10^{-4}$ |
| Magenta coupler (M-501) | 0.03 |
| Magenta coupler (M-4) | 0.13 |
| Colored magenta coupler (CM-1) | 0.04 |
| DIR compound (D-3) | 0.004 |
| High-boiling point solvent (Oil-2) | 0.35 |
| Additive (SC-2) | 0.003 |
| Gelatin | 1.0 |
| 8th Layer: (IL-3) | |
| Gelatin | 1.0 |
| 9th Layer: yellow colloidal filter layer (YC) | |
| Yellow colloid silver | 0.1 |
| Additive (HS-1) | 0.07 |
| Additive (HS-2) | 0.07 |
| Additive (SC-2) | 0.12 |
| High-boiling point solvent (Oil-2) | 0.15 |

-continued

| | |
|---|---|
| Gelatin | 1.0 |
| 10th Layer: slow blue-sensitive emulsion layer (BL) | |
| Silver iodobromide emulsion (Em-1) | 0.25 |
| Silver iodobromide emulsion (Em-2) | 0.25 |
| Sensitizing dye (S-9) | $5.8 \times 10^{-4}$ |
| Yellow coupler (Y-3) | 0.60 |
| Yellow coupler (Y-4) | 0.32 |
| DIR compound (D-1) | 0.003 |
| DIR compound (D-2) | 0.006 |
| High-boiling point solvent (Oil-2) | 0.18 |
| Additive (SC-1) | 0.004 |
| Gelatin | 1.3 |
| 11th Layer: fast blue-sensitive emulsion layer (BH) | |
| Silver iodobromide erriulsion (Em-4) | 0.5 |
| Sensitizing dye (S-10) | $3.0 \times 10^{-4}$ |
| Sensitizing dye (S-11) | $1.2 \times 10^{-4}$ |
| Yellow coupler (Y-3) | 0.18 |
| Yellow coupler (Y-4) | 0.10 |
| High-boiling point solvent (Oil-2) | 0.05 |
| Additive (SC-1) | 0.002 |
| Gelatin | 1.0 |
| 12th Layer: 1st protective layer (PRO-1) | |
| Silver iodobromide emulsion (Em-5) | 0.3 |
| UV absorbing agent (UV-1) | 0.07 |
| UV absorbing agent (UV-4) | 0.1 |
| Additive (HS-1) | 0.2 |
| Additive (HS-2) | 0.1 |
| High-boiling point solvent (Oil-1) | 0.07 |
| High-boiling point solvent (Oil-3) | 0.07 |
| Gelatin | 0.8 |
| 13th Layer: 2nd protective layer (PRO-2) | |
| Alkali-soluble matting agent (average diameter 2 μm) | 0.13 |
| Folymethylmethacrylate (average diameter 2 μm) | 0.02 |
| Lubricant (WAX-1) | 0.04 |
| Antistatic agent (SU-1) | 0.004 |
| Antistatic agent (SU-2) | 0.02 |
| Gelatin | 0.5 |

Further, in addition to the above-mentioned compounds, to each layer are appropriately added coating aid SU-4, dispersion aid SU-3, hardening agents H-2 and H-3, stabilizer ST-5, antiseptic DI-1, antifoggants AF-1 and AF-2, dyes AI-5 and AI-6.

Furthermore, emulsions employed in the above-mentioned Samples are as follows. All these are inner high-iodide concentration type monodispersed emulsions.

Em-1: average silver iodide content ratio 7.5 mole percent, average grain diameter 0.55 μm, grain shape octahedron Em-2: average silver iodide content ratio 2.5 mole percent, average grain diameter 0.36 μm, grain shape octahedron Em-3: average silver iodide content ratio 8.0 mole percent, average grain diameter 0.36 μm, grain shape octahedron Em-4: average silver iodide content ratio 8.5 mole percent, average grain diameter 1.02 μm, grain shape octahedron Em-5: average silver iodide content ratio 2.0 mole percent, average grain diameter 0.08 μm, grain shape octahedron M-501
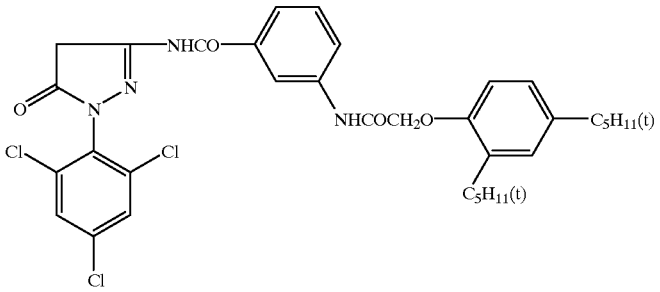
M-4
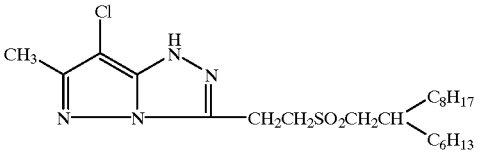
Y-3
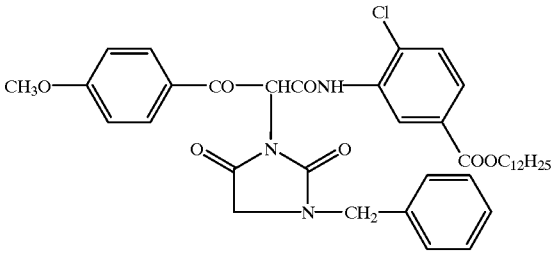
Y-4
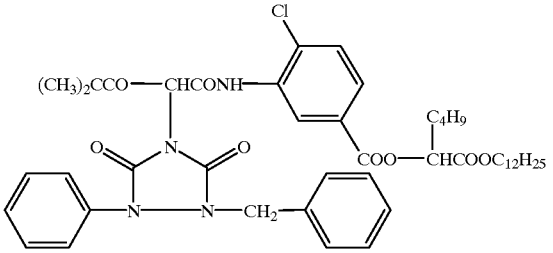
CC-1
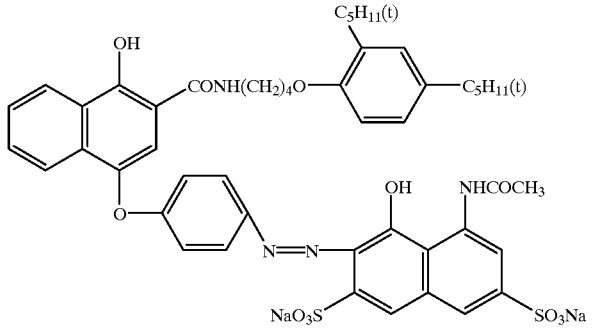

-continued
D-1
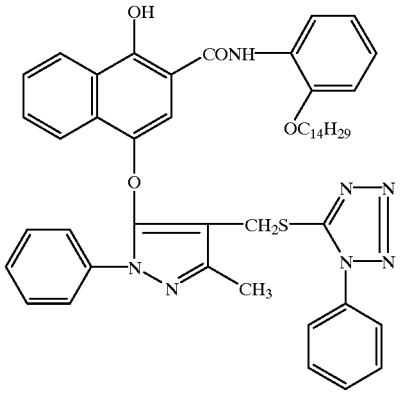
D-2
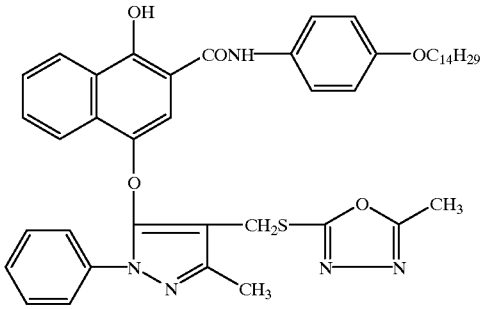
D-3
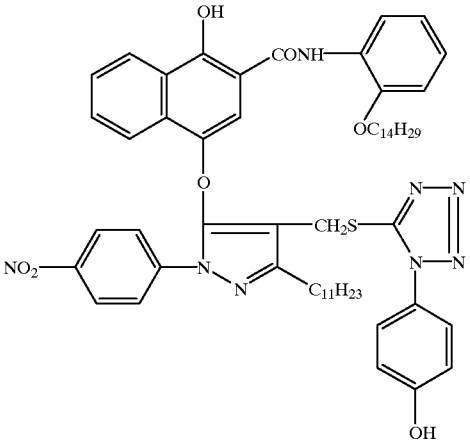
UV-1
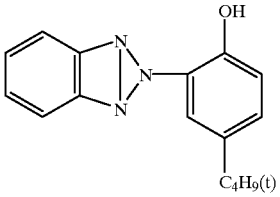
UV-4
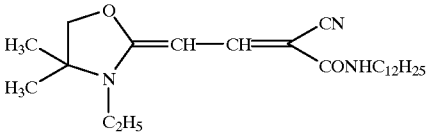

-continued
SC-1
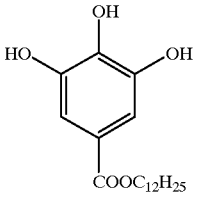
SC-2
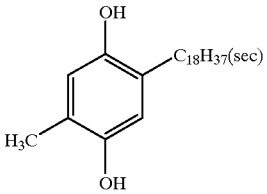
and
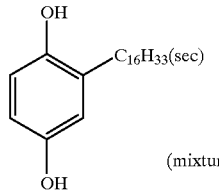
(mixture of 2:3)
HS-1
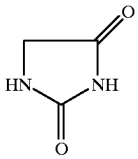
HS-2
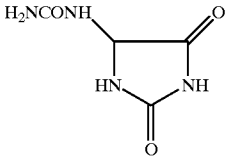
Oil-1
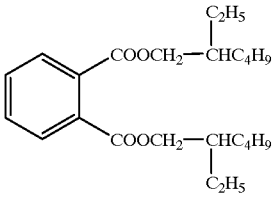
Oil-2
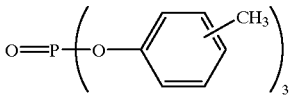
Oil-3
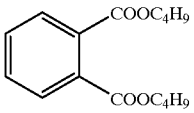
WAX-1
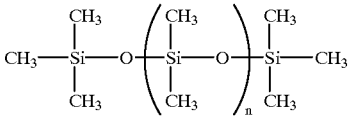
weight average molecular weight MW: 30,000
SU-1
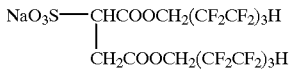

-continued
SU-2
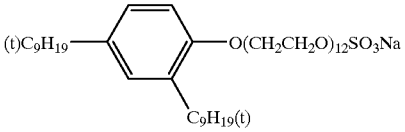
SU-3
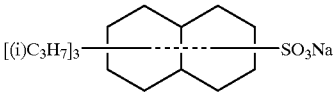
SU-4
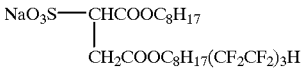
S-1
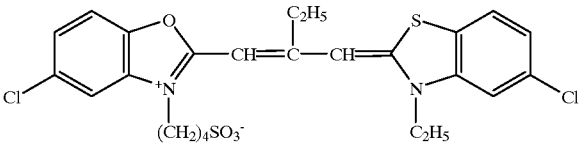
S-2
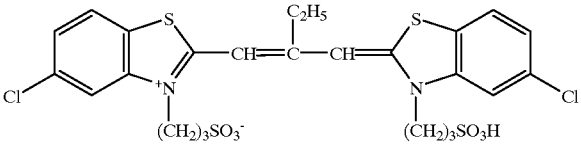
S-3
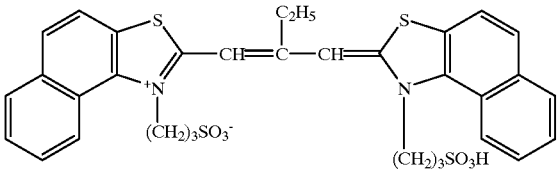
S-4
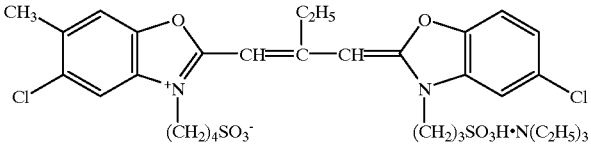
S-5
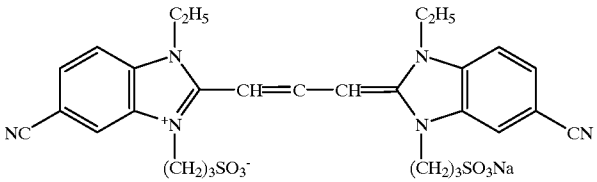
S-6
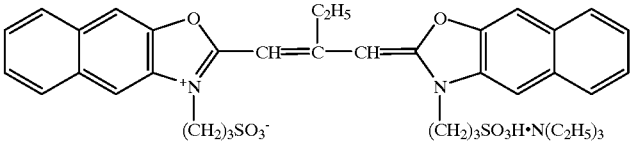
S-7
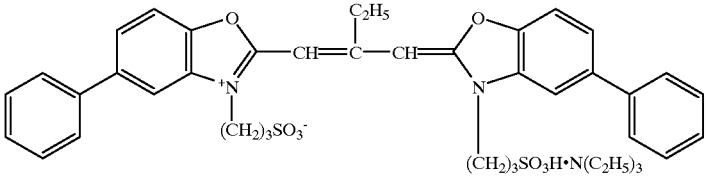

-continued
S-8
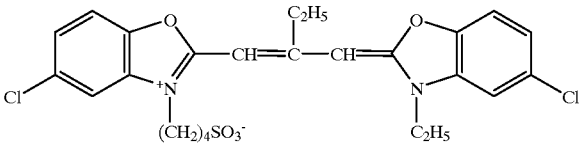
S-9
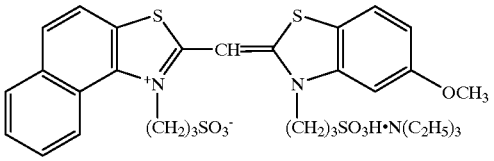
S-10
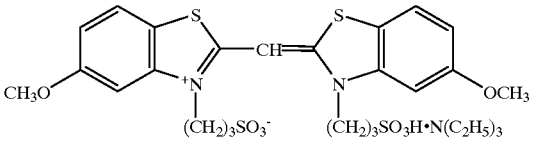
S-11
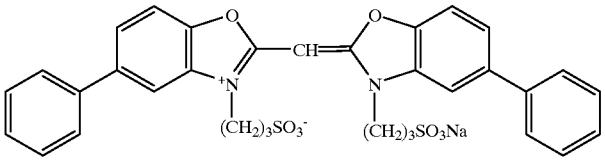
H-2
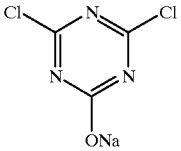
H-3
$[(CH_2{=}CHSO_2CH_2)_3CCH_2SO_2CH_2CH_2]_2NCH_2CH_2SO_3K$
H-4
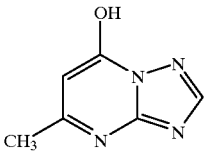
DI-1
Mixture of 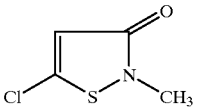 and 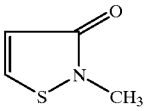
AF-1
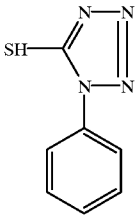
AF-2
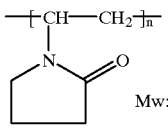
Mw: 9,000

-continued

Al-5

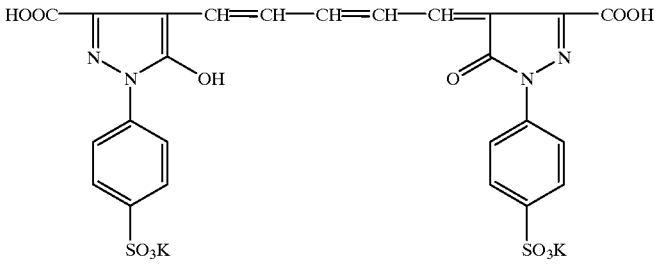

Al-6

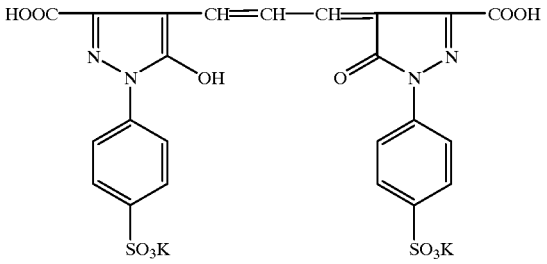

CM-1

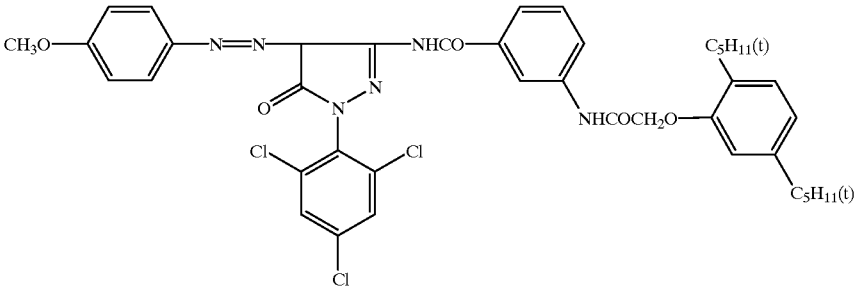

Samples 502 to 516 were prepared in the same manner as in Sample 501, except that the cyan coupler C-20 and High-boiling point solvent (Oil-1) in the 3rd and 4th layers of Sample 501 were replaced with the cyan couplers shown in Table 13 below.

Each of Samples 501 to 516 prepared as mentioned above was exposed through a wedge for 1/100 second employing white light and was subjected to the following photographic processing.

(Photographic Processing)

Photographic Processing Steps (38° C.)

| | |
|---|---|
| Color development | 3 minutes 15 seconds |
| Bleaching | 6 minutes 30 seconds |
| Washing | 3 minutes 15 seconds |
| Fixing | 6 minutes 30 seconds |
| Washing | 3 minutes 15 seconds |
| Stabilizing | 1 minute 30 seconds |
| Drying | |

Compositions of the processing solution employed in each processing step are as follows.

(Color Developer)

| | |
|---|---|
| 4-Amino-3-methyl-N-ethyl-N-(β-hydroxyethyl)aniline sulfate salt | 4.75 g |
| Sodium suifite anhydride | 4.25 g |
| Hydroxylamine ½ sulfate salt | 2.0 g |

-continued

| | |
|---|---|
| Potassium carbonate anhydride | 37.5 g |
| Potassium bromide | 1.3 g |
| Nitrilotriacetic acid 3 sodium salt | 2.5 g |
| Potassium hydroxide | 1.0 g |
| Water to make | 1 liter |
| pH adjusted to | pH 10.2 |
| (Bleach Solution) | |
| Ethylenediaminetetraacetic acid ferric (III) ammonium salt | 100 g |
| Ethylenediaminetetraacetic acid 2 ammonium salt | 10.0 g |
| Ammonium bromide | 150.0 g |
| Glacial acetic acid | 10 ml |
| Water to make | 1 liter |
| pH adjusted to | 6.0 |
| (Fixing solution) | |
| Ammonium thiosulfate (50% aqueous solution) | 175.0 g |
| Sodium sulfite anhydride | 8.5 g |
| Sodium metasulfite | 2.3 g |
| Water to make | 1 liter |
| pH adjusted to | 6.0 |
| (Stabilizer) | |
| Formalin (37% agueous solution) | 1.5 ml |
| Koniducks (manufactured by Konica Corp.) | 7.5 ml |
| Water to make | 1 liter |
| (Evaluation Methods) | |
| (Sensitivity) | |

Samples obtained by processing were subjected to sensitometric measurement to obtain red sensitivity. Further, exposure amount to provide a density of the minimum density+0.1 was obtained to measure sensitivity and the sensitivity was expressed in terms of relative value when the sensitivity of Sample 501 was 100.

(Recoloring)

To the bleach solution (hereinafter referred to as "new BL") employed for processing the above-mentioned Samples, was added 5 g of hydrosulfite to reduce the bleaching strength. Thus, the bleach solution, simulating an exhausted bleach solution (hereinafter referred to as "exhausted BL"), was prepared. Employing the exhausted BL, samples were subjected to the same processing as above. Compared to the maximum density of the obtained cyan dye, the recoloring (%) were calculated according to the following formula. Table 13 shows the results.

Recoloring (%)={(maximum density when exhausted BL is employed)/(maximum density when new BL is employed)}×100

(Color Reproduction)

Color Checker manufactured by Macbeth Co. was photographed employing each Sample and a camera (Konica FT-1 manufactured by Konica Corp.), and the exposed Sample was then processed employing the above-mentioned photographic processing. The resultant negative film image was printed onto Konica Color Paper Type QA in a size of 82 mm×117 nm employing a Konica Color Printer CL-P2000 (manufactured by Konica Corp.) Printer conditions were set so that gray color on the Color Checker was reproduced to be gray color on the print). The color reproduction on the practical print was visually evaluated (functional evaluation by a panel consisting of 10 persons: A: excellent, B: good, C: acceptable, D: not acceptable).

Table 13 shows the above results.

TABLE 13

| Sample No. | Coupler | High-boiling point solvent | Sensitivity | Recoloring | Color Reproduction |
|---|---|---|---|---|---|
| 501 | C-20 | Oil-1 | 106 | 90 | C |
| 502 | C-28 | Oil-1 | 105 | 92 | C |
| 503 | C-72 | Oil-1 | 102 | 78 | D |
| 504 | C-73 | Oil-1 | 103 | 85 | D |
| 505 | C-20 | L-7 | 113 | 98 | A |
| 506 | C-20 | L-15 | 115 | 99 | A |
| 507 | C-20 | L-23 | 111 | 99 | A |
| 508 | C-28 | L-7 | 112 | 98 | A |
| 509 | C-28 | L-15 | 112 | 96 | A |
| 510 | C-28 | L-23 | 110 | 98 | A |
| 511 | C-72 | L-7 | 110 | 94 | B |
| 512 | C-72 | L-15 | 112 | 94 | B |
| 513 | C-72 | L-23 | 110 | 93 | B |
| 514 | C-73 | L-7 | 115 | 93 | B |
| 515 | C-73 | L-15 | 15 | 95 | B |
| 516 | C-73 | L-23 | 114 | 94 | B |

Samples 501 to 504 employing the Oil-1 other than the liquid crystal exhibit insufficient color reproduction. Contrary to this, Samples 505 to 516 employing and the liquid crystals exhibit excellent recoloring and also color reproduction, and furthermore have no effect on sensitivity.

According to the present invention, it is possible to provede, firstly, a silver halide light-sensitive color photographic material which exhibits high sensitivity and improved color reproduction, and secondly to provide a silver halide light-sensitive color photographic material which exhibits a minimal decrease in the color image density upon processing even with an exhausted bleach solution.

We claim:

1. A silver halide light-sensitive color photographic material comprising a silver halide emulsion layer containing a coupler and a thermotropic liquid crystal compound.

2. The silver halide light-sensitive color photographic material of claim 1 wherein the liquid crystal compound is a smectic thermotropic liquid crystal compound or nematic thermotropic liquid crystal compound.

3. The silver halide light-sensitive color photographic material of claim 1 wherein the liquid crystal compound is thermotropic low molecular liquid crystal compound.

4. The silver halide light-sensitive color photographic material of claim 3 wherein the liquid crystal compound is a smectic thermotropic low molecular liquid crystal compound or nematic thermotropic low molecular liquid crystals.

5. The silver halide light-sensitive color photographic material of claim 4 wherein the liquid crystal compound is represented by general formula (L-1) or (L-2):

General formula (L-1)

$$Y_1\text{-}A_1\text{-}(X_1)m\text{-}A_2\text{-}Y_2$$

General formula (L-2)

$$Y_1\text{-}A_1\text{-}(X_1)m\text{-}A_2\text{-}(X_2)n\text{-}A_3\text{-}Y_2$$

wherein $A_1$, $A_2$, and $A_3$ eah represents an alicyclic group or a aromatic group; $X_1$ and $X_2$ each represents a bonding group; m and n each represents 0 or 1, and $Y_1$ and $Y_2$ each represents a substituent.

6. The silver halide light-sensitive color photographic material of claim 3 wherein the photographic material comprises ablue-sensitive silver halide emulsion layer, a green-sensitive silver halide emulsion layer, and a red-sensitive silver halide emulsion layer, and the green-sensitive emulsion layer comprises the thermotropic low molecular liquid crystal compound and a magenta coupler represented by the following general formula M-1, General formula M-1

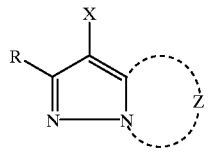

wherein R represents a hydrogen atom or a substituent; z represents a group of nonmetallic atoms necessary for forming a nitrogen-containing heterocyclic ring and said ring formed by said Z may have a substituent, X represents a split-off group upon reacting with the oxide of a color developing agent.

7. The silver halide light-sensitive color photographic material of claim 1 wherein the photographic material comprises a blue-sensitive silver halide emulsion layer, a green-sensitive silver halide emulsion layer, and a red-sensitive silver halide emulsion layer, and the red-sensitive emulsion layer comprises the thermotropic liquid crystal compound and a compound represented by the general formulas (I) to (IV), (IX), (X), or (XI);

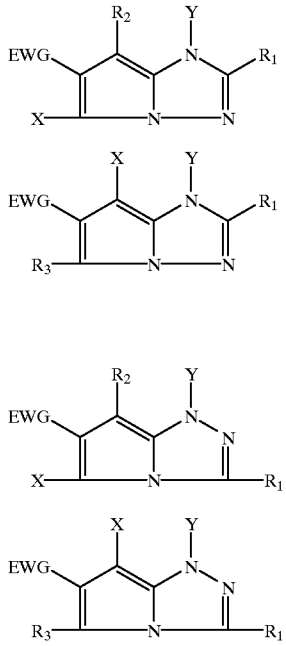

wherein $R_1$, $R_2$, and $R_3$, and Y each represents a hydrogen atom or a substituent; EWG is an electron attractive group having a Hammett substituent constant $\sigma_P$ of not less than 0.3, and X represents a hydrogen atom or a split-off group upon reaction with the oxide of a color developing agent;

General formula (IX)

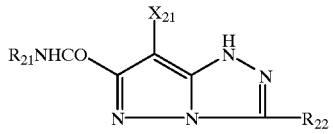

General formula (X)

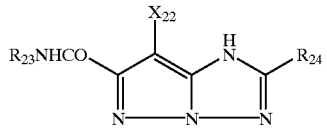

wherein $R_{21}$ and $R_{23}$ each represents a branched alkyl group, a substituted alkyl group, a substituted aryl group or a heterocyclic group, and $R_{22}$ and $R_{24}$ each represents a substituent; $X_{21}$ and $X_{22}$ each represents a hydrogen atom, a halogen atom, or a split-off group upon reaction with the oxide of a color developing agent;

General formula (XI)

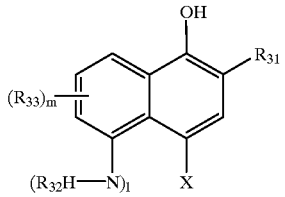

wherein $R_{31}$ represents —CON($R_{34}$)($R_{35}$), —NHCO$R_{34}$, —NHCOO$R_{36}$, —NHSO$_2$$R_{36}$, —NHCON($R_{35}$)($R_{36}$), —SO$_2$N($R_{34}$)($R_{35}$) or —NHSO$_2$N($R_{34}$)($R_{35}$); $R_{32}$ represents a hydrogen atom or a substituent; $R_{33}$ represents a substituent; X represents a hydrogen atom or a split-off group upon reaction with the oxide of an aromatic primary amine developing agent; 1 represents 0 or 1; m represents an integer of 0 to 3; $R_{34}$ and $R_{35}$ each represents a hydrogen atom, an aromatic group, an aliphatic group or a heterocyclic group; $R_{36}$ represents an aromatic group, an aliphatic group or a heterocyclic group; when m is 2 or 3, each $R_{33}$ may be the same or different or may form a ring through linking with each other, and $R_{34}$ and $R_{35}$, $R_{32}$ and $R_{33}$, $R_{32}$ and X may combine with each other to form a ring. However, when l is 0, m is 0 and $R_{31}$ is —CONH$R_{37}$ in which $R_{37}$ represents an aromatic group.

8. The silver halide light-sensitive color photographic material of claim 7 wherein the red-sensitive emulsion layer comprises the thermotropic liquid crystal compound and a compound represented by the general formulas (I) to (IV);

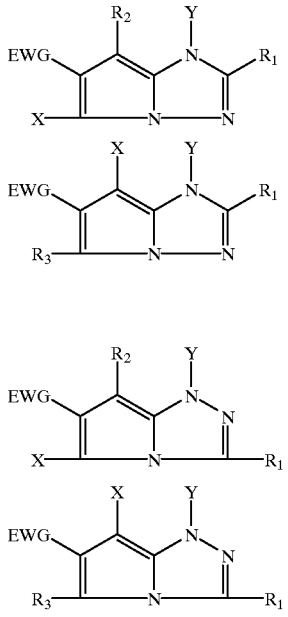

wherein $R_1$, $R_2$, and $R_3$, and Y each represents a hydrogen atom or a substituent; EWG is an electron attractive group having a Hammett substituent constant $\sigma_P$ of not less than 0.3, and X represents a hydrogen atom or a split-off group upon reaction with the oxide of a color developing agent.

9. The silver halide light-sensitive color photographic material of claim 8 wherein the thermotropic liquid crystal compound is a smectic thermotropic liquid crystal compound or nematic thermotropic liquid crystal compound.

10. The silver halide light-sensitive color photographic material of claim 8 wherein the thermotropic liquid crystal compound is represented by the following general formula (L-1) or (L-2), General formula (L-1)

$$Y_1\text{-}A_1\text{-}(X_1)m\text{-}A_2\text{-}Y_2$$

General formula (L-2)

$$Y_1\text{-}A_1\text{-}(X_1)m\text{-}A_2\text{-}(X_2)n\text{-}A_3\text{-}Y_2$$

wherein $A_1$, $A_2$, and $A_3$ each represents an alicyclic group or a aromatic group; $X_1$ and $X_2$ each represents a bonding group; m and n each represents 0 or 1, and $Y_1$ and $Y_2$ each represents a substituent.

11. The silver halide light-sensitive color photographic material of claim 7 wherein the red sensitive layer comprises the thermotropic liquid crystal compound and a compound represented by general formula (IX) or (X), General formula (IX)

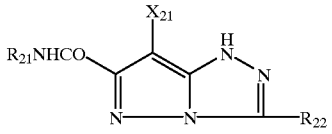

General formula (X)

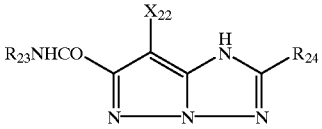

wherein $R_{21}$ and $R_{23}$ each represents a branched alkyl group, a substituted alkyl group, a substituted aryl group or a heterocyclic group, and $R_{22}$ and $R_{24}$ each represents a substituent. $X_{21}$ and $X_{22}$ each represents a hydrogen atom, a halogen atom, or a split-off group upon reaction with the oxide of a color developing agent.

12. The silver halide light-sensitive color photographic material of claim 11 wherein the thermotropic liquid crystal compound is represented by the following general formula (L-1) or (L-2), General formula (L-1)

$$Y_1\text{-}A_1\text{-}(X_1)m\text{-}A_2\text{-}Y_2$$

General formula (L-2)

$$Y_1\text{-}A_1\text{-}(X_1)m\text{-}A_2\text{-}(X_2)n\text{-}A_3\text{-}Y_2$$

wherein $A_1$, $A_2$, and $A_3$ each represents an alicyclic group or a aromatic group; $X_1$ and $X_2$ each represents a bonding group; m and n each represents 0 or 1, and $Y_1$ and $Y_2$ each represents a substituent.

13. The silver halide light-sensitive color photographic material of claim 11 wherein the thermotropic liquid crystal compound is smectic thermotropic liquid crystal or nematic thermotropic liquid crystal.

14. The silver halide light-sensitive color photographic material of claim 1 wherein the liquid crystal compound is a thermotropic high molecular liquid crystal compound.

15. The silver halide light-sensitive color photographic material of claim 14 wherein the liquid crystal is a smectic thermotropic high molecular liquid crystal compound or nematic thermotropic high molecular liquid crystals.

16. The silver halide light-sensitive color photographic material of claim 14 wherein the liquid crystal compound is represented by general formula (L-3), (L-4) or (L-5), General formula (L-3)

$$-\!\!\left[Y_{11}-A_{11}-(X_{11})_k-A_{12}-Y_{12}\right]_n\!\!-$$

General formula (L-4)

$$-\!\!\left[Y_{11}-A_{11}-(X_{11})_k-A_{12}-(X_{12})_l-A_{13}-Y_{12}\right]_n\!\!-$$

General formula (L-5)

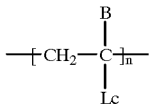

Lc: $-Y_{11}\text{-}A_{11}\text{-}(X_{11})_k\text{-}A_{12}\text{-}Y_{13}$ or $-Y_{11}\text{-}A_{11}\text{-}(X_{11})_k\text{-}A_{12}\text{-}(X_{12})_l\text{-}A_{13}\text{-}Y_{13}$ wherein $A_{11}$, $A_{12}$, and $A_{13}$ each represents an alicyclic group or a aromatic group; $X_{11}$, $X_{12}$, $Y_{11}$ and $Y_{12}$ each represents a bonding group; k and l each represents 0 or 1, and $Y_{13}$ represents a substituent; B is a methyl group or a hydrogen atom; n represents recurring number.

17. The silver halide light-sensitive color photographic material of claim 14 wherein the photographic material comprises a blue-sensitive silver halide emulsion layer, a green-sensitive silver halide emulsion layer, and a red-sensitive silver halide emulsion layer, and the green-sensitive emulsion layer comprises the thermotropic high molecular liquid crystal and a magenta coupler represented by the following general formula M-1, General formula M-1

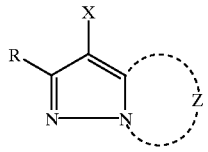

wherein R represents a hydrogen atom or a substituent; Z represents a group of nonmetallic atoms necessary for forming a nitrogen-containing heterocyclic ring and said ring formed by said Z may have a substituent, X represents a split-off group upon reacting with the oxide of a color developing agent.

18. A silver halide light-sensitive color photographic, material comprising a silver halide emulsion layer wherein the silver halide emulsion layer contains a coupler and a high-boiling point organic solvent comprising a thermotropic liquid crystal compound.

19. The silver halide light-sensitive color photographic material of claim 18 wherein the thermotropic liquid crystal compound is represented by the following general formula (L-1) or (L-2), General formula (L-1)

$$Y_1\text{-}A_1\text{-}(X_1)m\text{-}A_2\text{-}Y_2$$

General formula (L-2)

$$Y_1\text{-}A_1\text{-}(X_1)m\text{-}A_2\text{-}(X_2)n\text{-}A_3\text{-}Y_2$$

wherein $A_1$, $A_2$, and $A_3$ each represents an alicyclic group or a aromatic group; $X_1$ and $X_2$ each represents a bonding group; m and n each represents 0 or 1, and $Y_1$ and $Y_2$ each represents a substituent.

20. The silver halide light-sensitive color photographic material of claim 18 wherein said silver halide emulsion layer is on a support.

21. A silver halide light-sensitive color photographic material comprising a silver halide emulsion layer wherein the silver halide emulsion layer contains an oil drop of a thermotropic liquid crystal compound.

22. The silver halide light-sensitive color photographic material of claim 21 wherein the thermotropic liquid crystal compound is represented by the following general formula (L-1) or (L-2), General formula (L-1)

$$Y_1\text{-}A_1\text{-}(X_1)m\text{-}A_2\text{-}Y_2$$

General formula (L-2)

$$Y_1\text{-}A_1\text{-}(X_1)m\text{-}A_2\text{-}(X_2)n\text{-}A_3\text{-}Y_2$$

wherein $A_1$, $A_2$, and $A_3$ each represents an alicyclic group or a aromatic group; $X_1$ and $X_2$ each represents a bonding group; m and n each represents 0 or 1, and $Y_1$ and $Y_2$ each represents a substituent.

* * * * *